US007077517B2

(12) United States Patent
Awai et al.

(10) Patent No.: US 7,077,517 B2
(45) Date of Patent: Jul. 18, 2006

(54) IMAGE READING AND RECORDING APPARATUS

(75) Inventors: Takashi Awai, Tokyo (JP); Akio Okubo, Tokyo (JP); Hideyuki Terashima, Chiba-ken (JP); Yoshiaki Suzuki, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 10/739,347

(22) Filed: Dec. 19, 2003

(65) Prior Publication Data

US 2004/0179045 A1 Sep. 16, 2004

(30) Foreign Application Priority Data

Dec. 24, 2002 (JP) ..... 2002-373313

(51) Int. Cl.
*B41J 11/00* (2006.01)

(52) U.S. Cl. ..... 347/104; 347/218; 400/185; 400/187; 358/498

(58) Field of Classification Search ..... None
See application file for complete search history.

(56) References Cited

U.S. PATENT DOCUMENTS

| | | | | | |
|---|---|---|---|---|---|
| 4,649,437 | A | * | 3/1987 | Watanabe | 358/474 |
| 4,706,125 | A | * | 11/1987 | Takagi | 358/406 |
| 4,866,531 | A | * | 9/1989 | Kobori et al. | 358/400 |
| 4,978,112 | A | * | 12/1990 | Yokoi | 271/9.02 |
| 4,998,121 | A | | 3/1991 | Koh et al. | 346/160 |
| 5,043,763 | A | | 8/1991 | Koh et al. | 355/206 |
| 5,124,800 | A | * | 6/1992 | Hashimoto | 358/296 |
| 5,153,655 | A | | 10/1992 | Suzuki et al. | 355/285 |
| 5,157,444 | A | | 10/1992 | Mori et al. | 355/282 |
| 5,745,661 | A | | 4/1998 | Koh et al. | 395/113 |
| 5,913,099 | A | | 6/1999 | Kamei et al. | 399/296 |
| 5,940,543 | A | | 8/1999 | Isemura et al. | 382/284 |
| 5,954,326 | A | * | 9/1999 | Gaarder et al. | 271/9.02 |
| 6,102,506 | A | | 8/2000 | Sasai et al. | 347/3 |
| 6,113,093 | A | | 9/2000 | Morinaga et al. | 271/162 |
| 6,523,929 | B1 | * | 2/2003 | Kan et al. | 347/22 |
| 6,948,871 | B1 | * | 9/2005 | Onishi et al. | 400/679 |

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

The present invention relates to an image reading and recording apparatus comprising: a driving source; a recording sheet feeding means for feeding a recording sheet; recording means for recording an image in a predetermined recording area on the recording sheet, supplied by the recording sheet feeding means, and movable to outside of the recording area; document feeding means for feeding a document; reading means movable between the reading position for reading an image on the document, fed by the document feeding means, and the stand by position withdrawn from the reading position; a document feeding force transmitting means for transmitting the driving force of the driving source to the document feeding means; and moving means for moving the reading means to the reading position by the driving force of the driving source at the time the recording means is moved to the outside of the recording area.

18 Claims, 68 Drawing Sheets

FIG.60

[Timing chart 1]

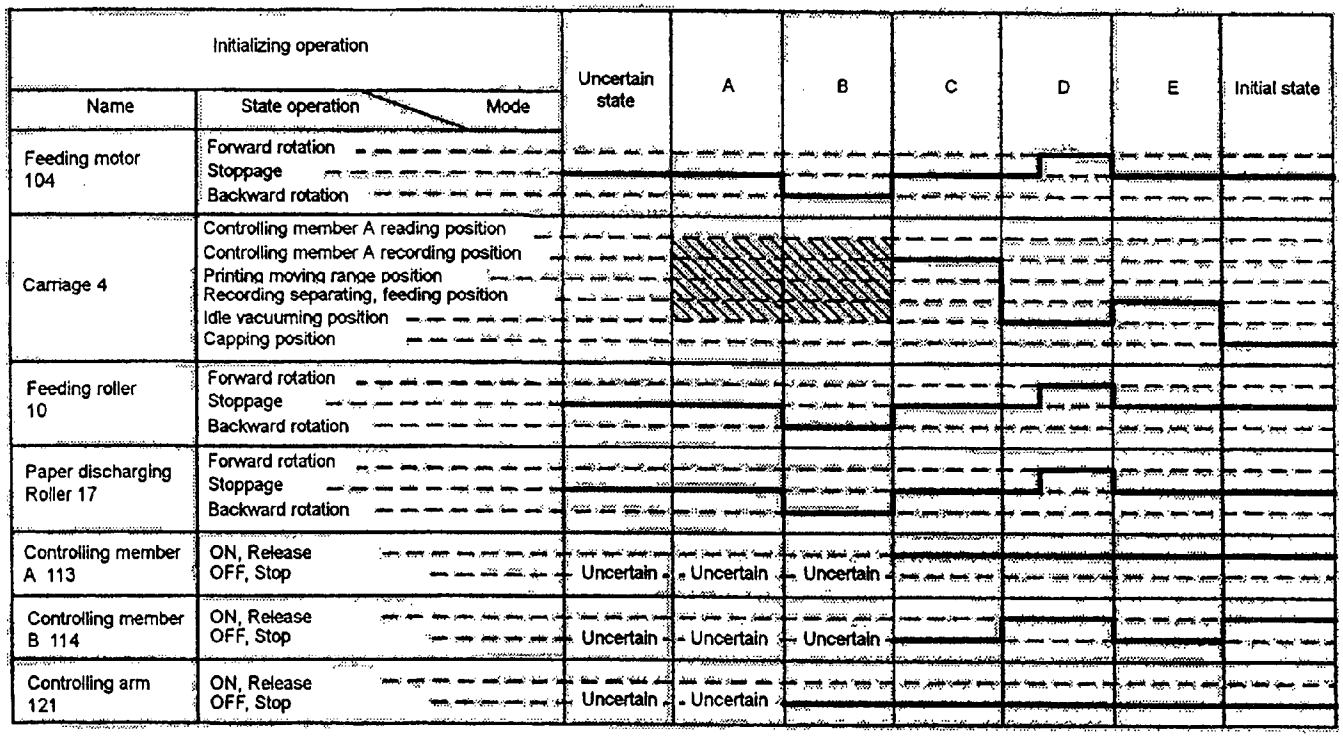

A Operation of displacing the carriage from the capping position
B Operation of certainly having the CS in the stand by state
C Operation of switching ON the controlling member A
D Operation to be executed only in the case the recording separating roller sensor is switched OFF
E Operation of moving the recording switching part to the idle rotation position

FIG.61

| | | | | | | | | |
|---|---|---|---|---|---|---|---|---|
| Recording switching means 151 | Recording separating feeding position | | | | | | | |
| | Idle rotation | Uncertain | Uncertain | | | | | |
| | Recovery position | | | | | | | |
| Reading switching means | A | | | | | | | |
| | Controlling art stopping position operation | Uncertain | Uncertain | | | | | |
| | Idle rotation | | | | | | | |
| CS driving arm 134 | Reading position | | | | | | | |
| | Stand by position | Uncertain | Uncertain | | | | | |
| Spring clutch | CS reading state maintaining position | | | | | | | |
| | Drive transmitting state | Uncertain | Uncertain | | | | | |
| | Stand by position | | | | | | | |
| Contact image sensor (CS) | Reading state | | | | | | | |
| | Moving state to the reading position | | | | | | | |
| | Recovery state to the stand by position | Uncertain | Uncertain | | | | | |
| | Stand by position | | | | | | | |
| Recording Separating Feeding means | Operation | | | | | | | |
| | Stoppage stand by state | Uncertain | Uncertain | Uncertain | Uncertain | | | |
| Recovery mode | Operation | | | | | | | |
| | Stoppage stand by state | Uncertain | Uncertain | | | | | |
| Recording paper Separating roller 19 | Operation | | | | | | | |
| | Stand by, Initial state | Uncertain | Uncertain | Uncertain | Uncertain | | | |
| Recording Separating Roller sensor | Operation (OFF) | | | | | | | |
| | Stand by, Initial state (ON) | Uncertain | Uncertain | Uncertain | Uncertain | | | |

A Reading separating, feeding, CS rotating position

[Timing chart 2]

A Controlling member A position confirmation mode
B Recording paper separating feeding mode

FIG.63

| | | | | | | | | |
|---|---|---|---|---|---|---|---|---|
| Recording switching means 151 | Recording separating feeding position | | | | | | | |
| | Idle rotation | Uncertain | | | | | | |
| | Recovery position | | | | | | | |
| Reading switching means | A | | | | | | | |
| | Controlling art stopping position operation | | | | | | | |
| | Idle rotation | | | | | | | |
| CS driving arm 134 | Reading position | | | | | | | |
| | Stand by position | | | | | | | |
| Spring clutch | CS reading state maintaining position | | | | | | | |
| | Drive transmitting state | | | | | | | |
| | Stand by position | | | | | | | |
| Contact image sensor (CS) | Reading state | | | | | | | |
| | Moving state to the reading position | | | | | | | |
| | Recovery state to the stand by position | | | | | | | |
| | Stand by position | | | | | | | |
| Recording Separating Feeding means | Operation | | | | | | | |
| | Stoppage stand by state | | | | | | | |
| Recovery mode | Operation | | | | | | | |
| | Stoppage stand by state | | | | | | | |
| Recording paper Separating roller 19 | Operation | | | | | | | |
| | Stand by, initial state | | | | | | | |
| Recording Separating Roller sensor | Operation (OFF) | | | | | | | |
| | Stand by, Initial state (ON) | | | | | | | |

A Reading separating, feeding, CS rotating position

FG.64
[Timing chart 3]

| Recovery operation | | Initial state | Vacuuming state | Idle vacuuming state | Initial state |
|---|---|---|---|---|---|
| Name | State operation / Mode | | | | |
| Feeding motor 104 | Forward rotation | | | | |
| | Stoppage | | | | |
| | Backward rotation | | | | |
| Carriage 4 | Controlling member A reading position | | | | |
| | Controlling member A recording position | | | | |
| | Printing moving range position | | | | |
| | Recording separating, feeding position | | | | |
| | Idle vacuuming position | | | | |
| | Capping position | | | | |
| Feeding roller 10 | Forward rotation | | | | |
| | Stoppage | | | | |
| | Backward rotation | | | | |
| Paper discharging Roller 17 | Forward rotation | | | | |
| | Stoppage | | | | |
| | Backward rotation | | | | |
| Controlling member A 113 | ON, Release | | | | |
| | OFF, Stop | | | | |
| Controlling member B 114 | ON, Release | | | | |
| | OFF, Stop | | | | |
| Controlling arm 121 | ON, Release | | | | |
| | OFF, Stop | | | | |

FIG.65

| | | | | | |
|---|---|---|---|---|---|
| Recording switching means 151 | Recording separating feeding position<br>Idle rotation<br>Recovery position | Uncertain | | | |
| Reading switching means | A<br>Controlling art stopping position operation<br>Idle rotation | | | | |
| CS driving arm 134 | Reading position<br>Stand by position | | | | |
| Spring clutch | CS reading state maintaining position<br>Drive transmitting state<br>Stand by position | | | | |
| Contact image sensor (CS) | Reading state<br>Moving state to the reading position<br>Recovery state to the stand by position<br>Stand by position | | | | |
| Recording Separating Feeding means | Operation<br>Stoppage stand by state | | | | |
| Recovery mode | Operation<br>Stoppage stand by state | | | | |
| Recording paper Separating roller 19 | Operation<br>Stand by, initial state | | | | |
| Recording Separating Roller sensor | Operation (OFF)<br>Stand by, Initial state (ON) | | | | |

A Reading separating, feeding, CS rotating position

FIG.66
[Timing chart 4]

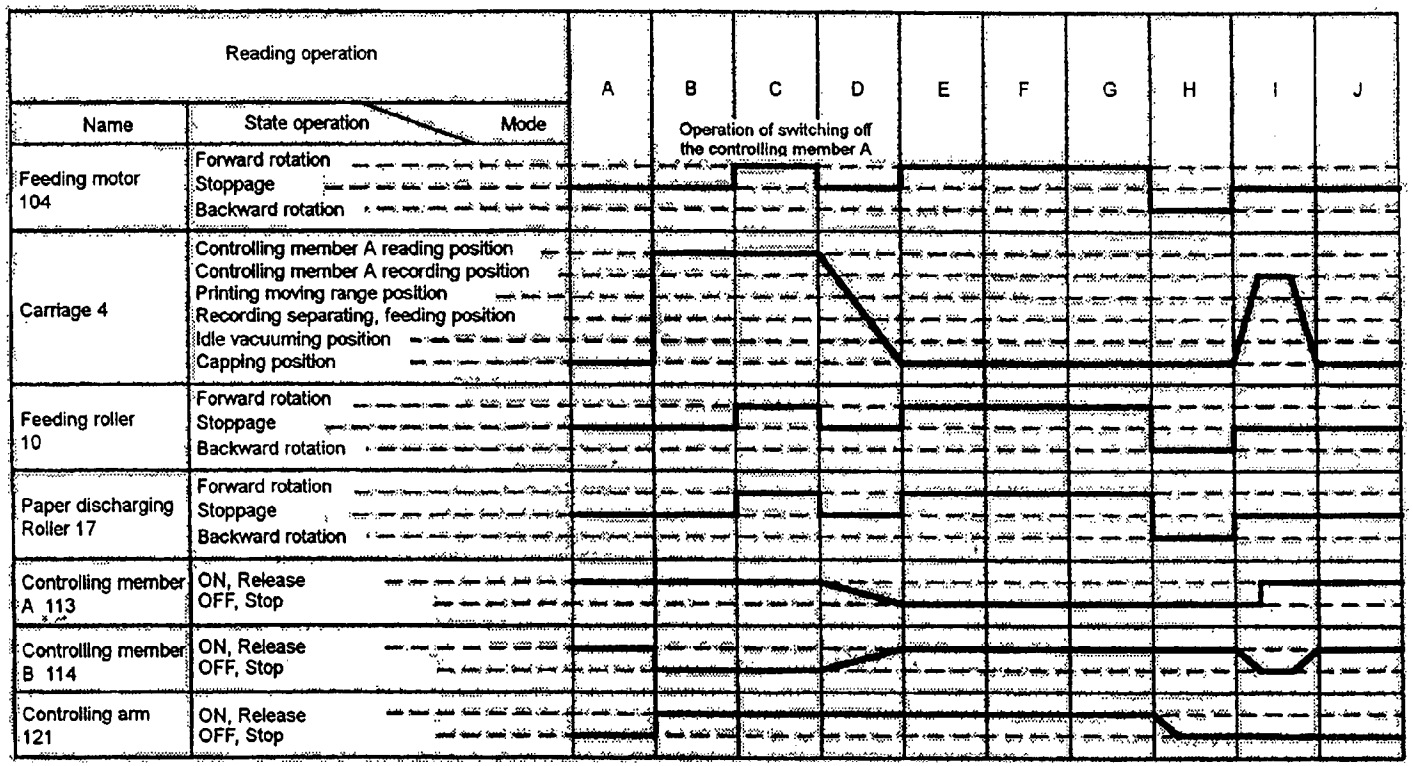

A Initial state
B Controlling arm releasing operation
C Move of the CS by the second switching means and drive switch to the document feeding means
D Move operation of the carriage to the capping position
E Move of the CS to the reading position and move of the document to the reading position
F Document feed and reading state
G Document paper discharging state
H Recovery operation of the CS to the stand by state
I Operation of switching on the controlling member A
J Initial state A Reading separating, feeding, CS rotating position

IMAGE READING AND RECORDING APPARATUS

BACKGROUND OF THE INVENTION

1. Field of the Invention

The present invention relates to an image reading and recording apparatus comprising integrally reading means for reading an image of a document, and recording means for recording (printing) an image on a recording medium, such as a facsimile.

2. Description of the Related Art

With reference to FIG. 68, an ink jet recording type facsimile, which has conventionally been used frequently, will be explained as an example of an image reading and recording apparatus.

Recording papers P are placed on a recording paper supporting member 303 so as to be supplied one by one into an apparatus main body 300A of a facsimile 300 by a recording paper feeding roller 304 and an unshown separating mechanism. The recording paper P supplied into the apparatus main body 300A is fed to a printing part 306 by a feeding roller 305 so that an image is formed on the upper surface thereof by an image forming mechanism such as an ink jet of the printing part 306. Then, the recording paper P is discharged to the outside of the apparatus main body 300A by a paper discharging roller 307 (arrow B direction).

In contrast, documents D are placed on a document supporting member 308, and it is set in a state butted against a wedge-like shape part formed by a document separating roller 309 and a separating piece 313. In the case where the document separating roller 309 is rotated according to an image reading command, only the document in contact with the document separating roller 309 out of the documents supported in a wedge-like shape, is separated from the other documents and fed according to friction of the document separating roller 309.

The document D separated and fed is clamped by a document feeding roller, a paper discharging roller 312 and rollers 314, 315 facing thereto so as to be fed according to the rotation or the rollers 310, 312. After reading the image information by a contact image sensor 311, or the like, it is discharged to the outside of the apparatus main body 300A (arrow A direction).

However, according to the facsimile 300, since independent feed mechanisms have been required for feeding the document D and the recording paper P, there has been a limitation for realizing the miniaturization and a low cost of the facsimile 300.

SUMMARY OF THE INVENTION

Accordingly, an object of the present invention is to provide an image reading and recording apparatus capable of realizing the miniaturization and a low cost of the apparatus main body, and executing highly sophisticated image reading and high quality image recording.

In order to achieve the above-mentioned object, an image reading and recording apparatus according to the present invention comprises a driving source, a recording sheet feeding means for feeding a recording sheet, recording means for recording an image on the recording sheet, supplied by the recording sheet feeding means, a document feeding means for feeding a document, reading means for reading an image on the document, fed by the document feeding means, a document feeding force transmitting means for transmitting the driving force of the driving source to the document feeding means, and moving means for moving the reading means to a reading position for reading the document by the driving force of the driving source by disposing the recording means to the outside of a recording area for recording an image to the recording sheet.

According to the image reading and recording apparatus of the present invention, the document can be read certainly, and a high quality read image can be obtained by preventing introduction of an external light beam at the time of pre-scanning (white reference adjustment) before a reading operation. Furthermore, an image recording operation to the recording sheet, and an image reading operation of the document can be executed by a common driving source.

In particular, according to the image reading and recording apparatus of the present invention, since selective feed of a recording sheet and a document, and operation of moving the means can be executed by one driving source, the miniaturization of the apparatus itself and cost reduction can be realized.

BRIEF DESCRIPTION OF THE DRAWINGS

FIG. 20 is an enlarged view of the step gear (A), the controlling arm, or the like;

FIG. 60 is a timing chart of the initializing operation in the image reading and recording apparatus according to the present invention;

FIG. 61 is a timing chart as the continuation of FIG. 60;

FIG. 63 is a timing chart as the continuation of FIG. 62;

FIG. 64 is a timing chart of the recovery operation in the image reading and recording apparatus according to the present invention;

FIG. 65 is a timing chart as the continuation of FIG. 64;

FIG. 66 is a timing chart of the reading operation in the image reading and recording apparatus according to the present invention;

DESCRIPTION OF THE PREFERRED EMBODIMENTS

Hereinafter, embodiments of the present invention will be explained with reference to the drawings.

The size, the material, the shape, the relative arrangement thereof, or the like of the constituent parts disclosed in the embodiments do not limit the scope of the present invention thereto unless otherwise specified.

Moreover, in the explanation below, the terminology "contact image sensor" is abbreviated as the "CS".

Entire Configuration of the Image Reading and Recording Apparatus

Figure 1:
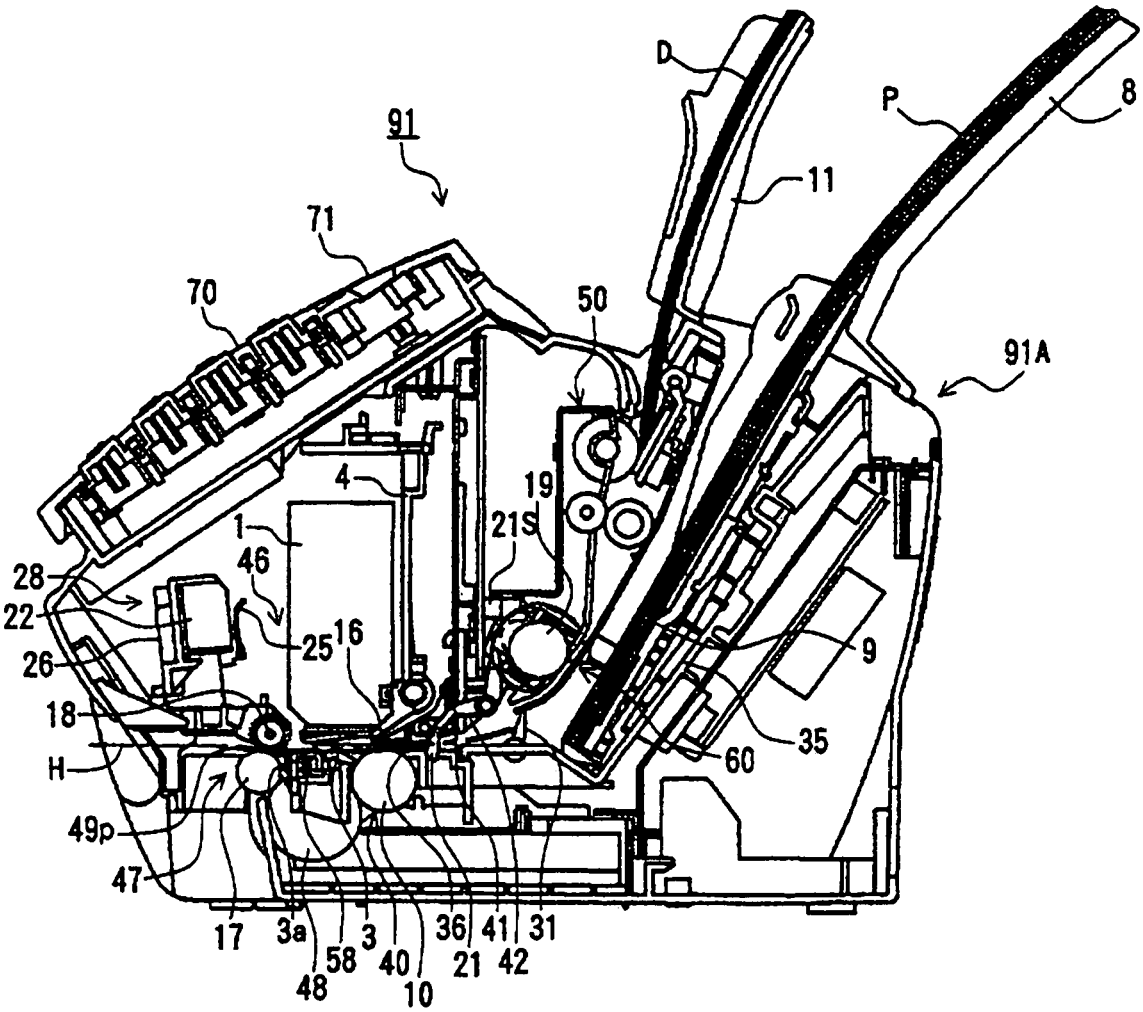
FIG. 1 is a diagram showing the state taken along the feeding direction of a document and a recording paper in an image reading and recording apparatus according to an embodiment of the present invention in a state of recording an image on the recording paper.
Figure 2:
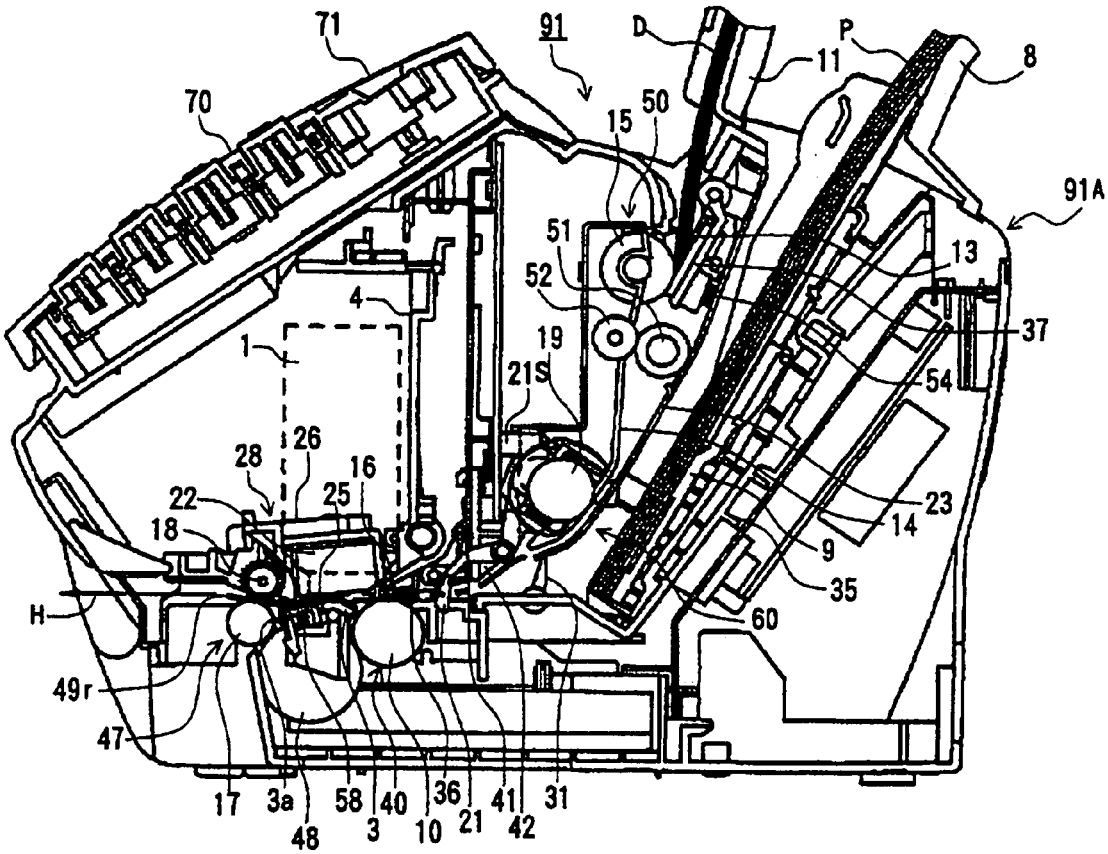
FIG. 2 is a diagram showing the state of reading the document in the image reading and recording apparatus of FIG. 1.
Figure 3:
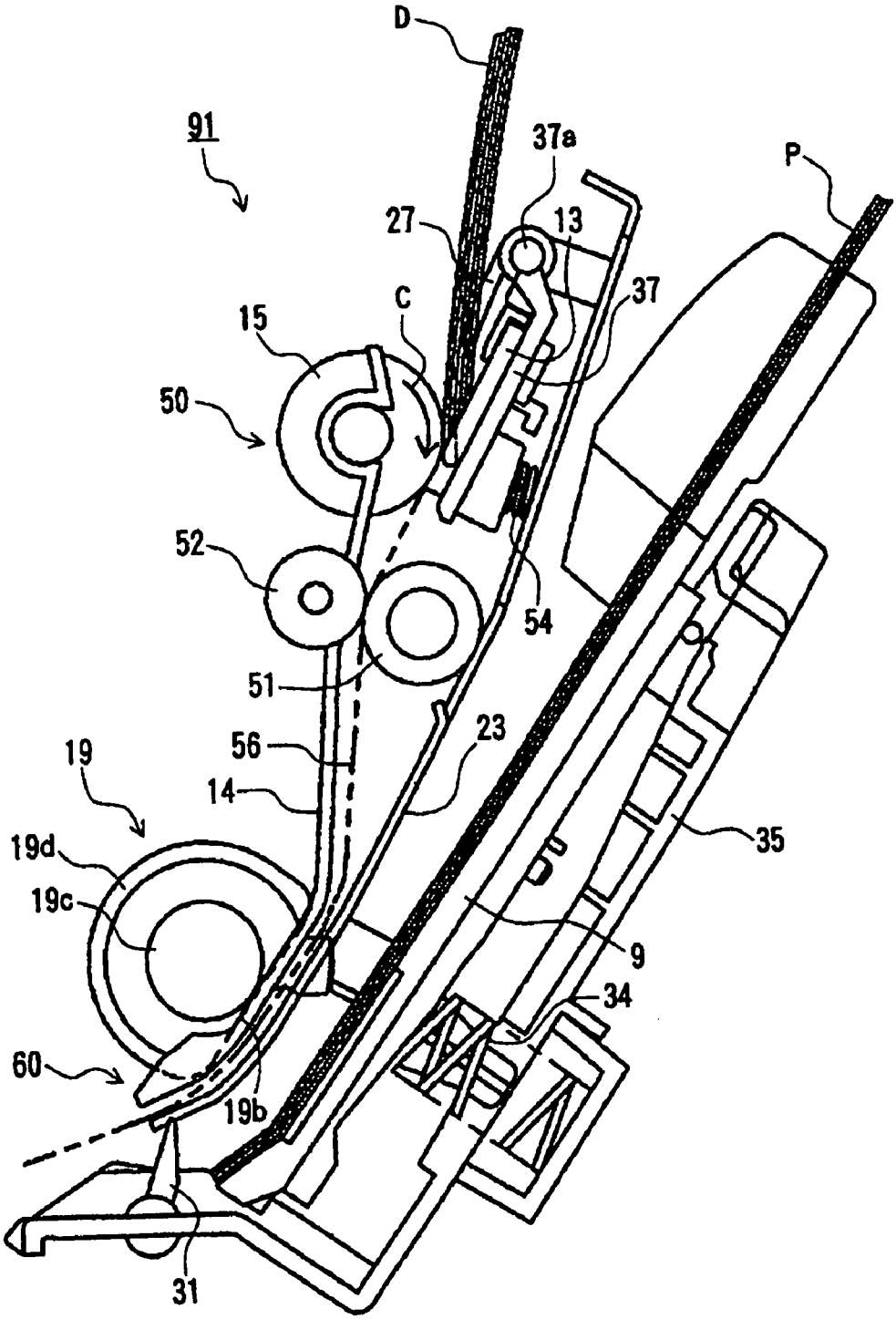
FIG. 3 is a diagram showing the state taken along the feeding direction of a document and a recording paper in the document feeding part and the recording paper feeding part in the image reading and recording apparatus of FIG. 1 in a state of supplying the document D by the document feeding part.
Figure 4:
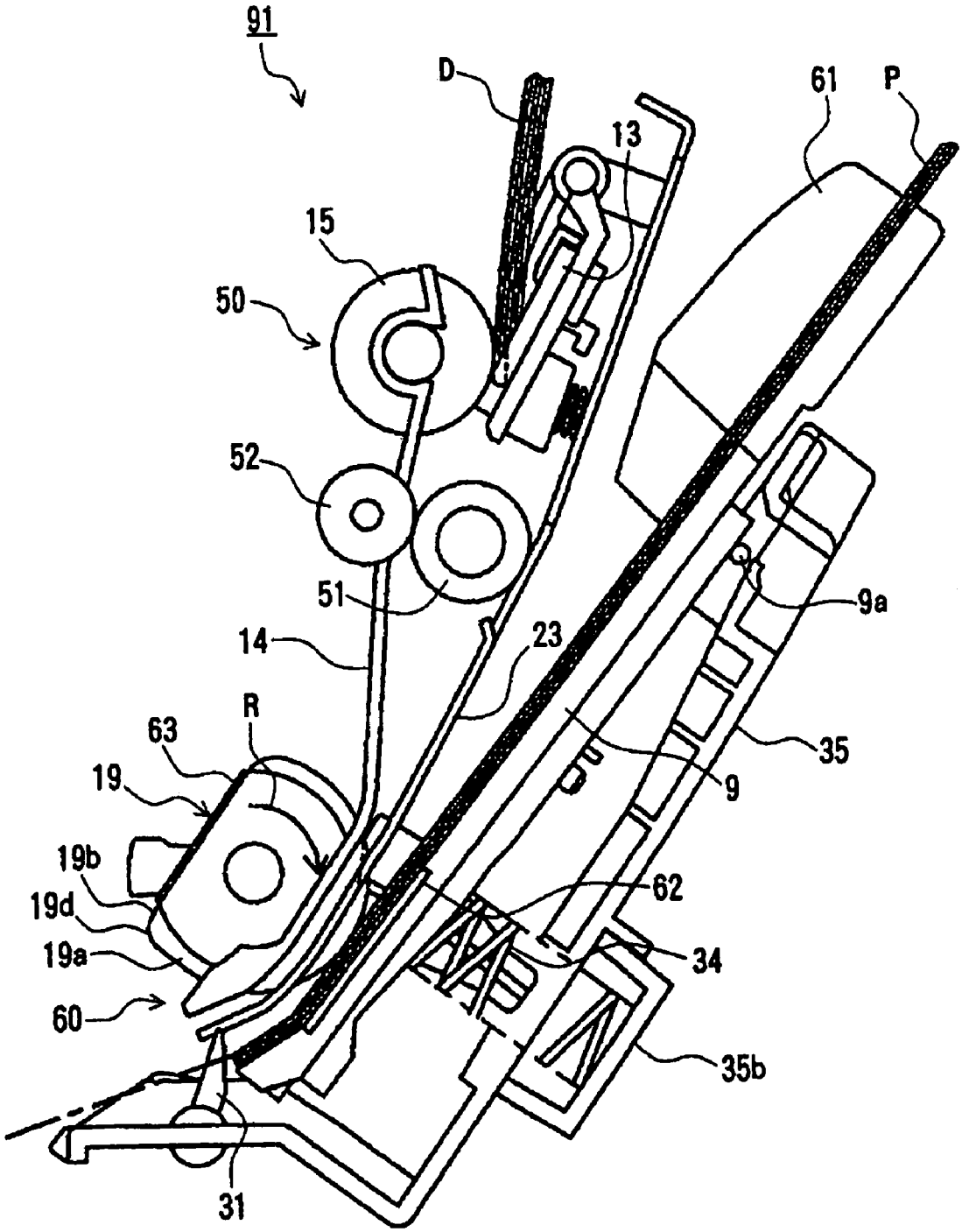
FIG. 4 is a diagram showing the state of feeding a recording paper into the apparatus main body by the recording paper feeding part in the image reading and recording apparatus of FIG. 1.

FIG. 1 is a cross-sectional view taken along the feeding direction of the document D and the recording paper P in the image reading and recording apparatus 91 of an embodiment of the present invention, showing the state of recording an image on the recording paper P. FIG. 2 is a diagram showing the state of reading the document D in the image reading and recording apparatus 91 of FIG. 1. FIG. 3 is a cross-sectional view taken along the feeding direction of the document D and the recording paper P in the document feeding part 50 and the recording paper feeding part 60 in the image reading and recording apparatus 91 of FIG. 1 in a state of supplying the document D by the document feeding part 60. FIG. 4 is a cross-sectional view showing a state of supplying the recording paper into the apparatus main body by the recording paper feeding part 60 in the image reading and recording apparatus 91 of FIG. 1.

A recording paper tray 8 for setting the recording sheet such as the recording paper P by the user, and a document tray 11 for setting a document such as the document D by the user are mounted in the rear part (on the right side in FIG. 1) of he apparatus main body 91A of the image reading and recording apparatus 91. Each separating mechanism is provided in the vicinity of the top end in the feeding direction of the trays 8, 11. The separating mechanisms are for separating and feeding the recording paper P and the document D set in the trays 8, 11 one by one.

The recording paper feeding part 60 as the recording sheet feeding means is provided with a recording paper separating roller 19, a base 35, a pressure plate 9, a pressure plate spring 34, a recording paper separating pad 62, a separating nail 31, or the like, and at least the recording paper separating roller 19 is necessary.

The recording paper separating roller 19, the recording paper separating pad 62, the separating nail 31, or the like comprise the above-mentioned separating mechanism. In general, a releasing cam 64 and a cam 66 shown in FIG. 6 to be described later press down the pressure plate 9 from the both sides along the recording paper P feeding direction to the position shown in FIG. 3. Since the pressure plate 9 is pressed down, the recording paper P is separated form the recording paper separating roller 19.

The document feeding means, for example, the document feeding part 50 is provided with a document separating roller 15, a document separating piece 13, a document feeding roller 51, a document feeding roller 52, or the like, and at least the document separating roller 15 is necessary.

The document separating piece 13 and the document feeding roller 51 comprise the above-mentioned separating mechanism. In the case where the recording paper feeding operation is started with the recording paper P set on the recording tray 8, the feeding roller 10 is rotated by a feeding motor 104 (see FIG. 15.), and the rotation is transmitted to the recording paper separating roller 19 and a releasing cam 64 shown in FIG. 6. In the case where the releasing cam 64 is rotated so that it is separated from the pressure plate 9, the pressure 9 is pushed by the pressure plate spring 34 so as to be raised to the position shown in FIG. 4 for pressuring the recording paper P against the recording paper separating roller 19. The recording paper P is fed out (picked up) according to the rotation of the recording paper separating roller 19 in the arrow R direction so as to be separated one by one by the separating nail 31. The separated recording paper P is fed to a paper feeding part 40. The recording paper separating roller 19 and the releasing cam 64 are rotated by one turn until the recording paper P is fed to the paper feeding part 40, and again, the rotation force from the feeding roller 10 is blocked in a state with the pressure plate 9 released form the recording separating roller 19 so as to be in the initial state. The initial state is maintained.

In the case where the document reading operation is started in a state with the document D set on the document tray 11, the feeding roller 10 is rotated by the feeding roller 104 (see FIG. 15), and the rotation is transmitted to the document separating roller 15 and a document feeding roller 51. According to the rotation of the document separating roller 15 in the arrow C direction, the document D in contact with the document separating roller 15 is fed out (picked up) so as to be separated one by one by the document separating piece 13. The separated document D is fed to the paper feeding part 40 by the document feeding roller 51 and the document feeding roller 52.

The paper feeding part 40 comprises the feeding roller 10, a pinch roller 16, a pinch roller guide 36, a pinch roller spring 41, a PE sensor lever 21, a PE sensor 21S, an upper guide 42, a platen 3, or the like, which provide a common feeding path for the recording paper P and the document D.

The recording paper P or the document D fed to the paper feeding part 40 is guided by the platen 3, the pinch roller guide 36, and the upper guide 42 so as to be sent to the nip of the roller pair of the feeding roller 10 and the pinch roller 16. The PE sensor lever 21 is provided on the upstream side of the roller pair 10, 16. The PE sensor lever 21 detects the top end of the recording paper P or the document D for finding the printing position on the recording paper P or the reading position on the document D. The pinch roller 16 is provided in the pinch roller guide 36. The pinch roller guide 36 is forced to the feeding roller 10 side by the pinch roller spring 41. The pinch roller 16 is pressured against the feeding roller 10 by the pinch roller spring 41 so as to generate the feeding force of the recording paper P or the document D.

The recording paper P or the document D fed to the paper feeding part 40 is fed to the recording part 46 and the reading part 28 in the common feeding path for the recording paper and the document by the feeding roller 10 and the pinch roller 16. In the case where the recording paper P is fed, as shown in FIG. 1, an image is printed on the recording paper upper surface by the recording part 46. Moreover, in the case where the document D is fed, as shown in FIG. 2, the image on the document upper surface is read out by the reading part 28.

The recording paper P or the document D which has passed by the recording part 46 or the reading part 28 is sent to the paper discharging part 47. The paper discharging part 47 comprises the paper discharging roller 17, a transmitting roller 48 for transmitting the rotation force of the feeding roller 10 to the paper discharging roller 17, a plurality of spurs 18 for helping the discharge of the recording paper P and the document M, or the like so as to provide the common feeding path for the recording paper P and the document D. The spurs 18 are pressured against the paper discharging roller 17 by an unshown spur spring. The recording paper P or the document D is to be discharged to the outside of the apparatus main body 91A by the paper discharging roller 17 and the spurs 18.

These rollers are to be rotated by a driving source such as a feeding motor 104 (see FIG. 15) by a mechanism to be described later. Therefore, the image reading and recording apparatus 91 of this embodiment needs not to additionally have a driving motor for reading or a mechanism for feeding a document so that the cost of the image reading and recording apparatus 91 can be reduced and the image reading and recording apparatus 91 can be miniaturized.

Recording means such as the recording part 46 is for printing an image on the recording paper P by reciprocal movement of the carriage 4 in the recording paper P width direction with the ink cartridge 1 mounted on the carriage 4 facing the platen 3 provided between the feeding roller 10 and the paper discharging roller 17. that is, the recording part 46 can print an image on the recording paper P by the serial recording method. The recording part 46 needs to comprise at least the ink cartridge 1. The recording paper width direction denotes the direction orthogonal to the recording paper feeding direction.

The reading part 28 as the reading means is disposed facing the platen 3 in the carriage 4 moving path between the feeding roller 10 and the paper discharging roller 17 at the time of the reading operation for reading the image on the upper surface of the document D being fed. The reading part 28 (reading means) has a plate-like white reference 25 (reading density reference member) mounted, with the document D feeding path provided between the reading part 28 and the white reference 25. At the time of the recording operation of the recording part 46, since the white reference 25 is rotated and separated from the platen 3 together with the reading part 28 so as to be moved from the position (reading position) shown in FIG. 2 to the position (stand by position) shown in FIG. 1, the reciprocal movement of the carriage 4 is not disturbed and pollution by the ink mists and the ink leakage at the time of the recording operation can be prevented. Moreover, since the reading part 28 is moved to the position of the carriage 4 reciprocal movement at the time of the reading operation, the image reading and recording apparatus 91 can further be miniaturized. In the case where the reading part 28 is at the reading position shown in FIG. 2, the document D passes by the feeding path between the reading part 28 and the white reference 25 so that the image on the document D is read out at the time.

Recording Paper Feeding Part

Figure 5:
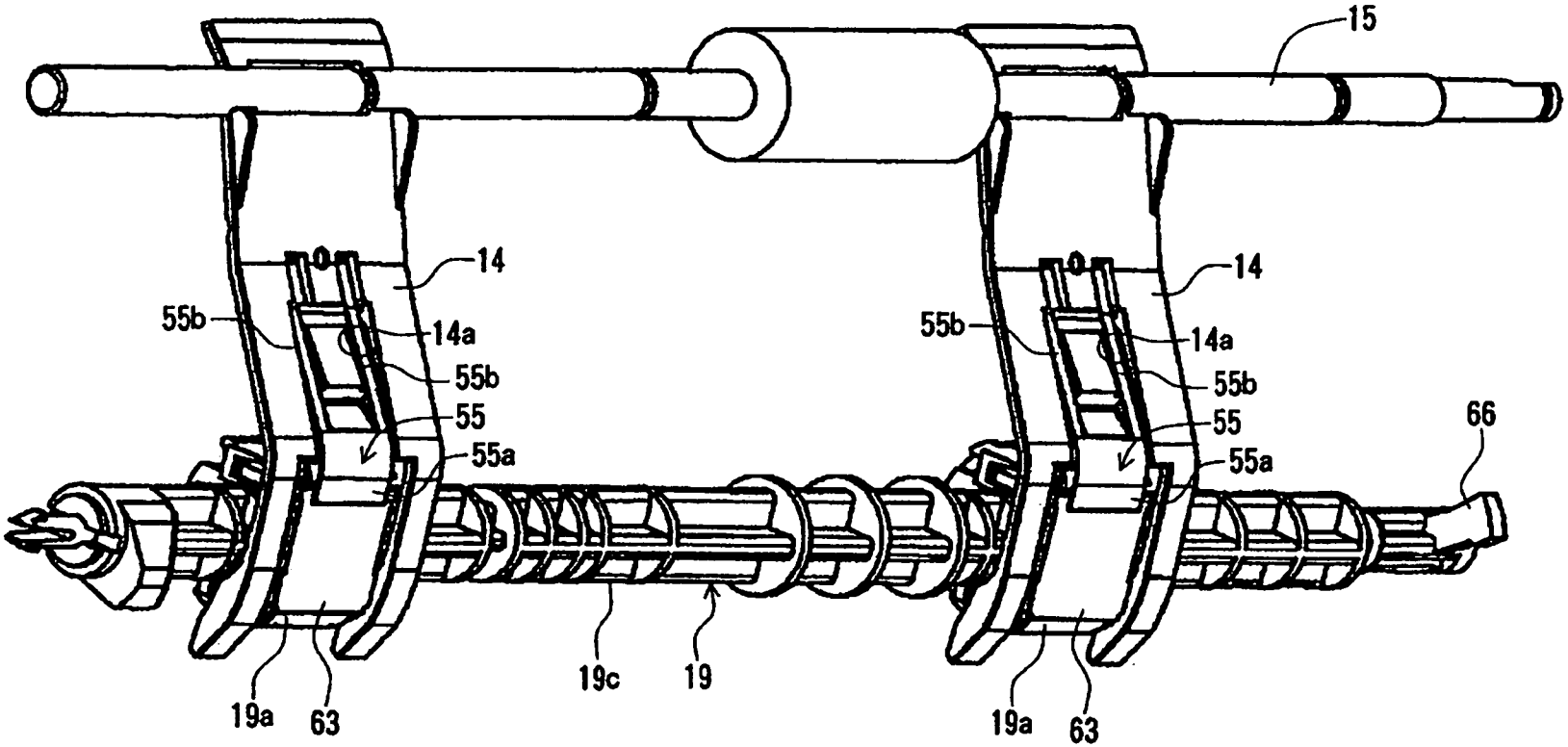
FIG. 5 is a perspective view of a recording paper separating roller and a document upper guide, viewed from the rear side of the apparatus main body, in the image reading and recording apparatus of FIG. 1.
Figure 6:
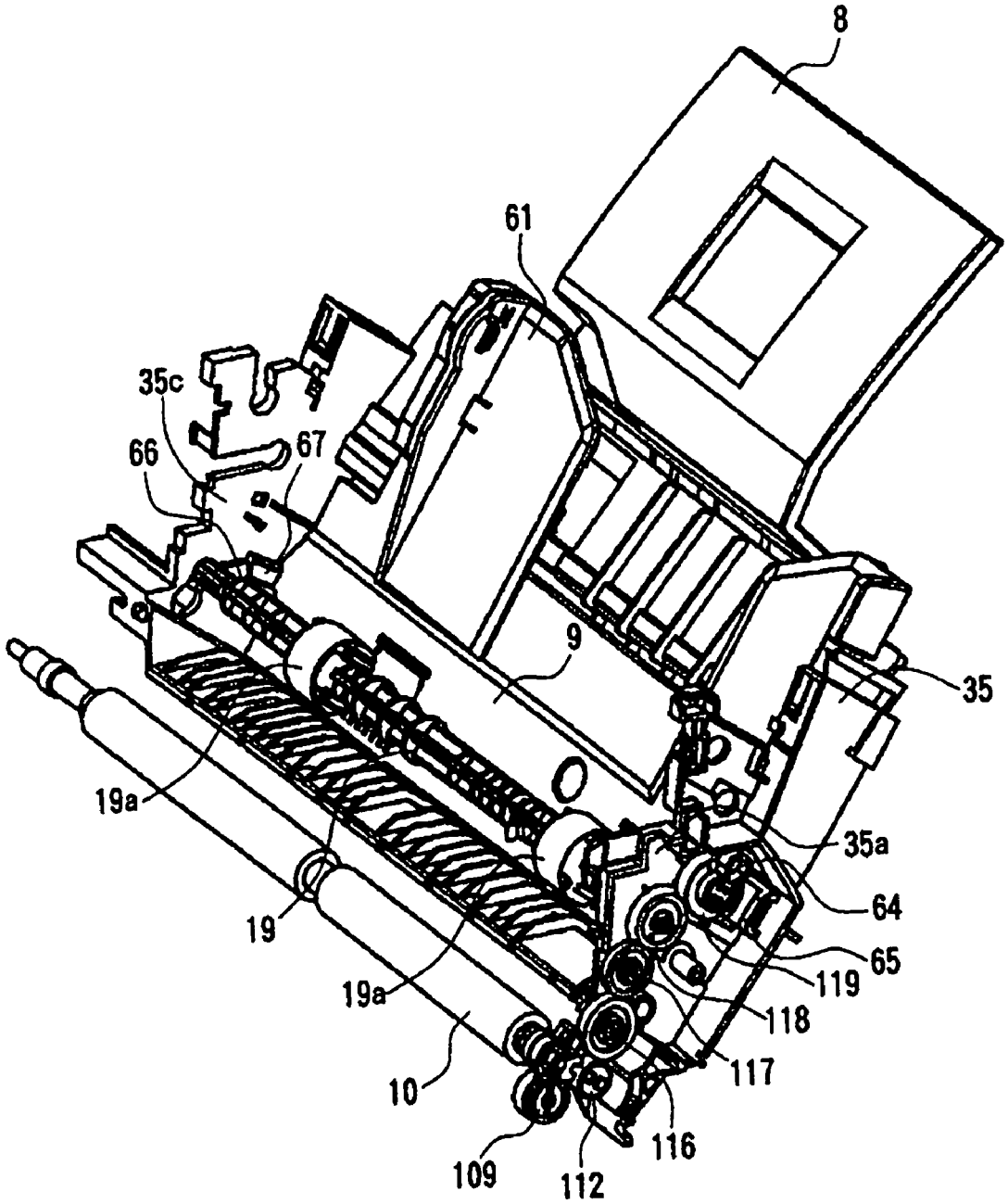
FIG. 6 is a perspective view of the image reading and recording apparatus, showing the recording paper feeding part in the image reading and recording apparatus of FIG. 1.

With reference to FIGS. 4 to 6, the recording paper feeding part 60 will be explained. FIG. 4 is a diagram showing a state of feeding a recording paper into the apparatus main body by the recording paper feeding part 60 in the image reading and recording apparatus 91 of FIG. 1. FIG. 5 is a perspective view of the recording paper separating roller 19 and the document upper guide 14, viewed from the rear side of the apparatus main body, in the image reading and recording apparatus main body. FIG. 6 is a perspective view of the image reading and recording apparatus, showing the recording paper feeding part 60.

The recording paper feeding part 60 comprises the recording paper separating roller 19, the separating nail 31, a movable side guide 61, the pressure plate 9, the pressure plate spring 34, the recording paper feeding tray 8, or the like formed on a base 35 as a unit. The recording paper feeding part 60 of this embodiment supplies the recording paper P with one side of the recording paper P as the reference. Therefore, the inner wall of the right side plate 35*a* of the base 35 is provided as the paper reference. In the base 35, a recess part 35*b* for providing the pressure plate spring 34 is formed at a position substantially facing the roller part 19*a* of the recording paper separating roller 19.

The pressure plate 9 is bonded with the base 35 by the pressure plate shafts 9*a* on the both end upper parts rotatably around the pressure plate shafts 9*a*.

The pressure plate 9 can take the withdrawn position (initial state) shown in FIG. 3 and the position to be contacted with the roller part 19*a* of the recording paper separating roller 19 shown in FIG. 4. A recording paper separating pad 62 made of a material having a relatively large coefficient of friction, such as an artificial leather is provided at a position facing the recording separating roller 19 of the pressure plate 9. The recording paper separating pad 62 is provided for preventing superimposed feed of the recording paper, or the like according to the association with the recording paper separating roller 19 in the case where the number of the recording papers P becomes small. Moreover, the movable side guide 61 is provided on the pressure plate 9 such that the pressure plate 9 can be moved in the right and left direction 8in the direction orthogonal to the recording paper feeding direction). The movable side guide 61 pressures the recording papers P having different sizes against the inner wall of the right side plate 35*a* provided as the reference surface for positioning the same on the pressure plate 9.

Figure 15:
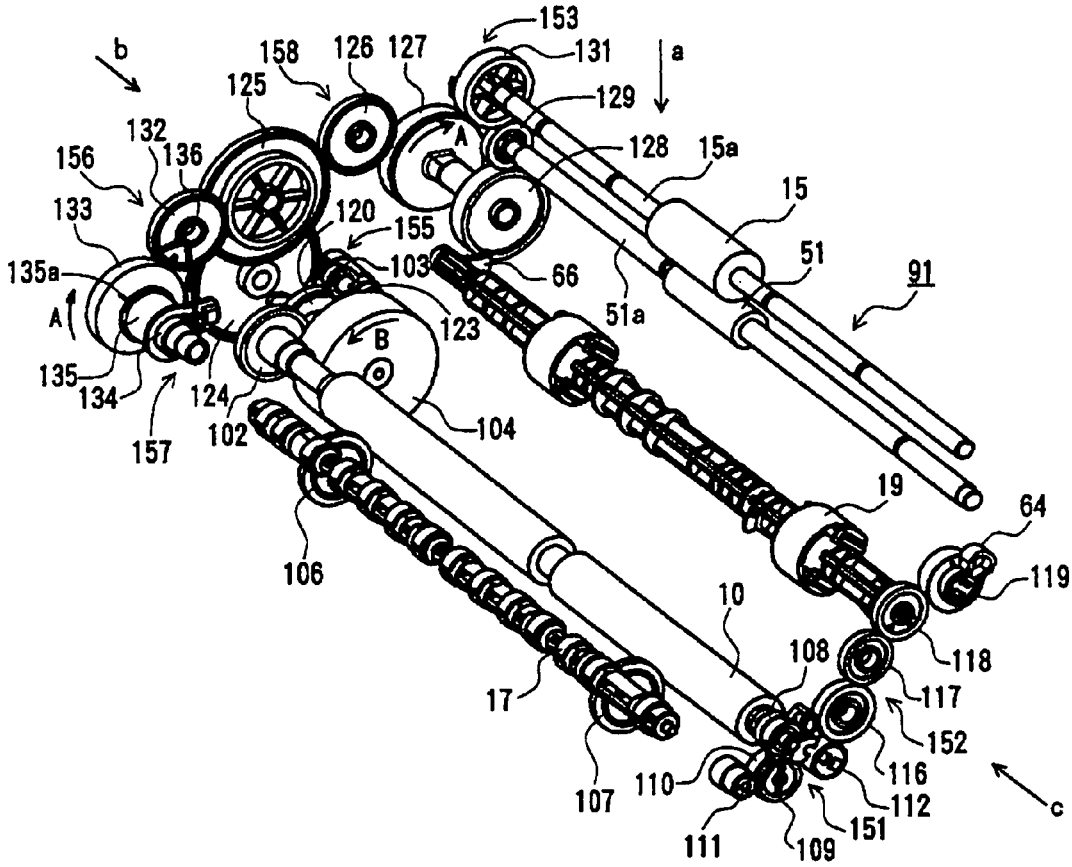
FIG. 15 is a partial perspective view of the parts concerning the separating feed of the recording paper, the separating feed of the document, the move of the CS and the driving system of the ink vacuuming mechanism in the image reading and recording apparatus of FIG. 1.

The recording paper separating roller 19 is an integrally molded product of a plastic, or the like, comprising a shaft part 19*c* and two roller parts 19*a* having a diameter larger than the shaft part 19*c*. A recording paper feeding roller rubber 19*d* made of a frictional elastic member is provided on the outer circumference of the roller part 19*a* for feeding the recording paper P. The both end parts of the shaft part 19*c* is pivoted rotatably by the base member 35. One end thereof is to receive the rotation force from the feeding motor 104 via a recording drive transmitting part 152 comprising a plurality of gears, or the like to be described later as shown in FIG. 15. The recording paper feeding roller rubber may be made of a recording paper feeding roller resin of a friction elastic member.

As shown in FIGS. 4 and 5, the recording paper feeding roller rubber 19*d* of the roller part 19*a* of the recording paper separating roller 19 is formed in a D-shaped cross-section. A roller guide 63 comprising a thin metal plate or a plastic material, having a low coefficient of friction in the surface is provided in a flat part 19*b* of the recording paper separating roller 19. By integrally molding the plastic material of the shaft part 19*c* and the elastomer of the frictional elastic member of the roller part 19*a* so as to form the surface of the flat part 19*b* with the plastic, the recording paper separating roller 19 having a low coefficient of friction can be obtained without the need of providing the roller guide 63 to the plat part 19*b*.

As shown in FIG. 3, at the time the flat part 19*b* is stopped substantially facing the recording paper P in the stand by state, not only the recording paper separating roller 19 does not contact with the recording paper P other than the time of feeding, but also a gap is formed between the document lower guide member 23 to be described later and the recording paper separating roller 19.

As shown in FIG. 6, the roller parts 19*a*, 19*a* of the recording paper separating roller 19 are disposed each at positions about 40 mm and about 180 mm from the inner side of the right side plate 35*a* as the paper reference. Therefore, the recording paper of the A4 size, or the like is fed by the two roller parts 19*a*, 19*a*. In the case where the rotation force from the feeding motor 104 is transmitted via the recording drive transmitting part 152 to be described later to the recording paper separating roller 19 so as to rotate the recording paper separating roller 19, the rotation is transmitted also to the releasing cam 64. At the time, the recording paper separating roller 19 and the releasing cam 64 are provided so as to meet the phase with each other per each rotation. The releasing cam 64 is formed in a shape such that it is projected form the hole of the right side plate 35*a* of the base 35 so as to press down the right pressing down part 65 of the pressure plate only when the flat part 19*b* of the recording paper separating roller 19 faces the pressure plate 9. Moreover, the releasing cam 64 has always the roller part 19*a* contacted with the recording paper P in the case where a part other than the flat part 19*b* of the recording paper separating roller 19 faces the pressure plate 9, or with the roller part 19*a* in the case where there is no recording paper P on the pressure plate 9 according to the pressuring force of the pressure plate spring 34.

At the time, the cam 66 formed integrally on the left of the shaft part 19*dc* of the recording paper separating roller 19 presses down the left pressing down part 67 of the pressure plate 9 provided in the vicinity of the left side plate 35*c* of the base 35, with the phase meeting with the releasing cam 64. Since the pressure plate 9 is pushed not by one side but by both sides by the releasing cam 64 and the cam 66, it cannot be pushed down while being tilted. Therefore, the recording paper can be placed and supplied certainly.

According to the above-mentioned configuration, the pressure plate 9 is contacted with or separated form the two roller parts 19*a* of the recording paper separating roller 19 in a state substantially parallel to the base 35 according to the rotation of the recording paper separating roller 19 in the R direction shown in FIG. 4.

Moreover, in the contact state of the roller part 19*a* of the recording paper separating roller 19 and the pressure plate 9, the recording paper separating roller 19 projects out from the lower surface of the document lower guide member 23 beyond a notch 53 shown in FIG. 8 formed in the document lower guide member 23 to be described later so as to be contacted with the uppermost recording paper P of the recording paper bundle placed on the pressure plate 9.

The recording papers P contacted with the roller part 19*a* of the rotating recording paper separating roller 19 are fed and blocked by the separating nail 31, but only the uppermost recording paper P set on the pressure plate 9 moves over the separating nail 31 by the friction of the roller part 19*a* of the recording paper separating roller 19 so as to pass by the PE sensor lever 21 and be fed to the paper feeding part 40.

After making one turn, the recording paper separating roller 19 again returns to the initial state with the flat part (D cut part) 19*b* withdrawn from the circumference separated form the recording paper P, and the pressure plate 9 pressed down by the releasing cam 64. Therefore, the second and subsequent recording papers P cannot be contacted with the recording paper separating roller 19 during the feed of the recording paper P by the feeding roller 10 so that the recording paper feeding part 60 can stably convey the recording paper P.

As mentioned above, in the case where the recording paper P does not reach to the PE sensor lever 21 even when the recording paper feeding operation is started, the recording paper feeding part 60 executes the paper feeding operation again, and in the case where the recording paper still does not reach to the PE sensor 21S, it stops the recording paper feeding operation and provides the error display on a display part 71 of an operation panel 70 shown in FIG. 1.

Document Feeding Part

Figure 7:
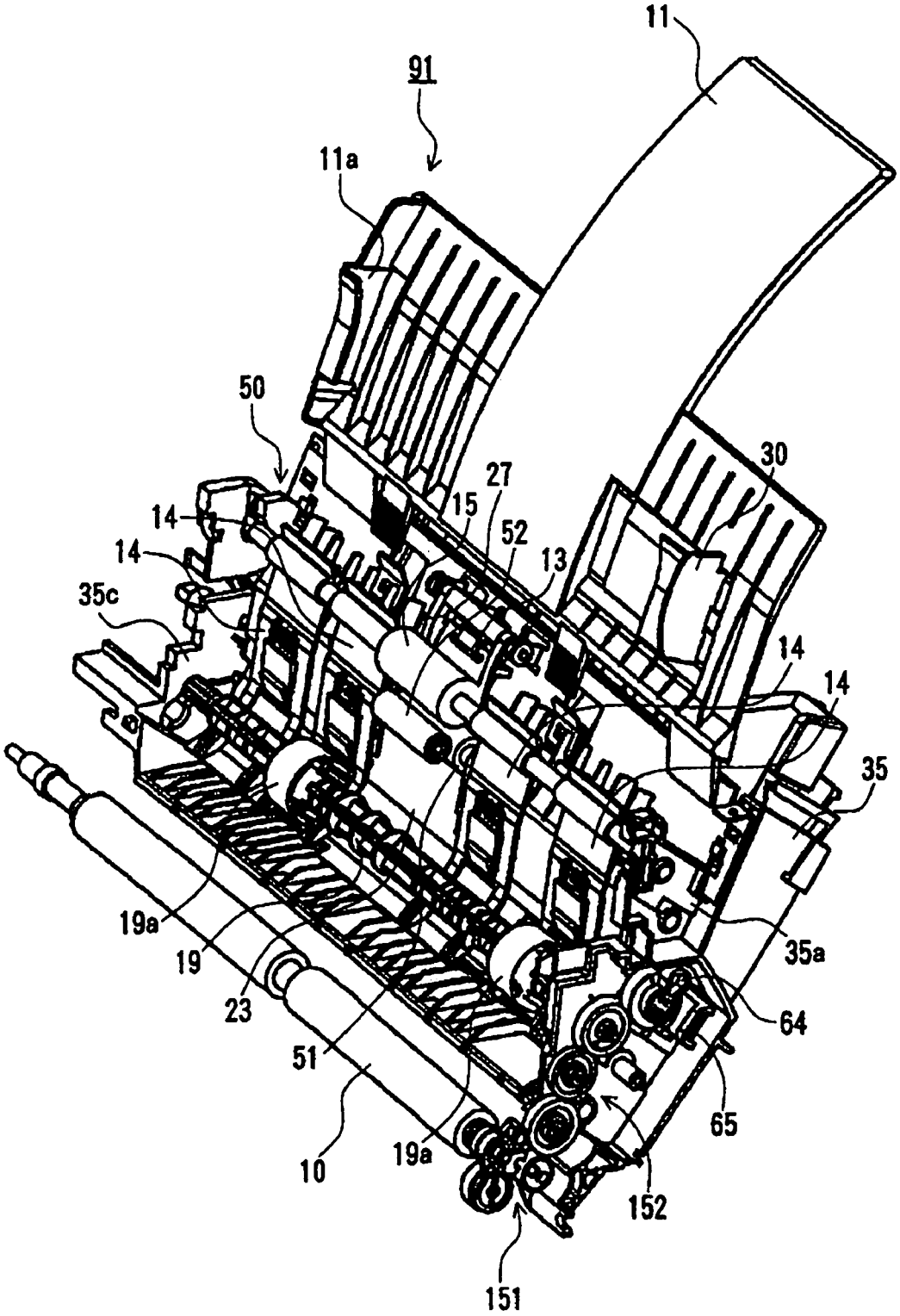
FIG. 7 is a perspective view of the image reading and recording apparatus, showing the document feeding part in the image reading and recording apparatus of FIG. 1.
Figure 8:
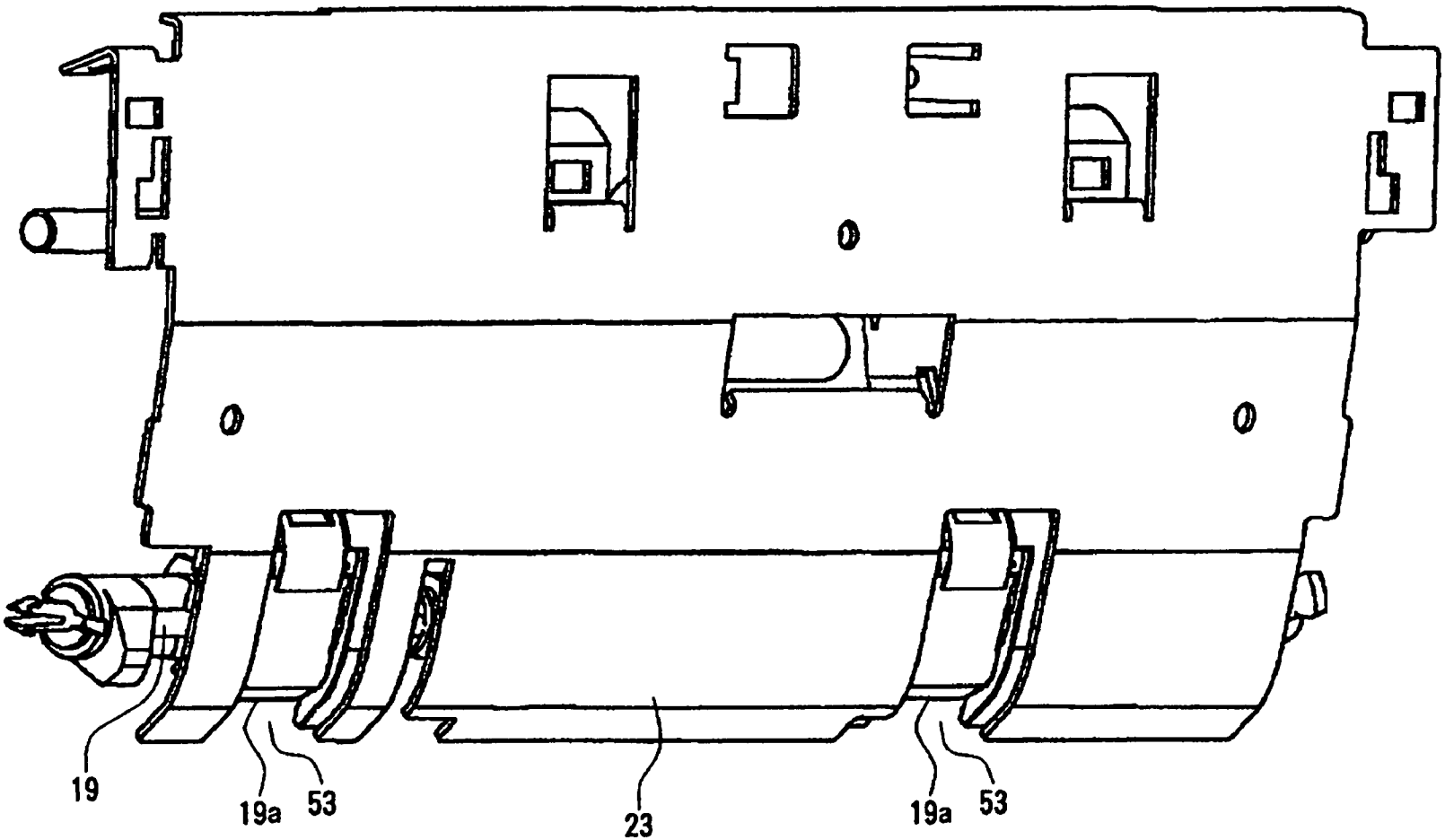
FIG. 8 is a perspective view of the recording paper separating roller and a document lower guide member, viewed from the rear side of the apparatus main body in the image reading and recording apparatus of FIG. 1.
Figure 9:
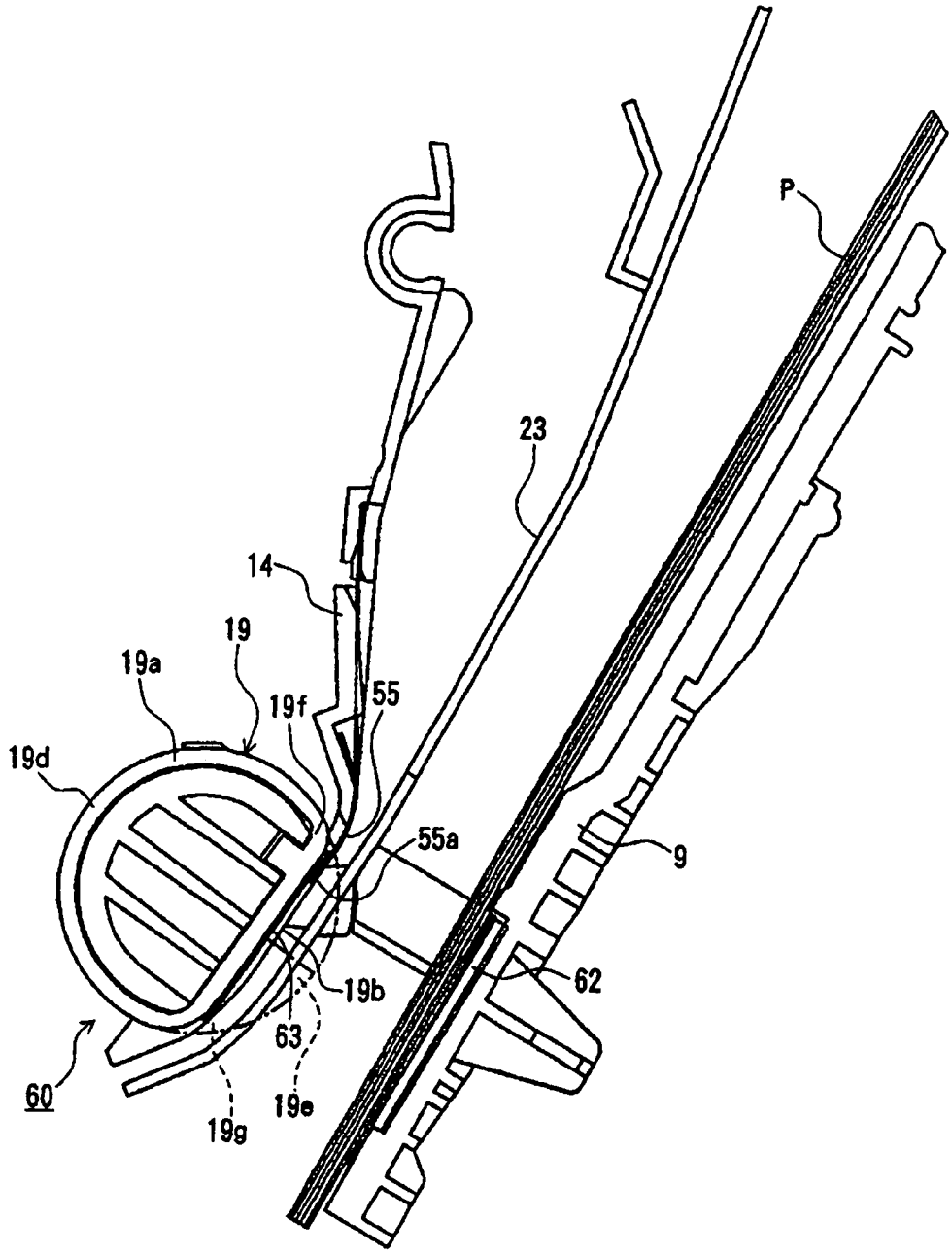
FIG. 9 is a cross-sectional view taken along the document feeding direction of the recording paper feeding part at the time of feeding a document in the image reading and recording apparatus of FIG. 1.
Figure 10:
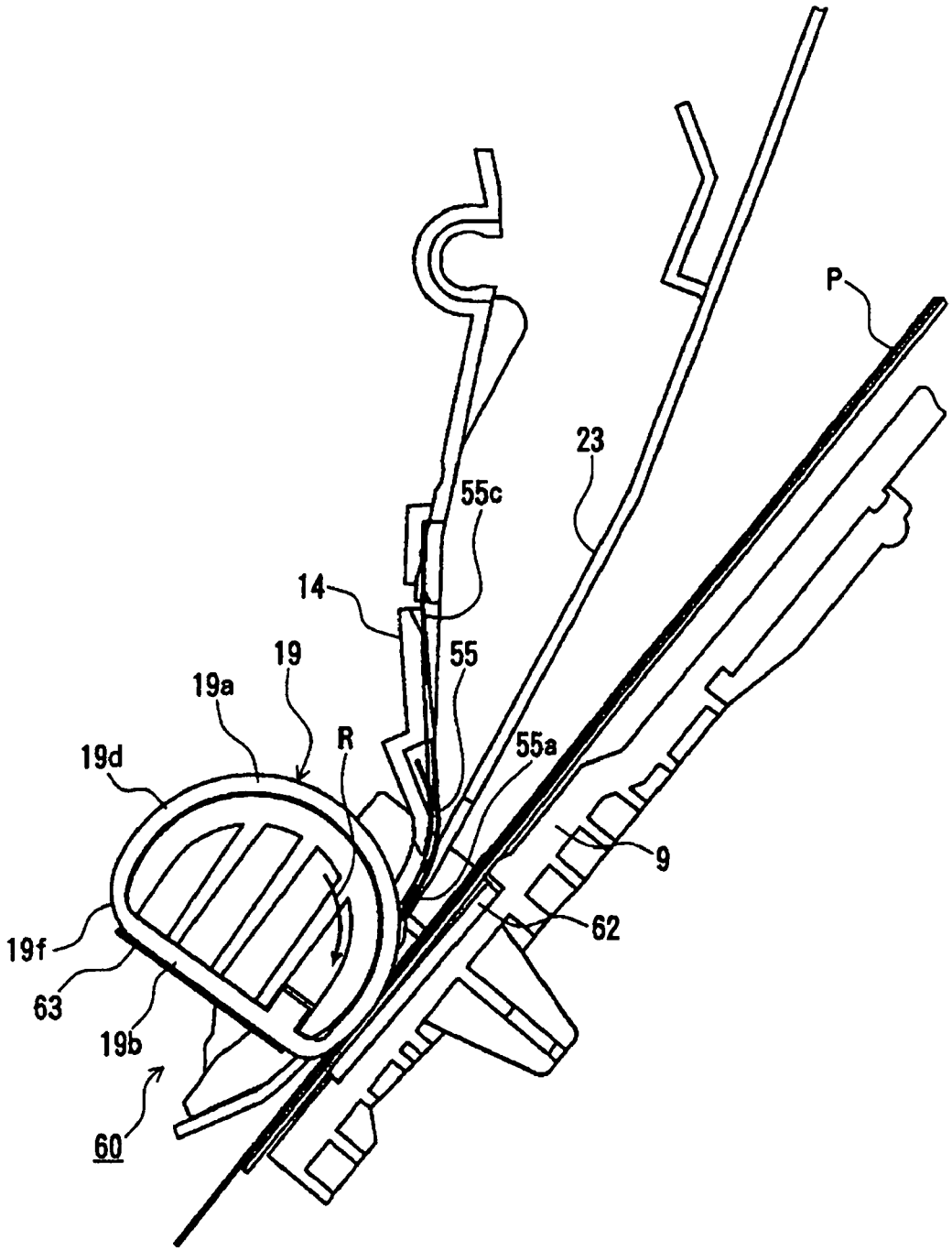
FIG. 10 is cross-sectional view taken along the recording paper feeding direction of the recording paper feeding part at the time of feeding a recording paper in the image reading and recording apparatus of FIG. 1.

With reference to FIGS. 2, 3, and 7 to 10, the document feeding part 50 will be explained. FIG. 7 is a perspective view of the image reading and recording apparatus, showing the document feeding part 50 in the image reading and recording apparatus 91 of FIG. 1. FIG. 8 is a perspective view of the recording paper separating roller 19 and the document lower guide member 23, viewed from the rear side of the apparatus main body. FIG. 9 is a cross-sectional view taken along the document feeding direction of the recording paper feeding part 60 at the time of feeding a document. FIG. 10 is cross-sectional view taken along the recording paper feeding direction of the recording paper feeding part 60 at the time of feeding a recording paper.

As shown in FIG. 7, the document feeding part 50 comprises the document separating roller 15, the document separating piece 13, the document feeding roller 51, the document feeding roller 52, or the like mounted on the base 35. The document feeding part 50 of this embodiment has one side of the document as the reference, and the inner wall the left side plate 11*a* of the document tray 11 as the document reference. The document tray 11 stores a plurality of the documents D. The document tray 11 is provided with a document slider 30 for preventing obliqueness of the document. The document slider 30 can move in the direction orthogonal to the document feeding direction such that the document is forced against the left side plate 11*a* for having the document reference on one side.

Moreover, the document separating roller 15 comprises a cylindrical friction elastic member mounted on a metal shaft member so as to be pivoted rotatably around the side plates 35*a*, 35*c* of the base member 35. One end of the document separating roller 15 is interlocked with the feeding motor 104 shown in FIG. 15 via the reading drive transmitting part 158 (see FIG. 15) to be described later and the reading drive switching part 155 (see FIGS. 44 to 49). The document separating piece 13 is supported by a separating piece supporting member 37 pivoted rotatably by the shaft 37*a* on the document lower guide member 23. The document separating piece 13 made of a material having a high coefficient of friction, such as a rubber and a resin, is forced to the document separating roller 15 side by the separating spring 54. The document feeding auxiliary member 27 executes an auxiliary operation for separating the document by pressuring the document D against the document separating roller 15 by an unshown spring.

The top end of the set documents D stays in a wedge-like part formed by the document separating piece 13 and the document separating roller 15. Only the uppermost document out of the documents D staying at the wedge-like part is fed by the friction of the document separating roller 15 to the document feeding roller 15 according to the rotation of the document separating roller 15 in the arrow C direction.

The document feeding roller 51 comprises a cylindrical elastic member mounted on a metal shaft member so as to be pivoted rotatably around the side plates 35*a*, 35*c* of the base member 35. One end of the document feeding roller 51 is interlocked with the reading drive transmitting part 158 (see FIG. 15) to be described later. The document feeding roller 52 is pressured against the document feeding roller 51 by an unshown document feeding roller spring so as to generate the document feeding force.

The document D fed by the document feeding roller 51 is fed with the lower surface supported by the document lower guide member 23, to the PE sensor lever 21 as in the case of the recording paper P. As mentioned above, the phase of the rotation direction of the recording paper separating roller 19 is in the initial state in the halfway thereof so that a sufficient gap for allowing passage of a document is generated between the flat part 19*b* of the recording paper separating roller 19 and the document lower guide member 23.

Accordingly, the document feeding part 5 is provided on the upstream side of the recording feeding part 60 on the feeding path 56 for document feeding shown by the broken line in FIG. 3.

As shown in FIGS. 3 and 7, the document upper guide member is formed in s strip-like shape, with the upper end thereof pivoted rotatably by the shaft part of the document separating roller 15, while sagging on the document lower guide member 23 by its self weight so as to provide the feeding path 56 for document feeding as shown in FIG. 3.

The document upper guide member 14 made of a slidable resin, or the like has a light weight, and it is provided rotatably in the shaft part of the separating roller 15 for pressuring the document by a light force. Therefore, in the case where the document D is fed by the document feeding roller 51 or the feeding roller 10, the document upper guide member 14 is pushed upward with the document separating roller 15 as the rotation center according to the tension of the document D, and backrush of the top end or the rear end of the document D so as to ensure the feeding path 56 for document feeding.

Moreover, in the case where the document D is clamped by the document feeding roller 15 and the feeding roller 10 and fed, the document feeding speeds of the document feeding roller 52 and the feeding roller 10 are set at the same speed. In the case where the diameters of the rollers have a size tolerance so that the feeding roller 10 has a higher document feeding speed, a tension is applied to the document D. The tension becomes a force of pushing the document upper guide member 14 upward. In the case where the document upper guide member 14 is pushed upward by the document D being fed, the upper surface of the document upper guide member 14 lower part is contacted with the shaft part 19*c* of the recording paper separating roller 19. Also in the contacted state, the guide surface of the document upper guide member 14 is to be disposed on the feeding path 56 for document feeding side with respect to the recording paper feeding roller rubber 19*d* of the recording paper separating roller 19.

Moreover, as mentioned above, since the recording paper separating roller 19 has its shaft part made of a flexible material such as a plastic, the shaft part 19*c* may be deflected at the time of feeding the document D in a state with the pivoted both ends fixed. However, since the lower part upper surface of the document upper guide member 14 is contacted with the shaft part 19*c* of the recording paper separating roller 19 in the deflected state as mentioned above, the flat surface 19*b* of the recording paper separating roller 19 cannot project to the feeding path 56 for document feeding. Furthermore, as mentioned above, since the roller guide 63 made of a low friction material is mounted on the flat part 19*b* of the recording paper separating roller 19, the document D cannot be contacted with the recording paper feeding roller rubber 19*d* of the roller part 19*a* of the recording paper separating roller 19 so that there is no risk of the feed failure.

In this embodiment, as shown in FIG. 7, total 4 pieces of the document upper guide members 14 are provided each on two pieces on the right and left sides of the friction elastic member of the document separating roller 15. Moreover, the document upper guide members 14 provided each one on the right and left sides are disposed at the same position as the roller pat 19*a* of the recording paper separating roller 19. Moreover, as shown in FIG. 5, the document upper guide member 14 has a notch 14*a* in the width direction center from the middle to the lower part of the document upper guide member 14 so as not to interfere the roller part 19*a* in the case where the recording paper separating roller 19 is rotated. Furthermore, as shown in FIG. 8, a notch part 53 is formed in the part facing the roller part 19*a* of the recording paper separating roller 19 of the document lower guide member 23 providing the lower surface of the feeding path 56 for document feeding until the document D is fed to the feeding part 40.

Therefore, as shown in FIGS. 4 and 5, at the time the recording paper separating roller 19 is rotated for feeding the recording paper P, since the roller part 19*a* of the recording paper separating roller 19 is rotated beyond the notch 14*a* of the document upper guide member 14 and the notch 53 of the document lower guide member 23, the recording paper P can be fed certainly without interference with the document upper guide member 14 and the document lower guide member 23.

Moreover, as shown in FIGS. 5 and 9, a document pressing member 55 made of a flexible material is mounted to the notch 14*a* of the two document upper guide members 14 disposed at the position of the roller part 190*a* of the recording paper separating roller 19. The lower end part 55*a* of the document pressing member 55 is disposed in the upper half (upstream side half) area 19*e* of a crescent-like area 19*g* formed with respect to the flat part 19*b* in the rotation radius of the roller part 19*a* of the recording paper separating roller 19 shown by the broken line in FIG. 9 so as to cover the upstream end part of the roller guide 63 mounted on the D cut corner part 19*c* and the D cut part 19*b* of the recording paper separating roller 19. Therefore, the lower end part 55*a* of the document pressing member 55 overlaps the upstream end part of the roller guide 63 for ensuring the gap for allowing passage of the document between the roller guide 63 and the document lower guide member 23. Moreover, since it is overlapped, the document pressing member 55 prevents hooking of the top end of the document by the corner part 19*f* between the roller part 19*a* and the flat part 19*b*, or the roller guide 63 end part so as to generate the document feed failure at the time of feeding the document D with the feeding path 56 for document feeding ensured.

Furthermore, as shown in FIG. 10, at the time the recording paper separating roller 19 is rotated in the arrow R direction, the roller part 19*a* interferes with the document pressing member 55. However, since the document pressing member 55 is deflected, the rotation of the recording paper separating roller 19 cannot be prevented.

Moreover, as shown in FIG. 9, the lower end part 55*a* of the document pressing member 55 is formed so as to cover the corner part 19*f* disposed on the upstream side of the flat part 19*b* of the recording paper separating roller 19 and a part of the roller guide 63 in the vicinity of the corner part 19*f*. then, as shown in FIG. 5, the upper part of the lower end part 55*a* is mounted on the document upper guide member 14 with two narrow arm parts 55*b* formed. Therefore, as shown in FIG. 10, even in the state of rotating the recording paper separating roller 19 in the arrow R direction so that the pressure plate 9 is raised above the releasing cam 64 with the recording paper P contacted with the roller part 19*a* of the recording paper separating roller 19, since the point 55*c* of deflecting the document pressing member 55 is provided in the upper part of the document pressing part 55, the lower end part 55*a* of the deflected document pressing member 55 is separated on the upstream side of the nip position of the roller part 19*a* of the recording paper separating roller 19 and the recording paper P without extreme approach to the recording paper P. Then, the document pressing member 5 is not contacted with the recording paper P. Therefore, the deflected document pressing member 55 does not generate the feed failure at the time of feeding the recording paper.

Accordingly, the document D passes by between the recording paper feeding roller 19 and the pressure plate 9 for placing the recording paper P on the feeding path 56 for document feeding by the document feeding roller 51 so as to pass by the PE sensor lever 21. Then, like the recording paper P, the document D is clamped by the feeding roller 10 and the pinch roller 16 and fed so as to reach to the paper feeding part 40.

Recording Part

Figure 11:
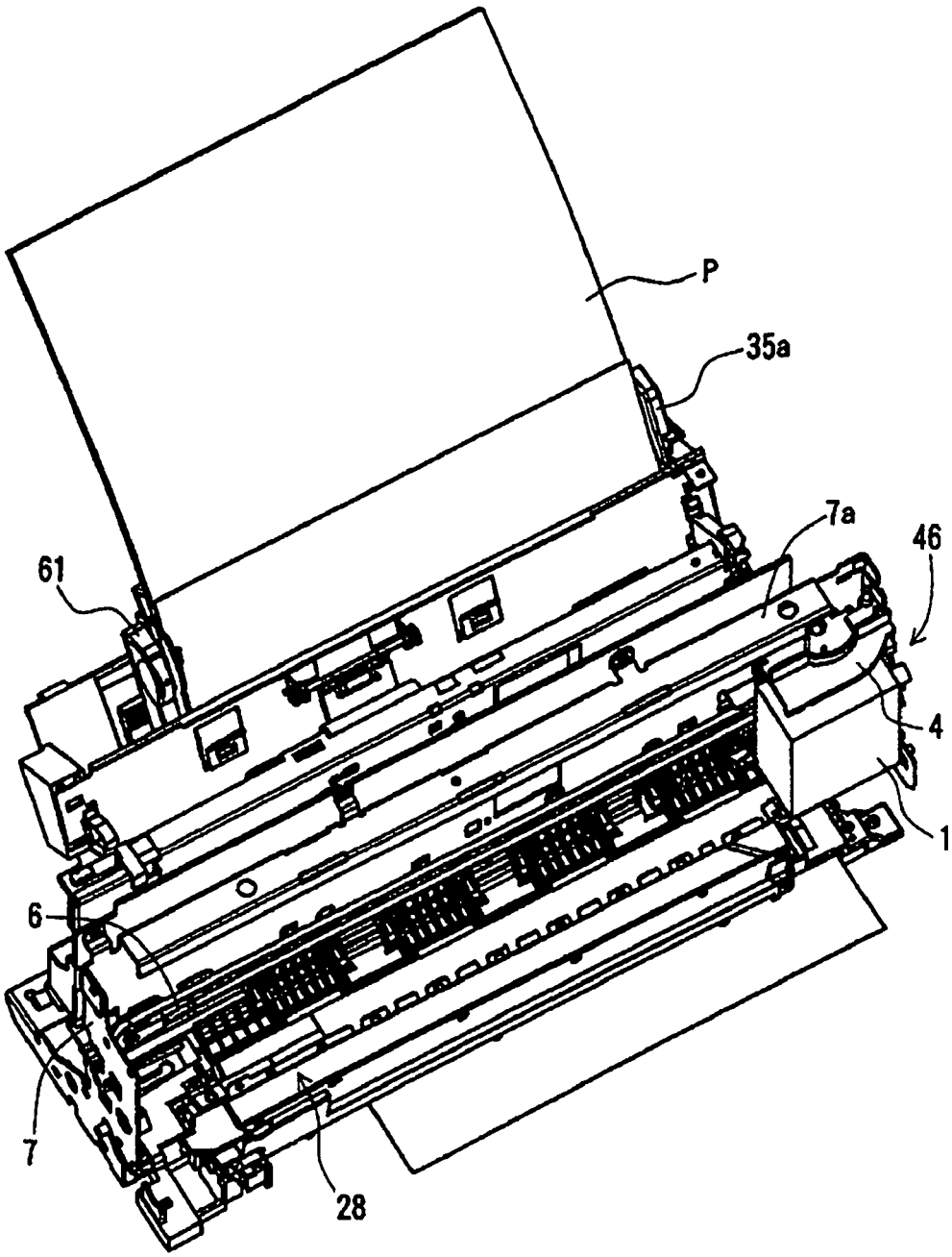
FIG. 11 is a perspective view of the image reading and recording apparatus showing an installation configuration of the recording part and the reading part at the time of a recording operation of the image reading and recording apparatus of FIG. 1.
Figure 12:
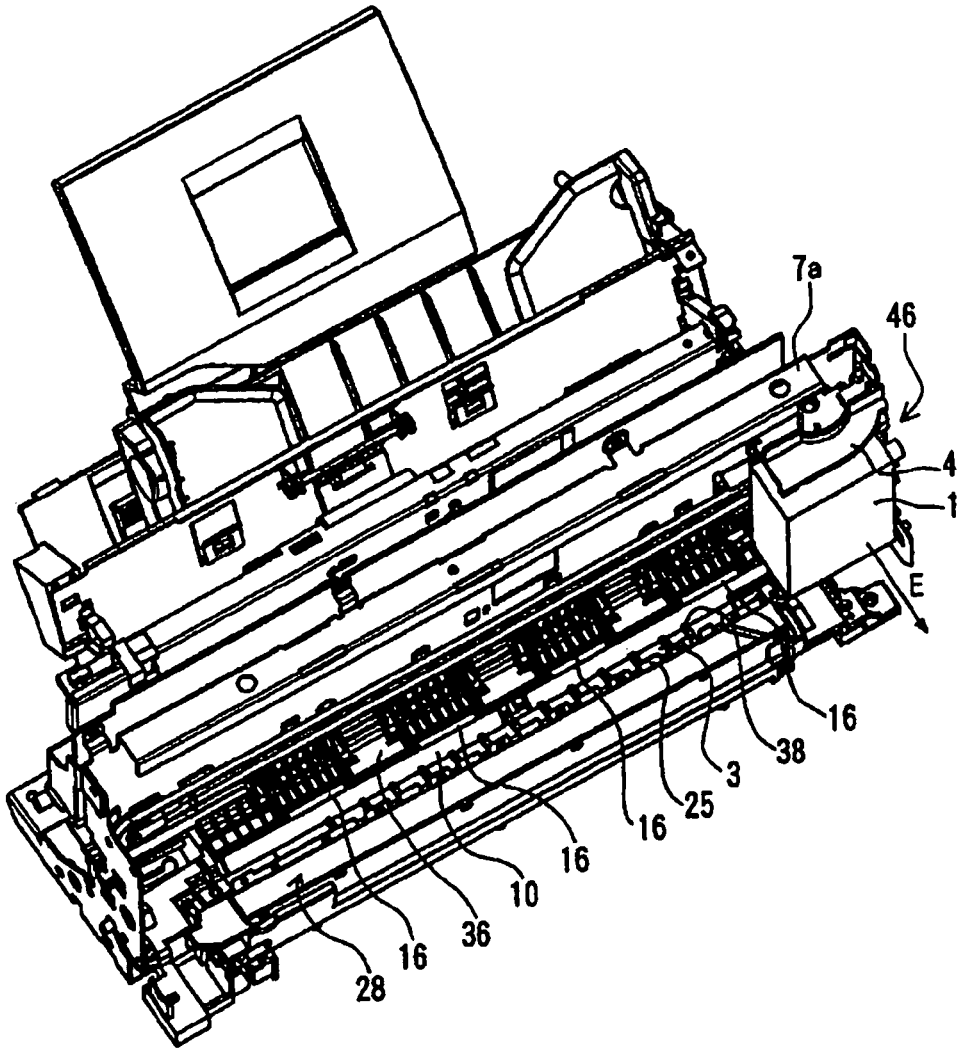
FIG. 12 is a diagram at the time of replacing the ink cartridge of the recording part.

With reference to FIGS. 1, 11 and 12, the recording part 46 will be explained. FIG. 11 is a perspective view of the image reading and recording apparatus showing an installation configuration of the recording part 46 and the reading part 28 at the time of a recording operation of the image reading and recording apparatus 91 of FIG. 1. FIG. 12 is a diagram at the time of replacing the ink cartridge of the recording part 46 in FIG. 11.

In FIG. 1, the recording paper P fed to the paper feeding part 40 according to the rotation of the recording paper separating roller 19 moves along on the platen 3 by the feeding roller 10 and the pinch roller 16 so as to be discharged to the outside of the apparatus by the paper discharging roller 17 and the spur 18.

An ink image is recorded on the upper surface of the recording paper P being fed by the feeding roller 10 or the paper discharging roller 17 by the recording part 46. According to the recording part 46 of this embodiment, an ink jet recording method of recording by ejecting an ink from the ink cartridge 1 is adopted. That is, the ink cartridge 1 comprises a minute liquid ejecting opening (orifice), a liquid path and an energy function part provided in a part of the liquid path, energy generating means for generating a liquid droplet forming energy to be applied to the liquid in the function part or the like.

By using the ink jet recording method in the recording part 46, it is advantageous in terms of miniaturization, the running cost, or the like. However, since the vicinity of the ink cartridge 1 is polluted by the ink mists generated at the time of ejecting the ink, caution is required at the time of designing the layout of the inside of the image reading and recording apparatus 91.

In this embodiment, as it will be described later, the contact image sensor (hereinafter it is abbreviated as the "CS") 22 is withdrawn from the reading stand by position (contact image sensor holder (hereinafter it is abbreviated as the "CS holder") first position) in the printing operation so as to be separated as shown in FIG. 1 (stand by position). Furthermore, since the reading surface of the CS is covered with the white reference 25, the pollution by the ink mists can be alleviated dramatically. Moreover, since the stand by position of the reading part 28 is separated from the printing surface, even in the case where jamming of the recording paper, or the like is generated in the recording part 46, the unfixed ink cannot be adhered on the reading surface of the CS 22 or the white reference 25.

As shown in FIG. 11, the carriage 4 has the above-mentioned ink jet cartridge 1 mounted for scanning in the recording paper P width direction (in the direction orthogonal to the recording paper feeding direction). The carriage 4 is interlocked with an endless belt-like timing belt 6 placed across pulleys to be rotated by an unshown carriage driving motor. The carriage is to be moved reciprocally along the guide rail 7*a* according to the rotation of the above-mentioned pulleys and the circulation of the timing belt 6.

Figure 14:
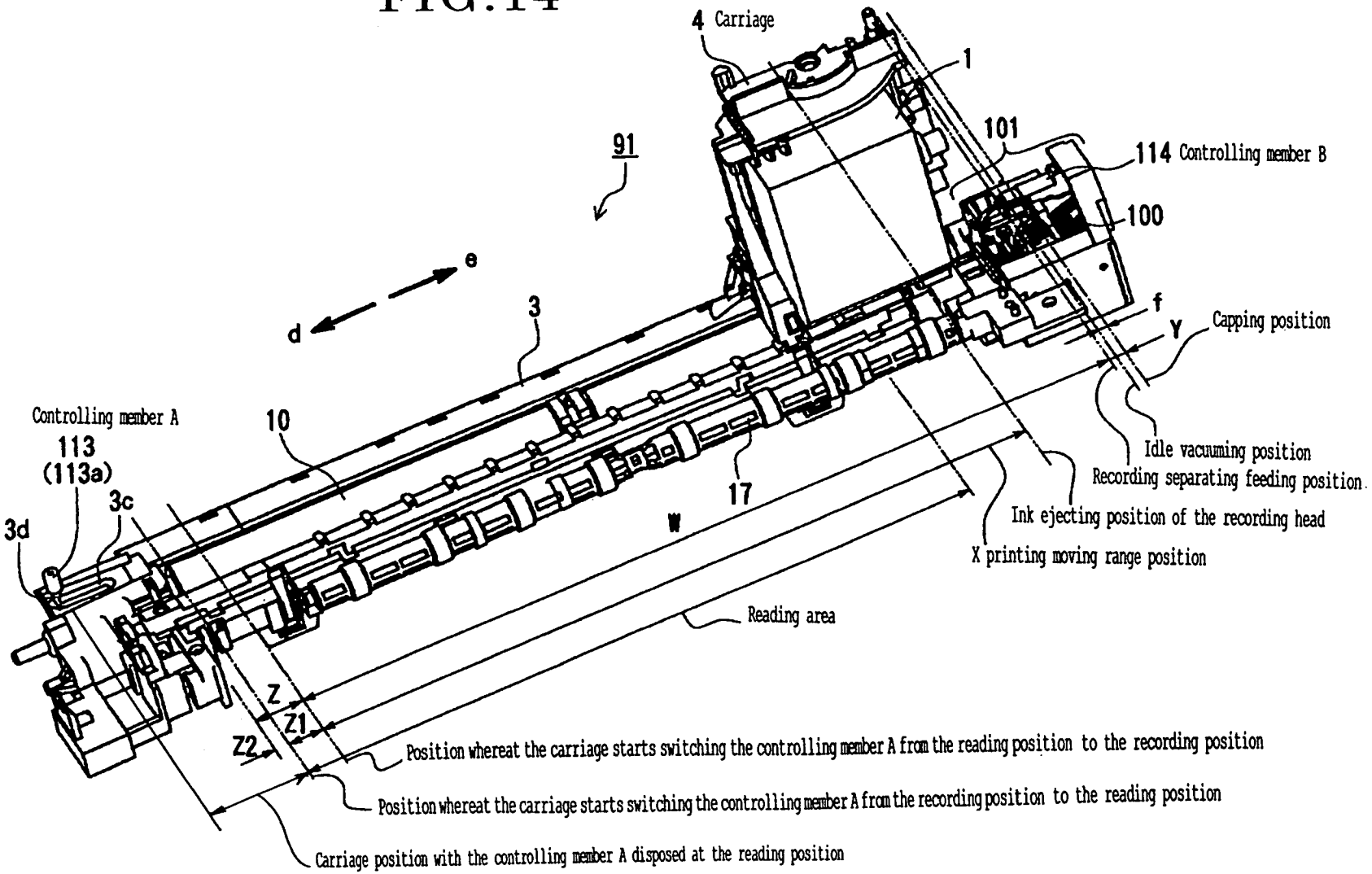
FIG. 14 is a diagram showing the operation change over position of the carriage in the image reading and recording apparatus of FIG. 1, with the control member (A) disposed at the recording position.

In general, the carriage 4 stands by at the capping position (the state in FIG. 11) on the right end of the guide rail 7. A recording head recovery unit 101 shown in FIG. 14 is disposed at the position. The recording head recovery unit 101 comprises a cap 100 made of a rubber or a resin having the elasticity for protecting the printing head from drying, a wiper mechanism for cleaning the surface of the printing head, an ink vacuuming mechanism for recovering the nozzle unejection state, or the like. The ink vacuuming mechanism is for vacuuming the ink in the nozzle via the cap 100 according to the reciprocal movement of a piston by the driving source to be described later. In the case where the ink is exhausted, the ink cartridge 1 can be replaced as shown in FIG. 12 by detaching the ink cartridge 1 at the stand by position to the arrow E direction on the apparatus front side.

As shown in FIG. 1, the recording paper feeding path 49*p* of the recording part 46 comprises the platen 3 for supporting the lower side of the recording paper P, an auxiliary platen member 3*a* disposed in the recess part formed in the recording paper supporting surface of the platen 3 for serving as the lower side supporting surface of the recording paper P following the platen 3, the above-mentioned feeding roller 10, the pinch roller 16, the pinch roller guide 36, or the like. The number of the spurs 18 and the pressuring force (spur force) to the paper discharging roller 17 are set at the appropriate number and spur pressure so as not to pollute with the unfixed ink of the recorded image by the spurs 18.

The spurs 18 of this embodiment are disposed by 13 in the recording paper P width direction (in the direction orthogonal to the recording paper feeding direction). Moreover, a plurality of ribs 38 are formed in the recording paper width direction on the recording paper supporting surface of the platen 3 shown in FIG. 12. At the time of feeding the recording paper, the recording paper P passes by the upper surface of the ribs 38. The auxiliary platen member 3*a* pivoted by the supporting part formed on the platen 3 by the shaft formed on the paper feed direction upstream side of the both side surfaces is in general forced by the spring 58 shown in FIG. 1 by the rear surface such that the recording paper supporting surface of the platen 3 and the recording paper supporting surface of the auxiliary platen member 3*a* are provided in the same plane. Then, in the case where the auxiliary platen member 3*a* is pushed from above, resisting to the pressuring force of the spring 58, it is sunk by about 5 mm with respect to the recording paper supporting surface of the platen 3.

The feeding direction of the recording paper P by the feeding roller 10 and the pinch roller 16 is set in the obliquely downward descending gradient from the roller upstream side to the downstream side. Moreover, the feeding direction by the paper discharging roller 17 and the spurs 18 is set in the obliquely upward raising gradient from the roller upstream side to the downstream side. Thereby, the recording paper P to be fed by the recording paper feeding part 49*p* is guided by the recording paper supporting surface of the platen 3 and the recording paper supporting surface of the auxiliary platen member 3*a* so as to be fed in the arrow H direction.

The recording paper feeding force F0 generated by he feeding roller 10 and the pinch roller 16 is so large that the friction resistance force between the rear surface of the document lower guide member 23 and the recording paper P shown in FIG. 2, however, in the case where the recording paper feeding accuracy is affected, a low friction member such as a polymer sheet may be attached on the rear surface of the document lower guide member 23.

The recording operation of the recording paper 46 is carried out by ejecting the ink according to the image information by the ink jet cartridge 1 while reciprocally moving the carriage 4 as mentioned above.

Reading Part

Figure 13:
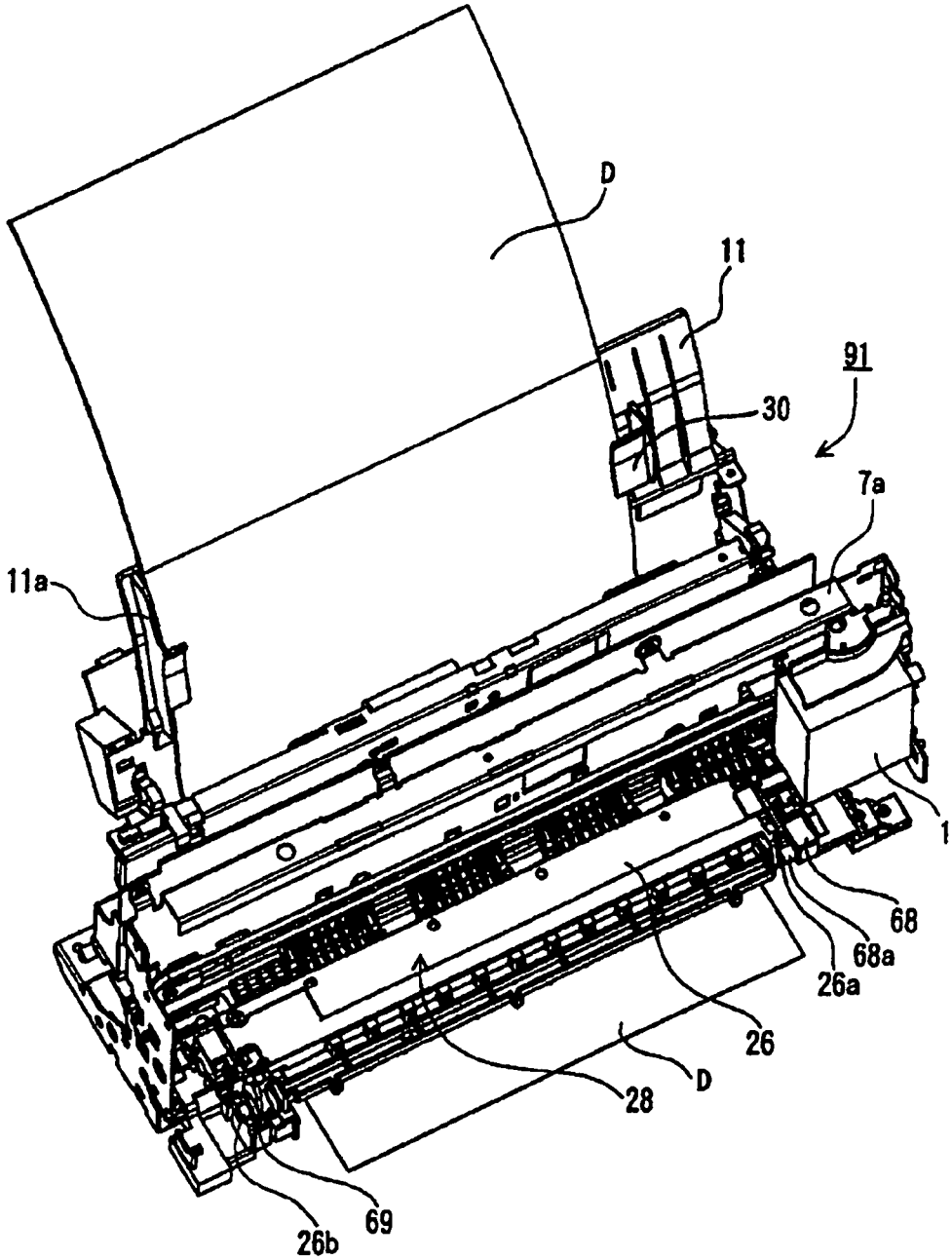
FIG. 13 is a perspective view of the image reading and recording apparatus showing an installation configuration of the reading part and the recording part at the time of reading the document of the image reading and recording apparatus of FIG. 1.

With reference to FIGS. 1, 2 and 13, the reading part 28 will be explained. FIG. 13 is a perspective view of the image reading and recording apparatus showing an installation configuration of the reading part 28 and the recording part 46 at the time of reading the document of the image reading and recording apparatus 91 of FIG. 1.

The reading means such as the reading part 28 comprises the CS 22, the CS holder 26, the white reference 25, or the like, and at least the CS 22 is necessary.

The CS 22 is stored in the recess part formed in the CS holder 26 with the sensor surface disposed on the outer side, and it is fixed with a screw (fastening member). The white reference 25 is formed by attaching a white sheet on a metal plate. The white reference 25 has a projection on the outer side in the metal plate document width direction so as to allow passage of at least a document between the sensor surface of the CS 22 and the white sheet of the white reference 25 for forming a gap with respect to the sensor surface of the CS 22.

As shown in FIG. 13, a boss 26*a* is formed on the right side surface in the longitudinal direction of the CS holder 26. A hollow boss 68*a* is formed in a CS holder supporting member 68 mounted on the platen 3. The boss 26*a* is engaged with the hollow boss 68*a*. Moreover, a boss 26*b* is formed on the left side surface of the CS holder 26. A bearing part 69 is formed in the platen 3. The boss 26*b* is engaged with the bearing part 69. The engaged part of the boss 26*a* and the hollow boss 68*a* and the engaged part of the boss 26*b* and the bearing part 69 as the right and left engaged part are disposed on the same axis.

The CS holder 26 can be rotated and moved from the CS holder first position (stand by position) shown in FIG. 1 to the CS holder second position (reading position) shown in FIG. 2. The CS holder first position (stand by position) is set at a position such that the carriage 4 of the recording part 46 and the ink cartridge 1 mounted on the carriage 4 do not come in contact with each other at the time of moving in the moving range of the carriage for recording an image on the recording paper. The CS holder second position (reading position) is set at a position in the carriage 4 moving space rotated until the document reading feeding path 49*r* shown in FIG. 2 formed by the reading surface of the CS 22 and the gap of the white reference 25 and the recording paper feeding path 49*p* shown in FIG. 1 at the time of recording coincide with each other.

Moreover, the right and left direction position of the CS holder 26 is set such that the ink cartridge 1 can move to the CS holder second position (reading position) in a state disposed at the capping position. As shown in FIG. 12, the upstream side in the paper feeding direction of the metal plate of the white reference 25 is formed in a comb teeth-like shape. The ribs 38 of the platen 3 can be disposed between the teeth of the comb. Moreover, a bent part is formed on the recording paper feeding direction downstream side of the metal plate of the white reference 25 for improving the strength in the longitudinal direction. The CS holder has a part of the CS holder 26 contact with the auxiliary platen member 3*a* for pressing down the auxiliary platen member 3*a* beyond the pressuring force of the spring 58 so as to take the second position (reading position).

Accordingly, the document feeding path 49*r* at the time of reading shown in FIG. 2 is formed at the time the document reading feeding path 49*r* is provided at a position substantially coinciding with the recording paper feeding path 49*p* shown in FIG. 1 between the feeding roller 10 and the paper discharging roller 17 as shown by the broken like so as to substantially coincide with the recording paper feeding path 49*p*.

A CD forcing moving part 157 (see FIGS. 15, and 52 to 59) interlocked with the feeding motor 104 via the reading drive switching part 155 to be described later and the CS drive transmitting part (see FIG. 15) is provided on the left side in the recording paper width direction of the CS holder 26. The CS forcing moving part 157 rotates the CS holder 26 according to the rotation of the feeding motor 104 (see FIG. 15) to the CS holder first position (stand by position) or the CS holder second position (reading position).

Next, the reading operation of the reading part 28 will be explained.

The CS holder 26 is supported at the CS holder first position (stand by position) while being forced in the counterclockwise direction as shown in FIG. 1 in the apparatus stand by state. In the case where the reading operation is started in a state with the document D set on the document tray 11, first, the reading drive switching part 155 (see FIG. 15) to be described later rotates the document separating roller 15 and the document feeding roller 51 via the reading drive transmitting part 158 for starting the document feeding operation by the document separating roller 15 and the document feeding roller 51, and furthermore, operates the CS forcing moving part 157 (see FIGS. 15, and 52 to 59) via the CS drive transmitting part 156 (see FIG. 15) for starting movement of the CS holder 26 by the CS forcing moving part 157.

The gear ratio and the roller diameter of the reading drive transmitting part 158 (see FIG. 15) and the CS drive transmitting part 156 (see FIG. 15) are set such that the CS holder 26 is moved to the CS holder second position (reading position) before the document D reaches at the feeding roller 10. As shown in FIG. 2, in the case where the CS holder 26 is rotated and stopped at the CS holder second position (reading position) so that a part of the CS holder 26 presses down the auxiliary platen member 3*a*, the document reading feeding path 49*r* is formed between the feeding roller 10 and the discharging roller 17.

The document D reached at the feeding roller 10 is fed by the feeding roller 10 so as to pass through the document reading feeding path 49*r* and has the image data read out by the CS 22, and then it is discharged to the outside of the apparatus by the paper discharging roller 17. Unlike the carriage 4, the CS reads out the image in the reading area shown in FIG. 14 without moving in the direction orthogonal to the document feeding direction.

After reading the rearmost end of the document D so that the document is discharged to the outside of the apparatus main body 91A by the paper discharging roller 17, the feeding motor 104 (see FIG. 15) is rotated backwardly so that the transmission of the rotation force of the CS forcing moving part 157 (see FIGS. 15, and 52 to 59) and the CS drive transmitting part 156 (see FIG. 15) is blocked. Then, the CS holder 26 is rotated to the CS holder first position (stand by position) shown in FIG. 1. At the same time, the auxiliary platen member 3*a* is pushed up by the spring 58 so that the recording paper supporting surface of the auxiliary platen member 3*a* and the recording paper supporting surface of the platen 3 are provided in the same plane so as to provide the recording paper feeding path 49*p*.

Finally, the reading drive switching part 155 to be described later switches the drive of the driving motor to the recording mode. Thereby, the image reading and recording apparatus 91 is in the stand by state.

The reading drive switching means (see FIG. 15) to be described later and the reading drive transmitting part 158 comprise the document feeding force transmitting means.

Moreover, the recording switching part 151 (see FIG. 15) to be described later and the recording drive transmitting part 152 comprise the recording sheet feeding force transmitting means.

Then, as shown in FIG. 15, the document feeding force transmitting means is disposed on the left side in the width direction of the recording paper, and the recording sheet feeding force transmitting means is disposed on the right side. That is, since the recording sheet feeding force transmitting means is disposed on one side of the recording area for recording an image on the recording paper by the recording part 46 and the document feeding force transmitting means is disposed on the other side, miniaturization can be realized. Moreover, the weight balance can be improved so that the apparatus can be placed in a stable state.

The reading drive switching part 155 (see FIG. 15) to be described later, the reading move transmitting part such as the CS drive transmitting part 156, and the reading forcing moving part such as the CS forcing moving part 157 comprise the moving means.

The feeding roller 10 is an example of the driving force transmitting means and the feeding means.

Driving System

Figure 16:
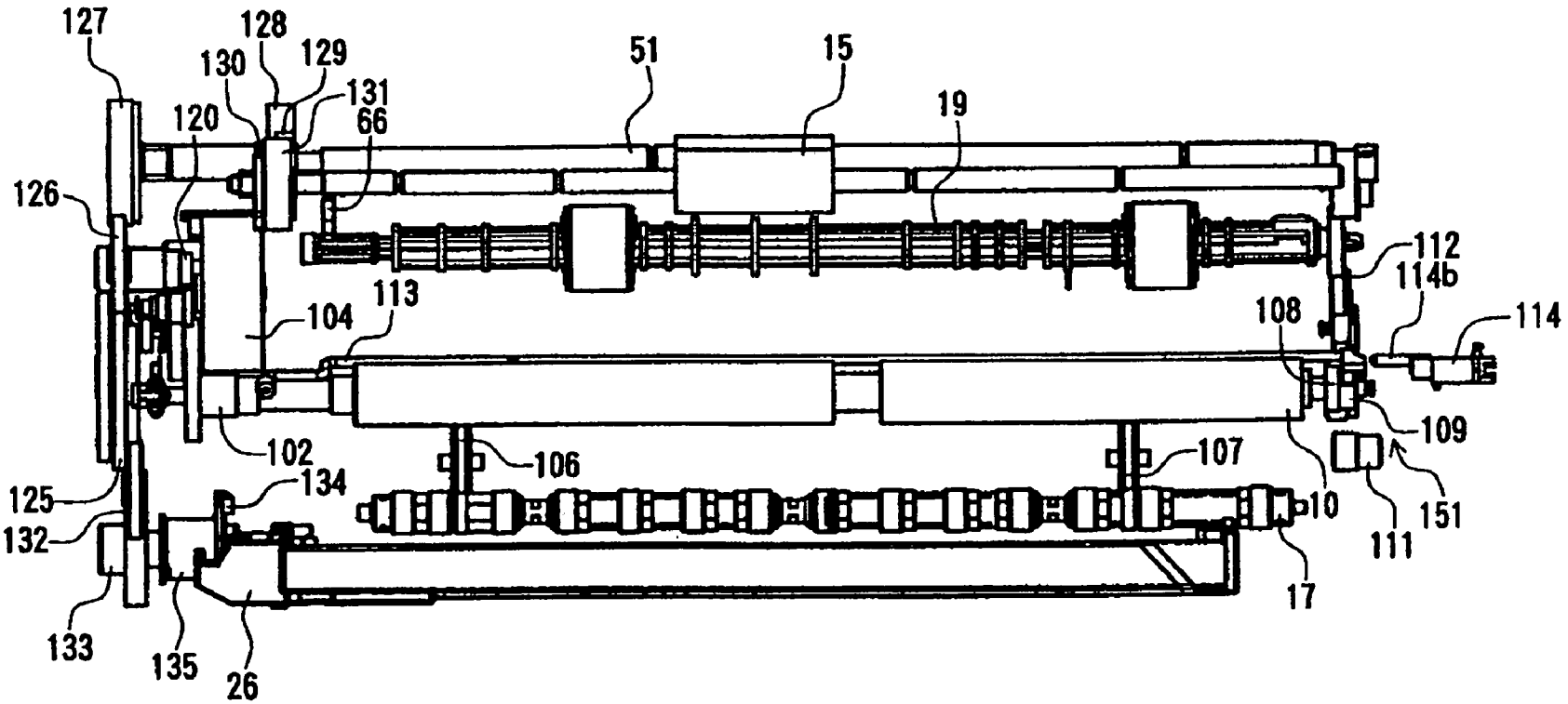
FIG. 16 is a diagram viewed from the arrow a direction in FIG. 15.
Figure 17:
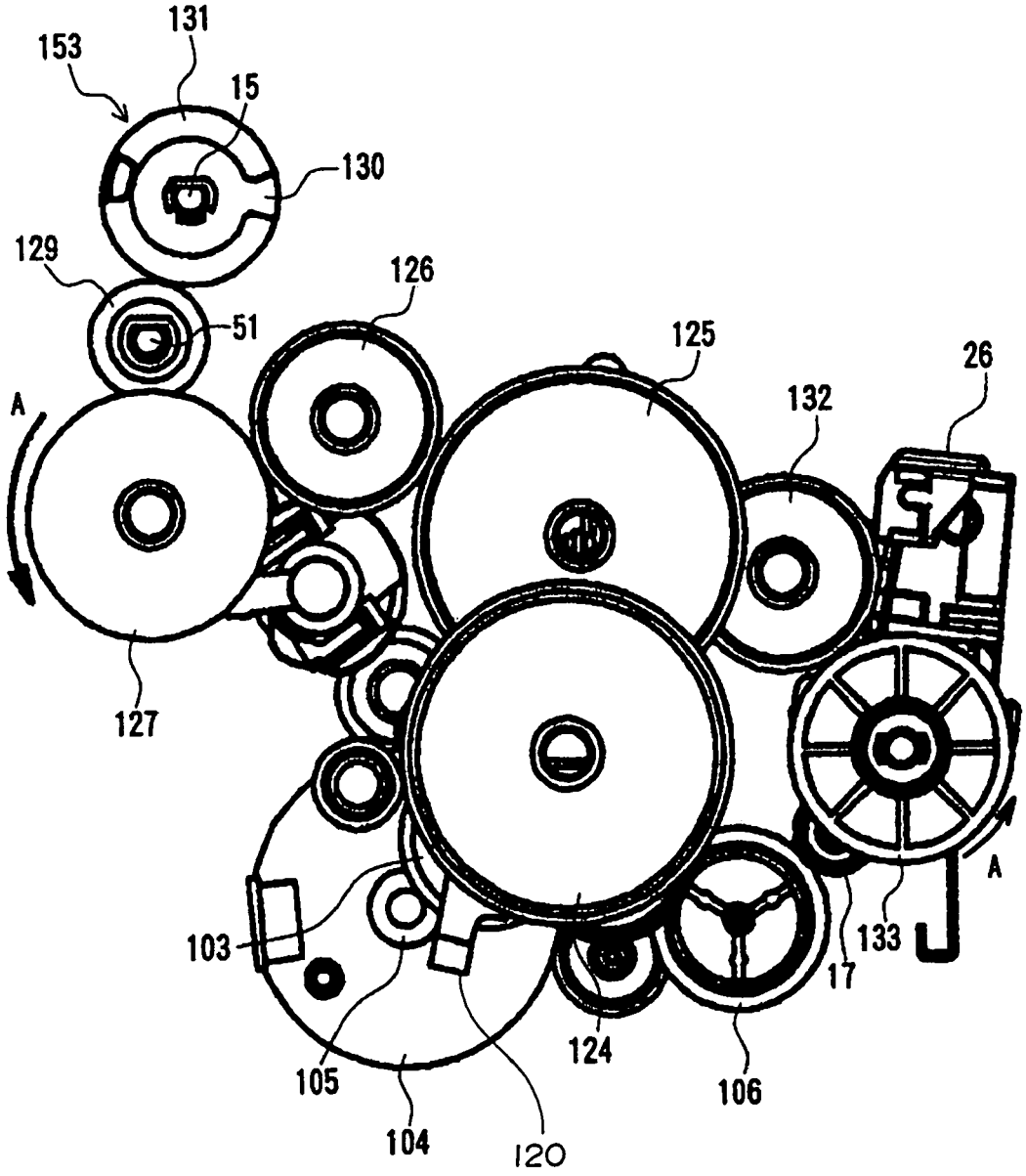
FIG. 17 is a diagram viewed from the arrow b direction in FIG. 15.
Figure 18:
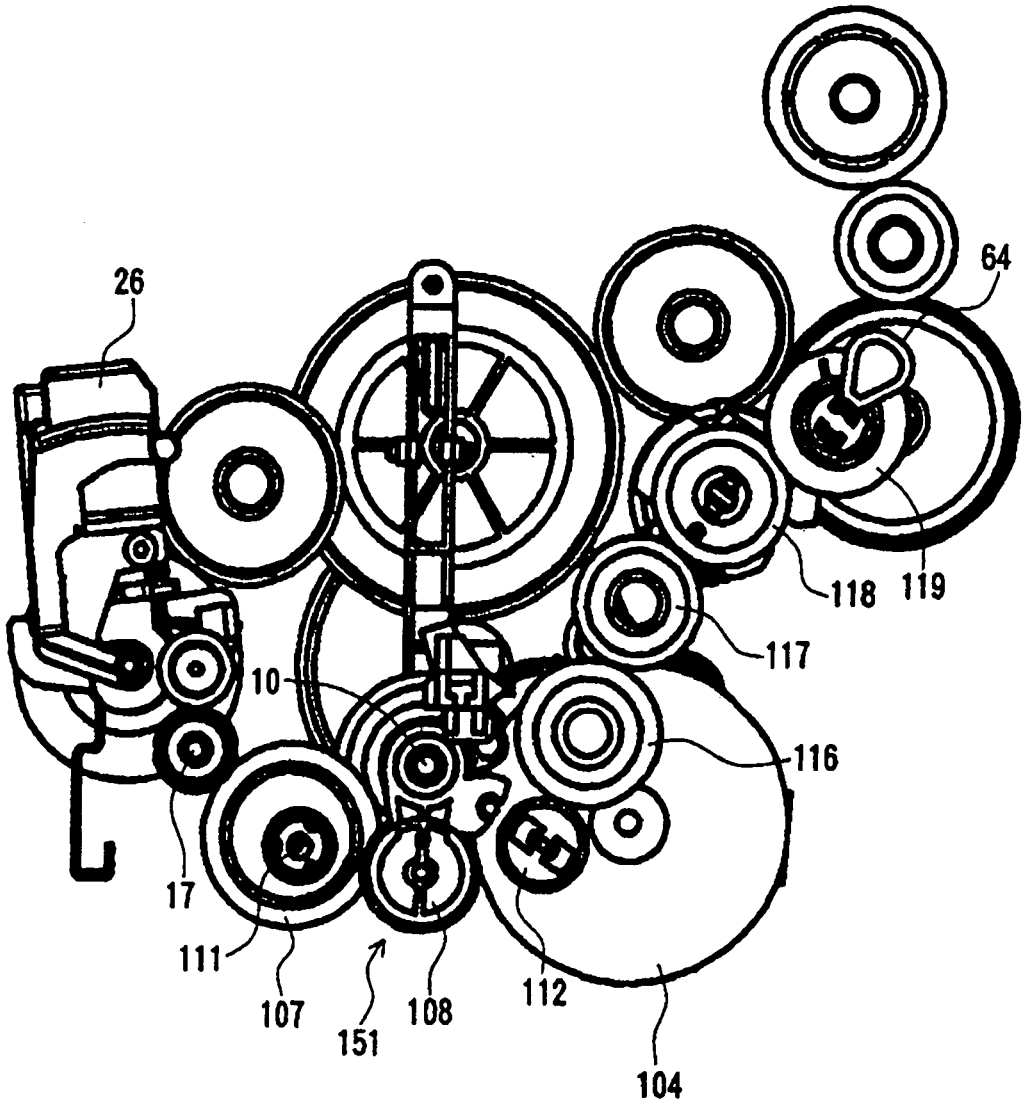
FIG. 18 is a diagram viewed from the arrow c direction in FIG. 15.

The driving system will be explained with reference to FIGS. 15 to 18. FIG. 15 is a partial perspective view of the parts concerning the separating feed of the recording paper, the separating feed of the document, the move of the CS 22 and the driving system of the ink vacuuming mechanism. FIG. 16 is a diagram viewed from the arrow a direction in FIG. 15. FIG. 17 is a diagram viewed from the arrow b direction in FIG. 15. FIG. 18 is a diagram viewed from the arrow c direction in FIG. 15.

In FIG. 15, the feeding roller 10 for feeding the document and the recording paper by a predetermined feeding speed has the feeding roller gear 102 fixed on one end of the shaft interlocked with a pinion gear 105 fixed to the shaft of the feeding motor 104 via the step gear (A) 103. As the feeding motor 104, for example, a pulse motor is used.

The paper discharging roller 17 obtains the rotation force from the feeding roller 10 by the friction transmission via the transmitting roller (A) 106 with the outer circumference made of a high friction member such as a rubber and a resin, and the transmitting roller (B) 107. A sun gear (A) 108 is fixed on the other end of the shaft of the feeding roller 10. A pendulum arm (A) 109 is pivoted rotatably with respect to the feeding roller 10 on the outer end part of the shaft of the feeding roller 10. A planetary gear (A) 110 having a predetermined friction load with respect to the pendulum arm (A) 109 is pivoted on the pendulum arm (A) 109. The planetary gear (A) 110 is engaged with the sun gear (A) 108.

The pendulum arm (A) 109, the planetary gear (A) 110, and the sun gear (A) 108 comprises the recording switching means such as the recording switching part 151.

Figure 21:
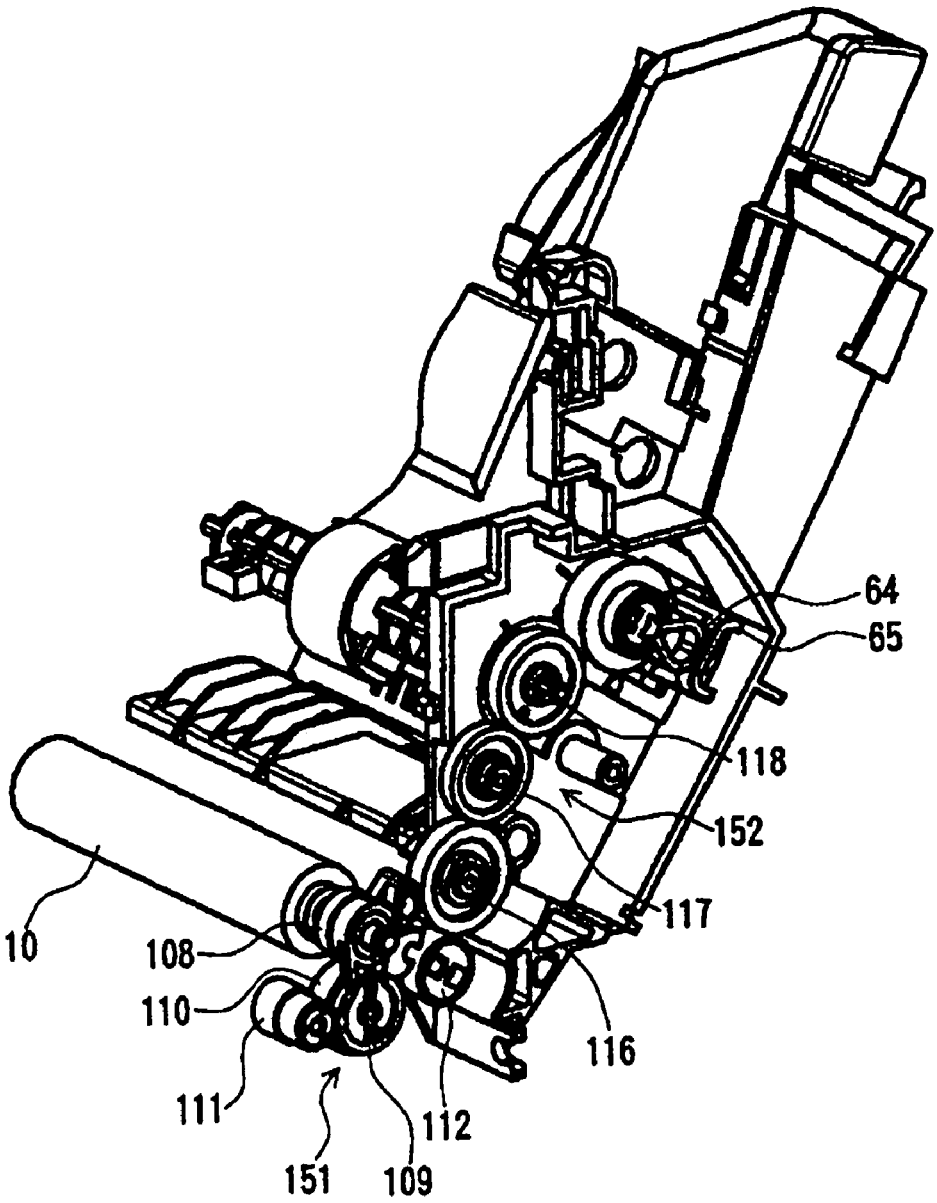
FIG. 21 is a right side perspective view of FIG. 15.
Figure 22:
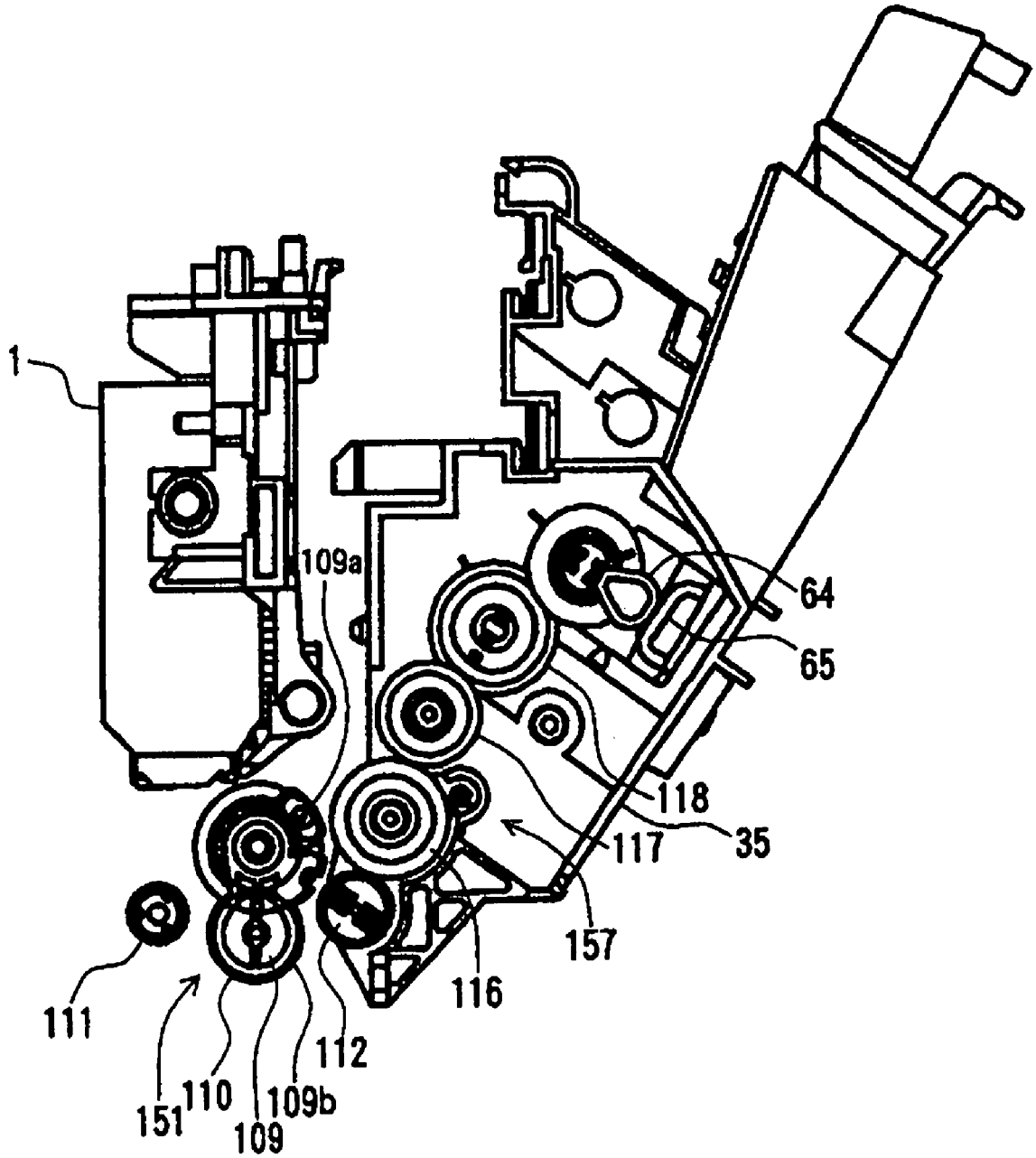
FIG. 22 is a diagram viewed from the right side of FIG. 21.

On the both sides of the planetary gear (A) 110, a recovery inputting gear 111 to be engaged rotatably in the recording head recovery unit 101 (see FIG. 14) and a recording paper separating inputting gear 112 to be engaged with the recording separating roller 19 rotatably in the base 35 (see FIG. 1) are provided (see FIGS. 21 and 22). As shown in FIGS. 37 to 42, in the case where the controlling member (A) 113 to be described later and the controlling member (B) 114 are in the released (ON) state, the planetary gear (A) 110 is engaged with the recording paper separating inputting gear 112 when the feeding roller 10 (see FIG. 15) is rotated forwardly, and it is engaged with the recovery inputting gear 111 when the feeding roller 10 is rotated backwardly.

Figure 38:
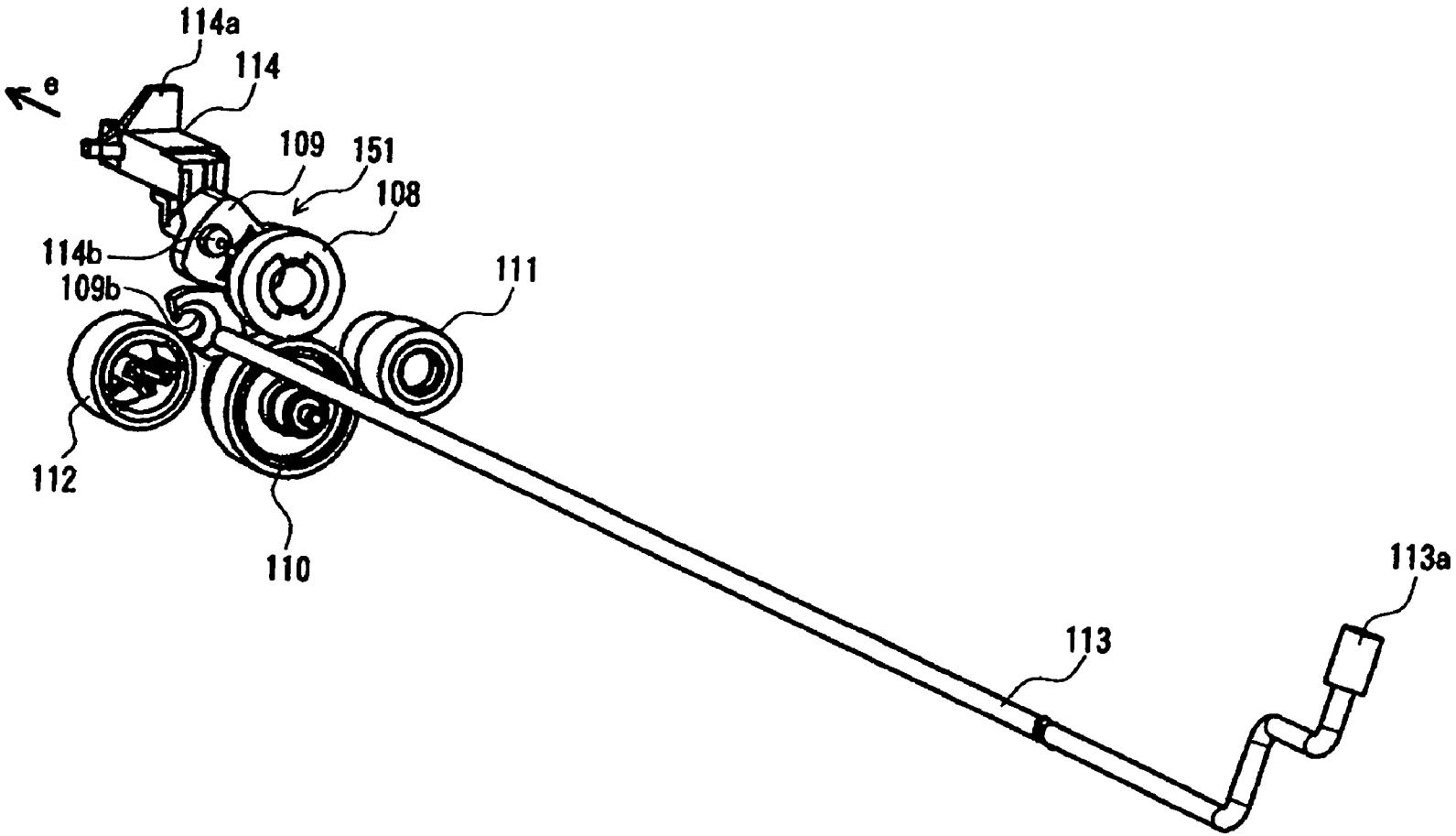
FIG. 38 is a perspective view showing the state of the controlling members (A), (B) and the pendulum arm in the state of FIG. 37.
Figure 40:
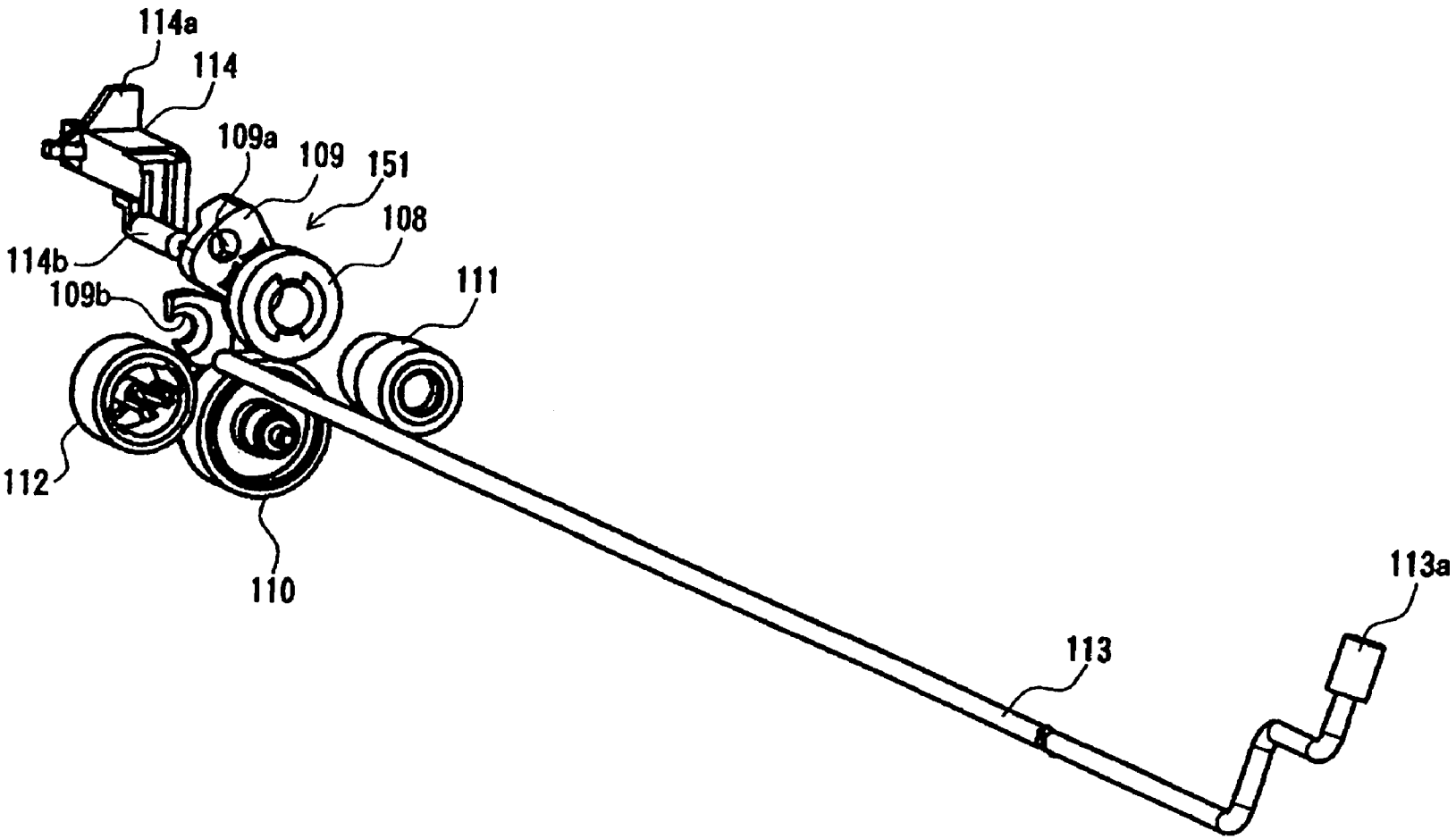
FIG. 40 is a perspective view showing the state of the controlling members (A), (B) and the pendulum arm in the state of FIG. 39.

As shown in FIGS. 22, 38 and 40, a through circular hole 109*a* and a semi circular notch 109*b* are formed in the pendulum arm (A) 109. The pendulum arm (A) 109 faces one end of a rod-like controlling member (A) 113. Moreover, a controlling member (B) 114 is disposed in the vicinity of the pendulum arm (A) 109. At the time the planetary gear (A) 110 is disposed at a position not to be engaged with either of the recovery inputting gear 111 or the recording paper separating inputting gear 112, the reading locking means, such as the controlling member (A) 113 is engaged with the semi circular notch 109*b* so as to limit (lock) the movement of the planetary gear (A) 110.

The recording intermediate locking means such as the controlling member (B) 114 is for limiting (locking) the movement of the planetary gear (A) 110 by engaging the boss 114*b* with the hole 109*a*.

As shown in FIG. 14, the controlling member (B) 114 is disposed reciprocally movably in the direction parallel to the carriage 4 moving direction in the recording head recovery unit 101 so as to be forced by an unshown flexible member in the arrow d direction.

Figure 24:
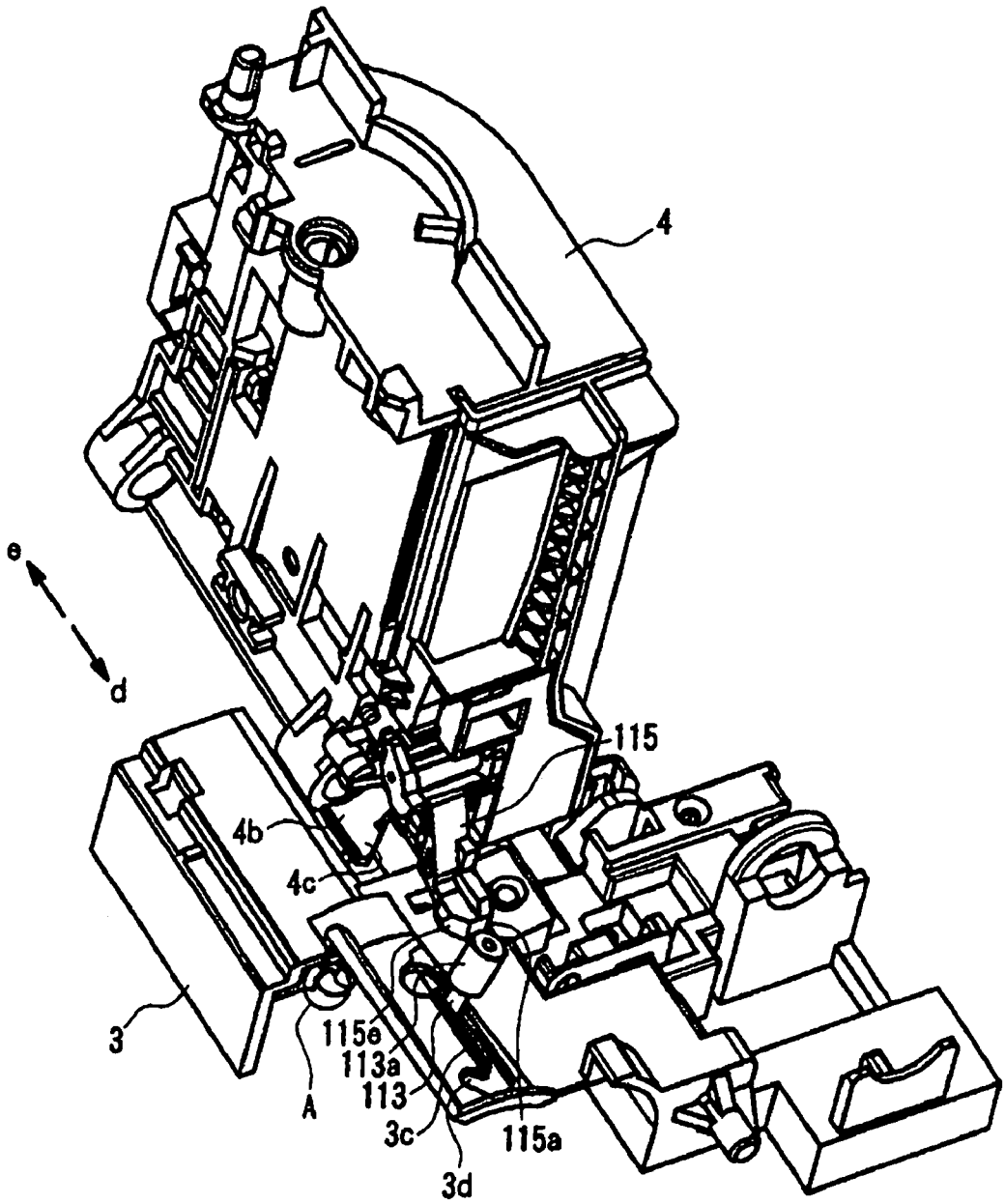
FIG. 24 is a perspective view of FIG. 23.

The controlling member (A) 113 having a rod-like shape is supported on the both side walls of the platen 3 rotatably as shown in FIG. 24, and reciprocally movably in the arrow d, e directions shown in FIG. 14. Then, the controlling member (A) 113 is forced in the arrow e direction shown in FIG. 14 by an unshown spring.

Figure 36:
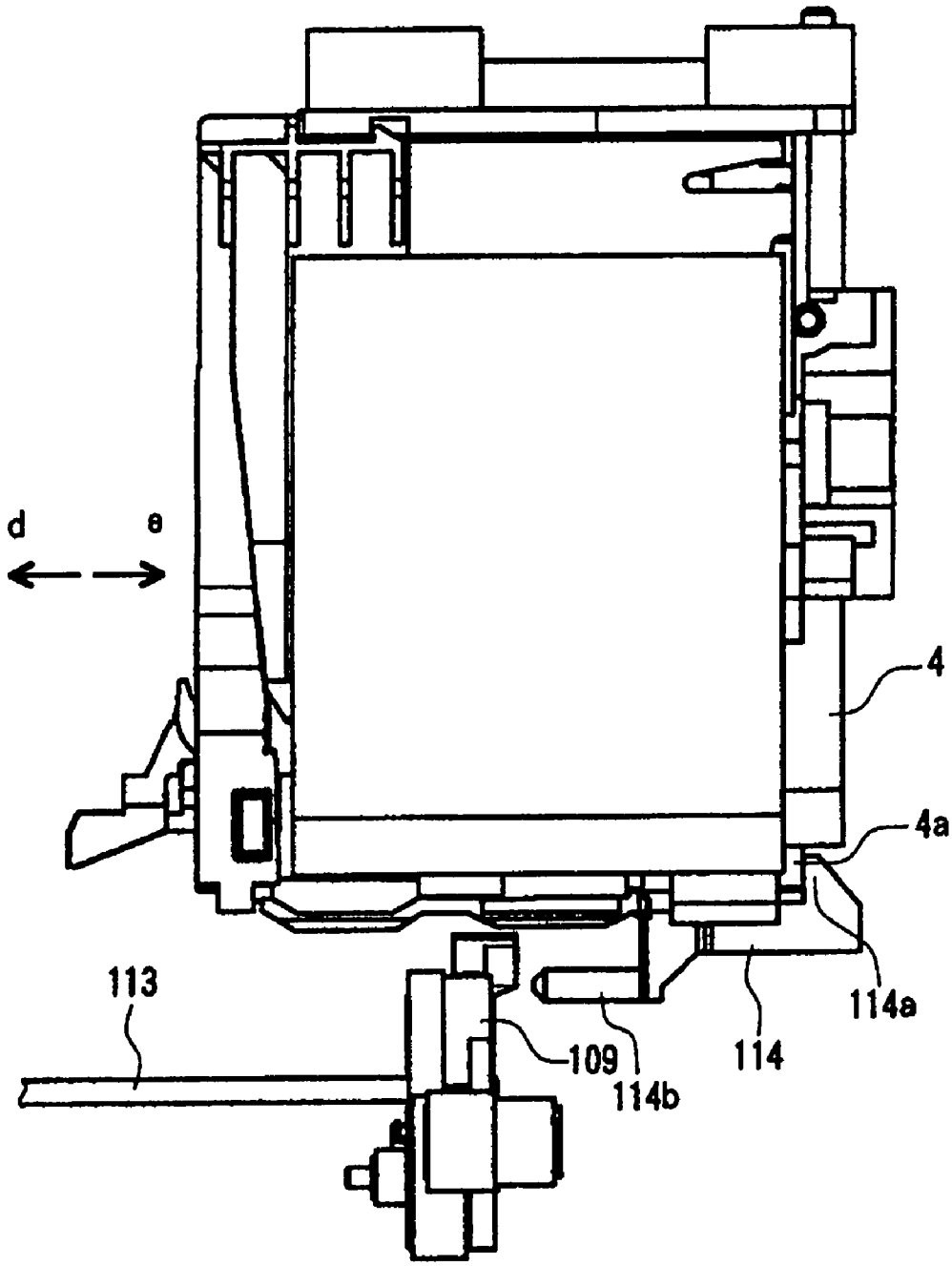
FIG. 36 is a diagram showing the relative positional relationship between the carriage, the controlling member (B) and the pendulum arm (A) at the time the controlling member (B) is in the turned ON state.
Figure 42:
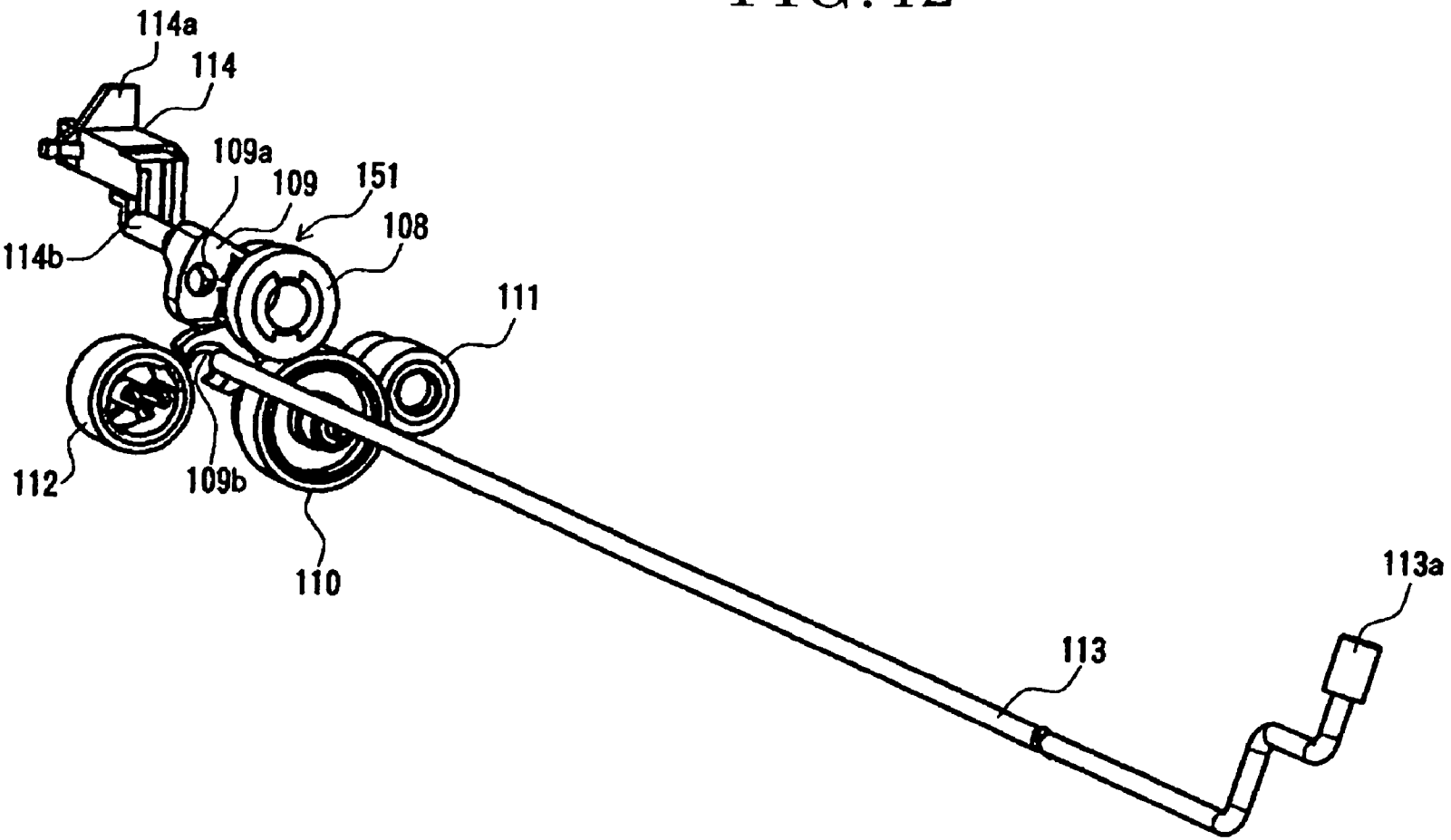
FIG. 42 is a perspective view showing the state of the controlling members (A), (B) and the pendulum arm in the state of FIG. 41.
Figure 43:
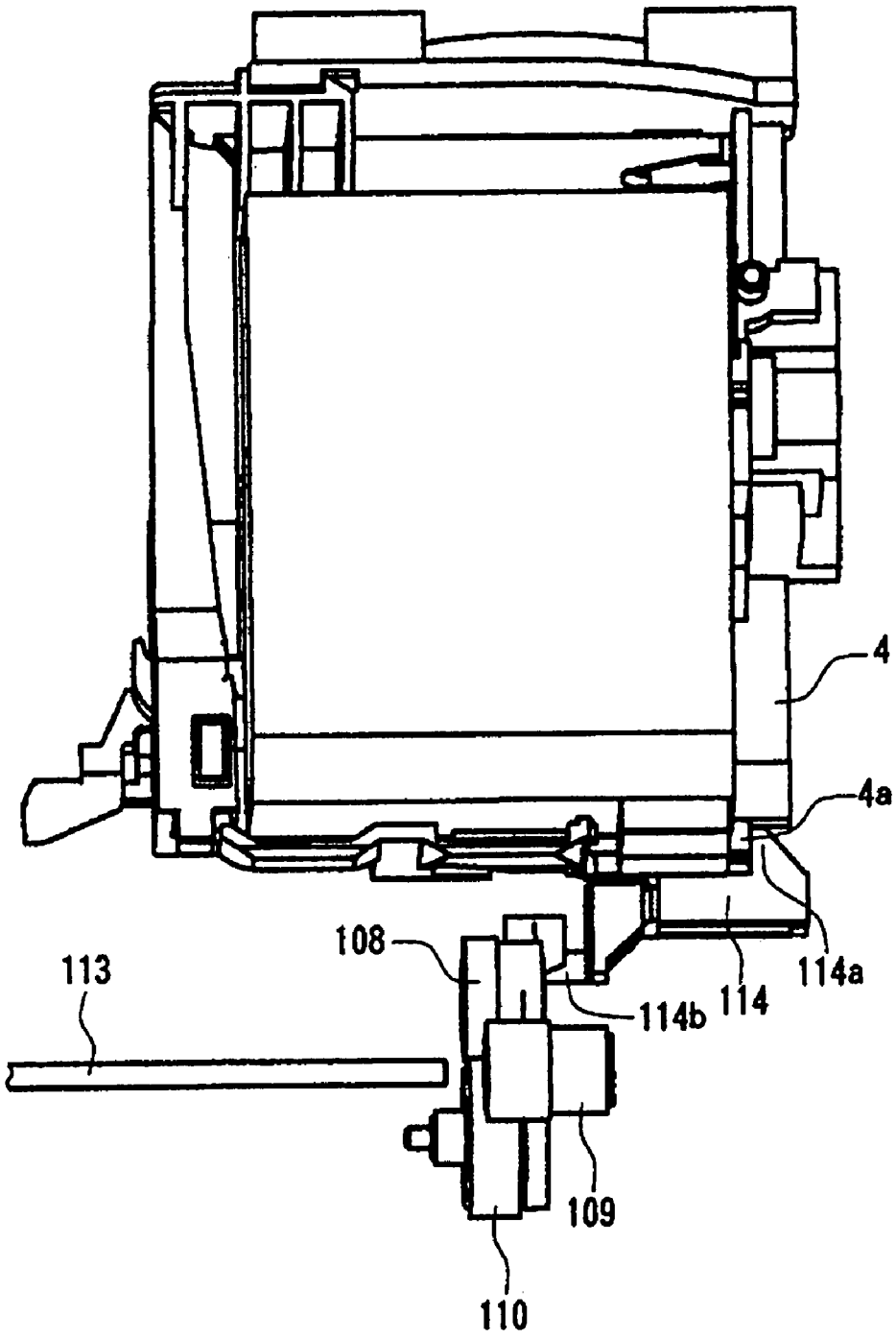
FIG. 43 is a diagram showing the state of the pendulum arm (A) engaged with the controlling member (B) and separated from the controlling member (A)

As shown in FIGS. 36 and 43, the projection 114*a* of the controlling member (B) 114 is to be engaged with the wall 4*a* of the carriage 4. As shown in FIG. 14, at the time the carriage 4 is at the capping position, the idle vacuuming position, and the recording separating feeding direction, since the wall 4*a* shown in FIG. 36 pushes the projection 114*a* of the controlling member (B) 114 to the right side (arrow e direction in FIG. 14), the controlling member (B) 114 is moved in the same direction so that the hole 109*a* and the boss 114*b* of the controlling part (B) 114 are in a non engaged state (ON) as shown in FIGS. 36, 40 and 42.

Since the top end part of the boss 114*b* has a tapered shape and the hole 109*a* has a conical shape, at the time the carriage 4 is in the arrow d direction with respect to the recording separating feeding position including the printing moving range position as shown in FIG. 14, the controlling member (B) 114 is pushed in the arrow d direction by the flexible member (not shown) of the controlling member (B) 114 so that the boss 114*b* is engaged with the hole 109*a* regardless of the position of the pendulum arm (A) 109 of the recording switching part 151 as shown in FIGS. 38 and 43. In the engaged state (OFF), the recording switching part 151 is in a idle rotation state.

The position of the ink cartridge 1 shown in FIG. 14 is shown by the ink ejecting hole of the ink cartridge 1.

In FIG. 14, the area between the recording separating feeding position and the recording head ink ejecting position, and the recording area such as the printing moving range position X area are defined to be the first area W. Moreover, the area between the recording separating feeding position and the capping position is defined to be the second area Y. Furthermore, the area between the position whereat the carriage 4 starts switching the controlling member (A) from the reading position to the recording position and the position whereat the carriage 4 starts switching the controlling member (A) from the recording position to the reading position is defined to be the third area Z. The first area may only be the printing moving range position X area. In this case, the area between the recording separating feeding position and the recording head ink ejecting position may be added to the second area.

Figure 35:
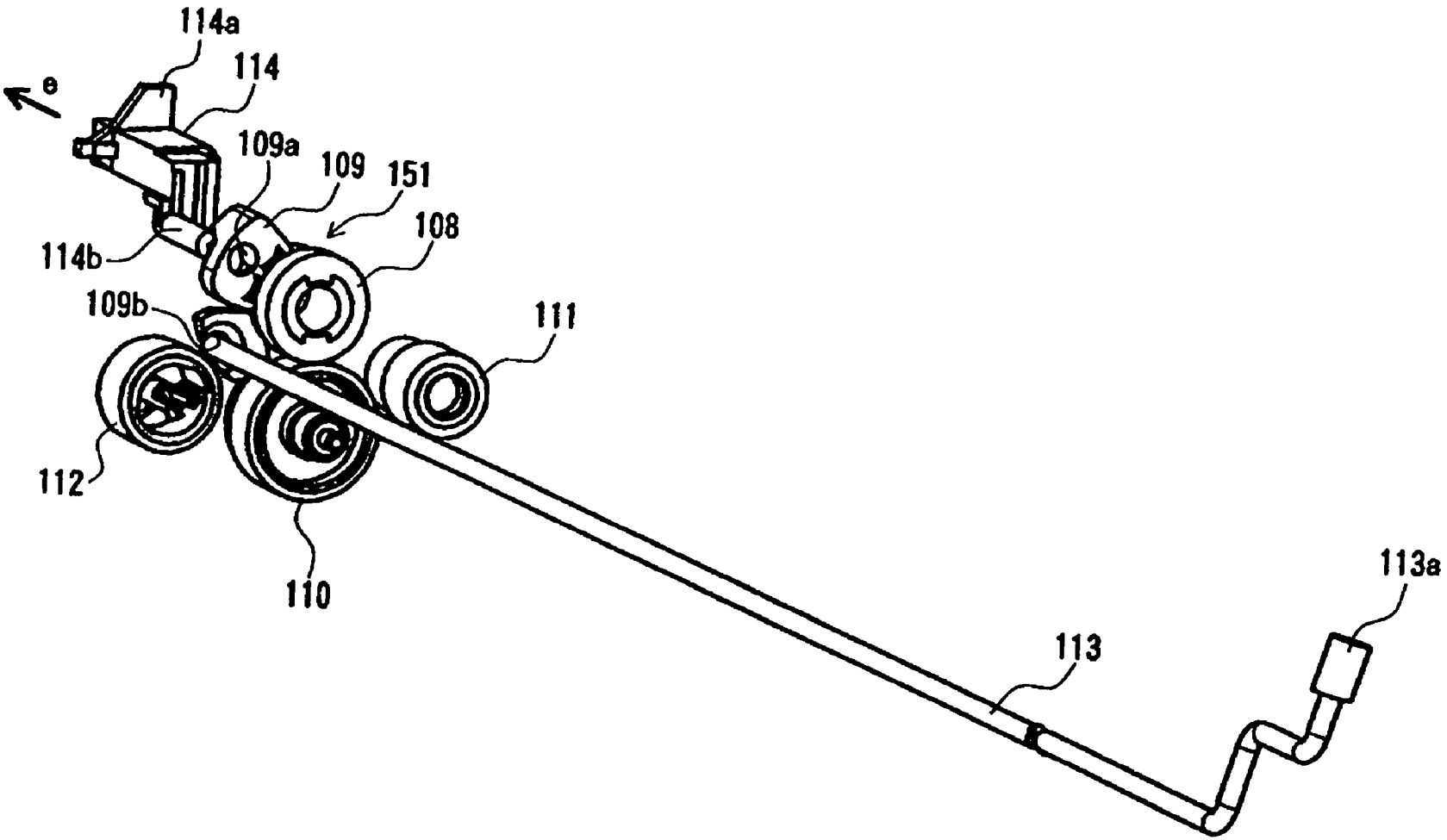
FIG. 35 is a perspective view of the controlling members (A), (B) at the time the controlling member (A) is in the switched OFF state and the controlling member (B) is in the switched ON state.

The position whereat the carriage 4 starts switching the controlling member (A) from the reading position to the recording position is the position whereat the carriage 4 approaches and moves from the right side to the controlling member (A) 113 so as to start moving the controlling member (A) 113 to the left side for starting detaching the controlling member (A) 113 from the notch 109*b* at the time the low friction part 113*a* of the controlling member (A) 113 is at the reading position on the right side in the different shape hole 3*c* corresponding to the carriage Z1 shown in FIG. 14 (as shown in FIG. 35, the controlling member (A) 113 is engaged with the notch 109*b* of the pendulum arm (A) 109). The operation will be explained later in detail.

The position whereat the carriage 4 starts switching the controlling member (A) from the recording position to the reading position is the position whereat the carriage 4 approaches and moves from the right side to the controlling member (A) 113 so as to detach the low friction part 113*a* from the different shape hole 3*d* so that the controlling member (A) 113 can engage with the notch 109*b* by the pressuring force in the arrow 3 direction at the time the low friction part 113*a* is at the recording position and engaged with the different shape hole 3*d* corresponding to the carriageZ2 as shown in FIG. 14 (as shown in FIG. 40, the controlling member (A) 113 is detached from the notch 109*b* of the pendulum arm (A) 109). The operation will be described later in detail.

Next, the operation of the controlling member (A) 113 will be explained.

Figure 23:
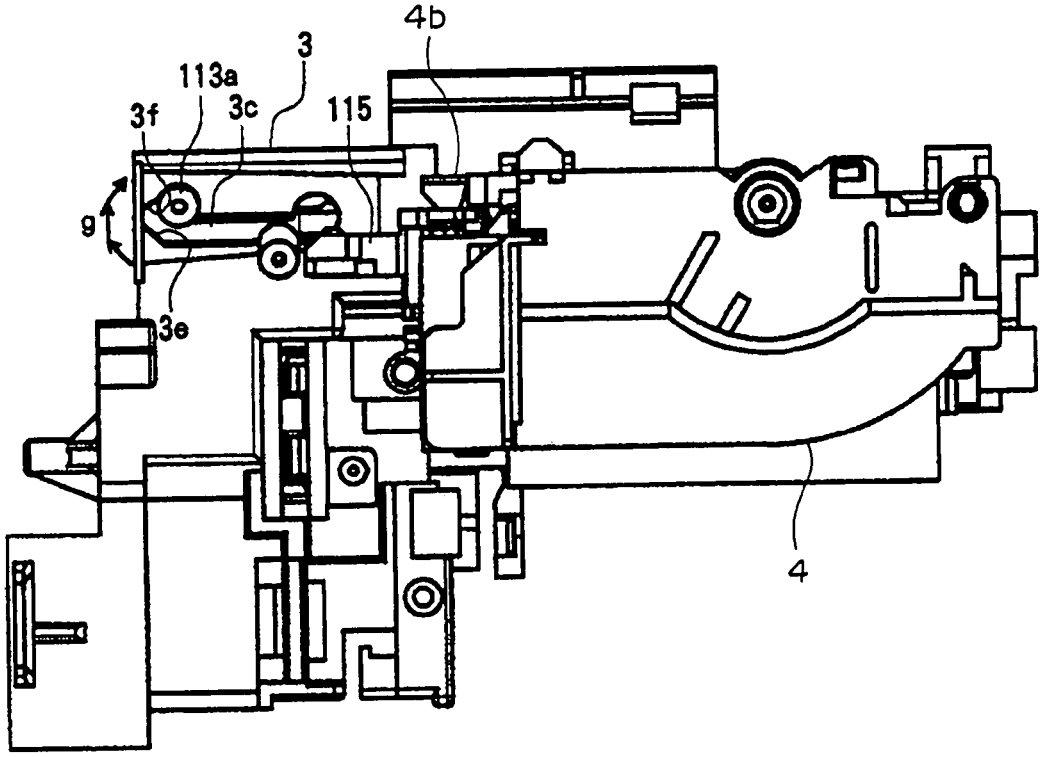
FIG. 23 is an enlarged diagram of the vicinity of the carriage at the time the carriage is moved to the left side in FIG. 14.
Figure 26:
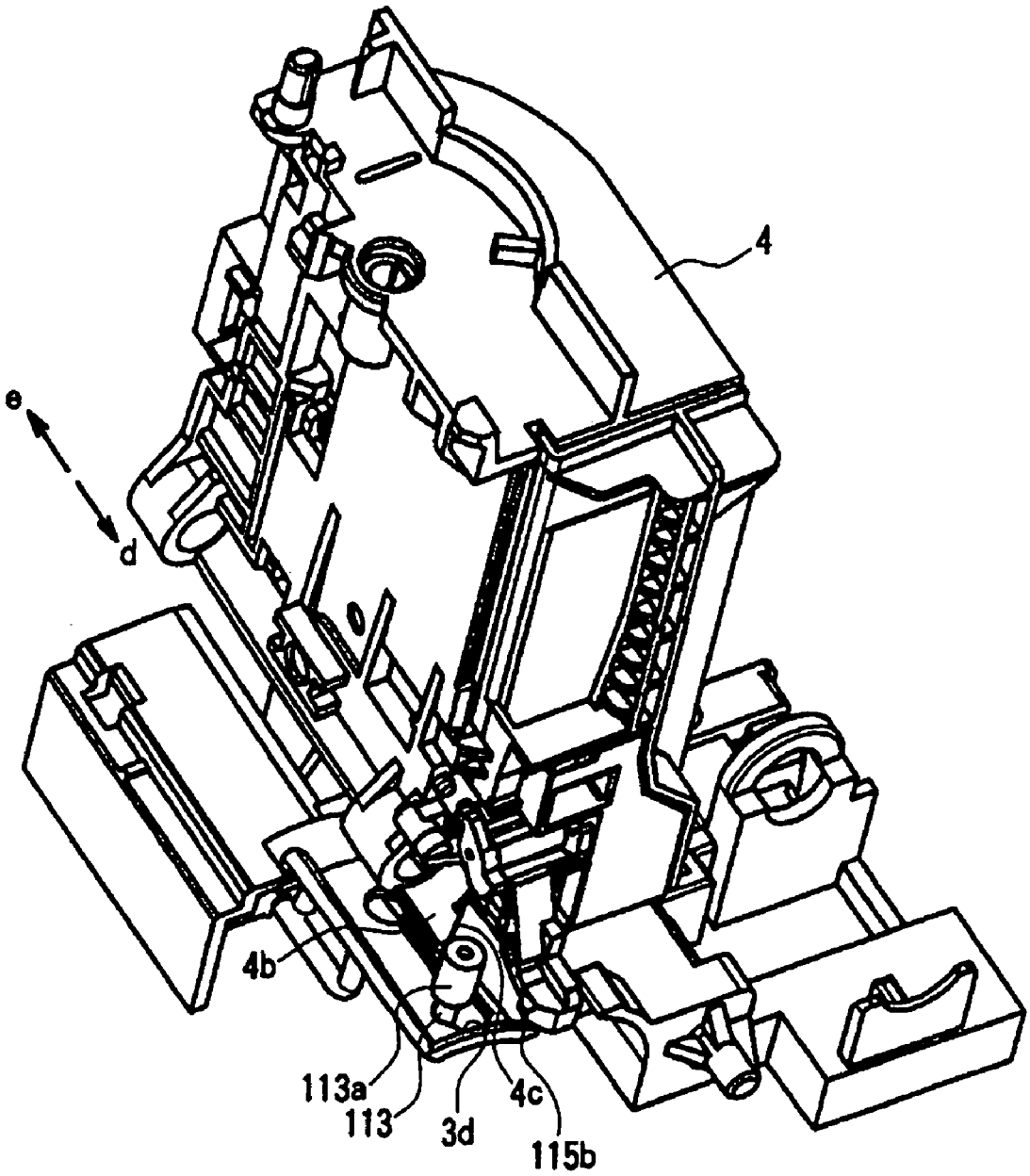
FIG. 26 is a perspective view of FIG. 25.
Figure 27:
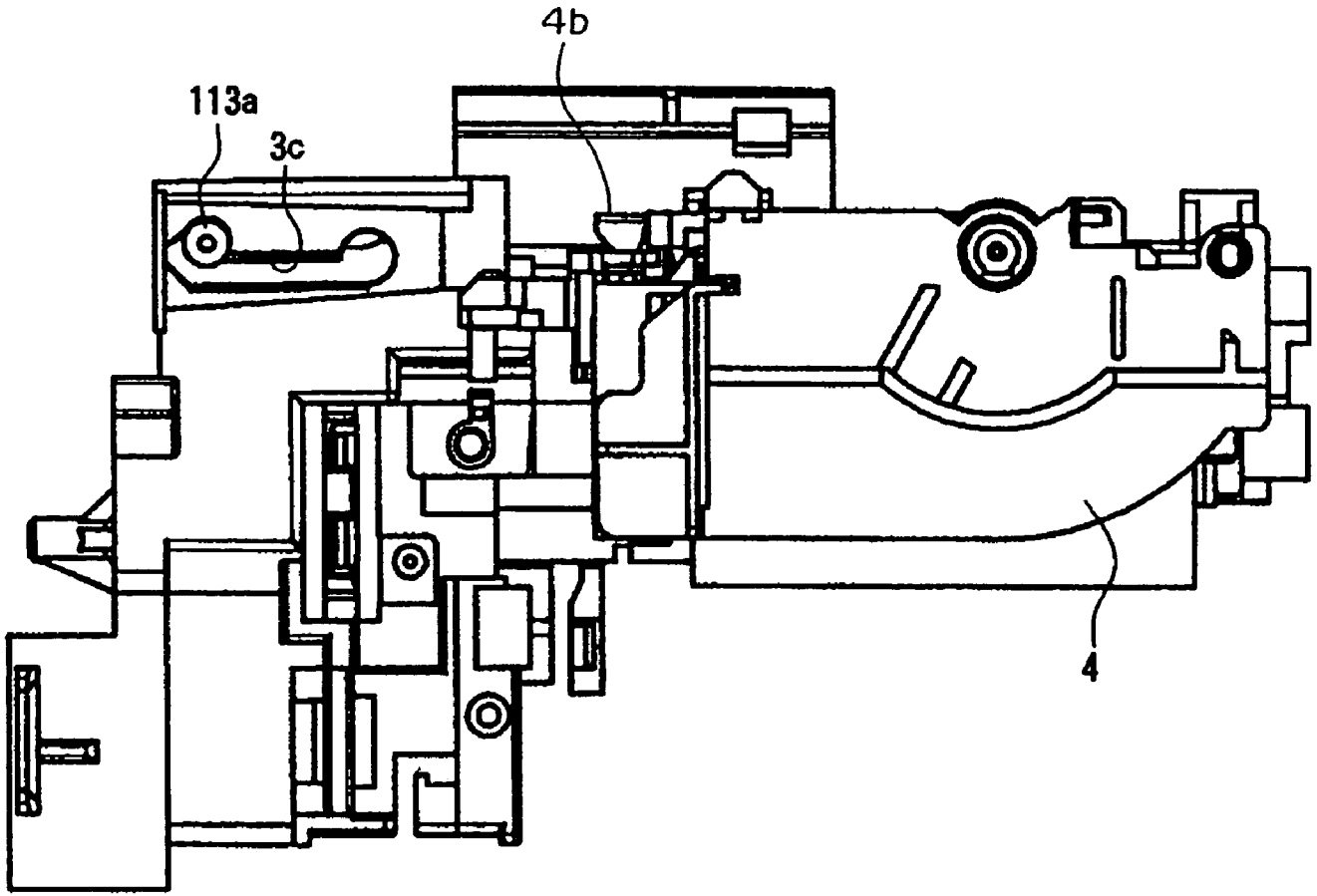
FIG. 27 is a plan view of the vicinity of the controlling member (A) at the time the controlling member (A) is engaged with a different shape hole so as to be in the switched ON state (released state)
Figure 33:
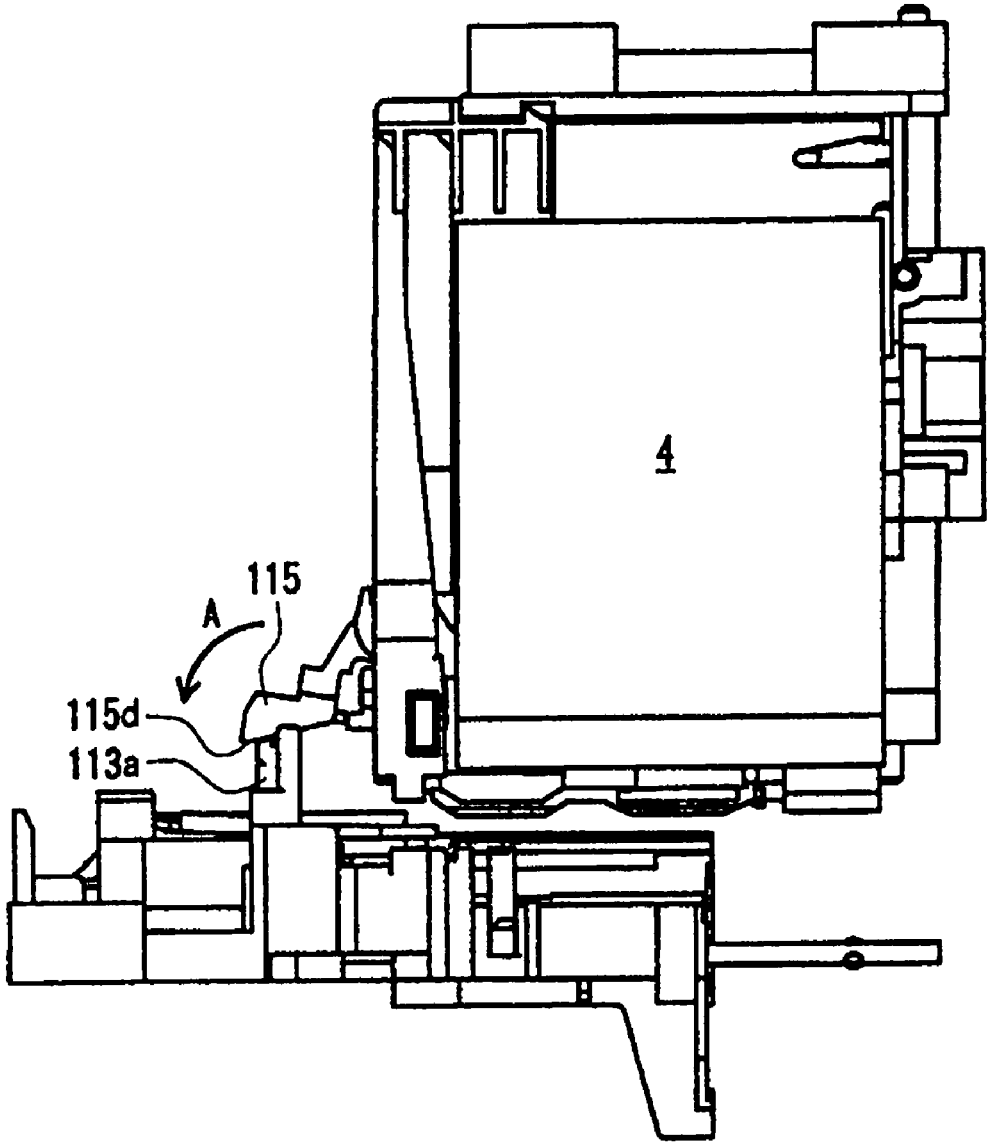
FIG. 33 is a diagram viewed from the right side of FIG. 32.

As shown in FIGS. 24 and 33, the carriage 4 is provided with a carriage cam 115 rotatably in the up and down direction. The carriage cam 115 is forced in the arrow A direction in FIG. 33 by an unshown flexible member. Moreover, as shown in FIGS. 23 and 24, continuous different shape holes 3*c*, 3*d* are formed in the plate 3. As shown in FIG. 35, the controlling member (A) 113 is formed in a substantially L shape. As shown in FIG. 26, the L shaped part communicates with the different shape holed 3*c*, 3*d*. The low friction part 113*a* made of a plastic, or the like is fixed on the communicated top end upper part.

Figure 37:
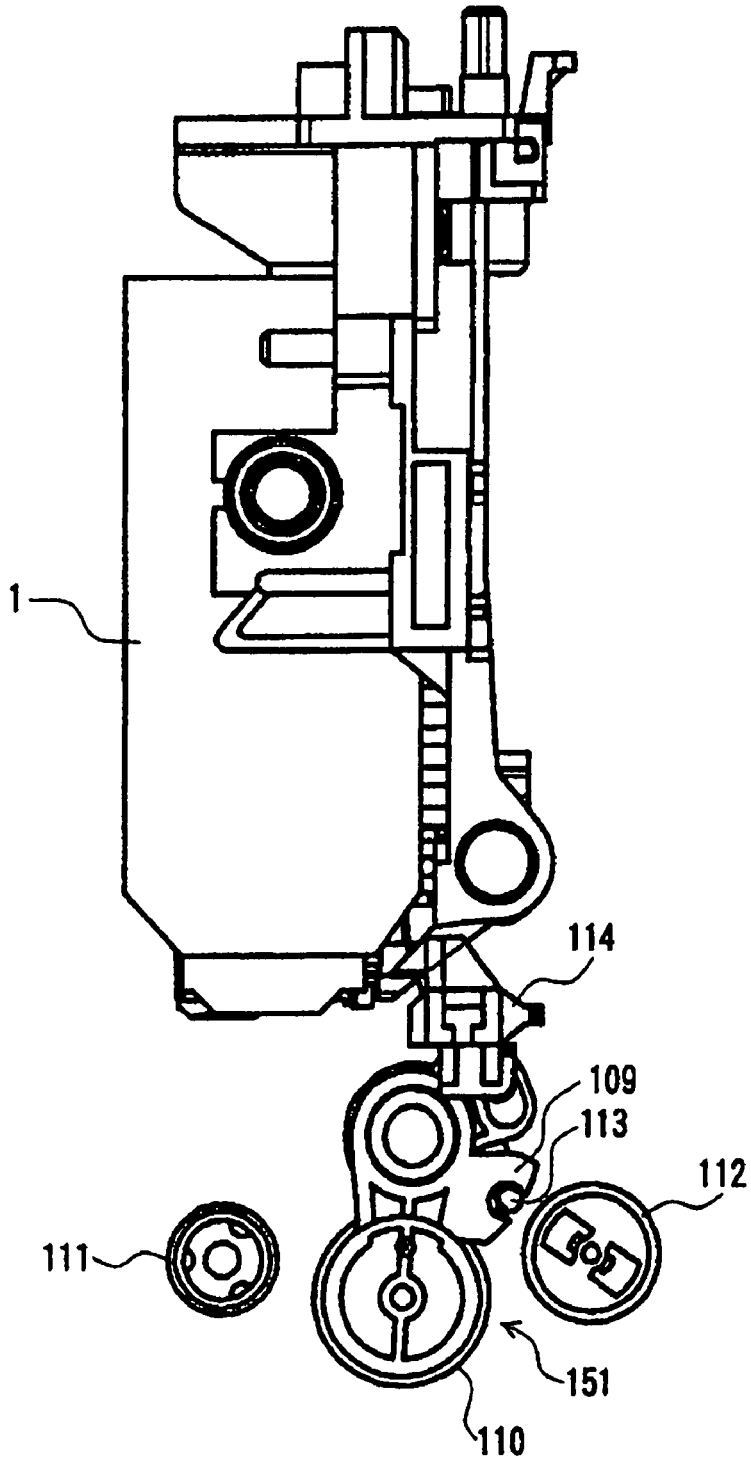
FIG. 37 is a diagram showing the state of the pendulum arm (A) at the time the pendulum arm a is not tilted.

At the time the controlling member (A) 113 is at the position shown in FIG. 24 (the low friction part 113*a* of the controlling member (A) 113 is at the different shape hole 3*c*), it is in he OFF state (stopped state) as shown in FIG. 35. That is, as shown in FIG. 35, since the controlling member (A) 113 is engaged with the semi circular notch 109*b* of the pendulum arm (A) 109, the planetary gear (A) 110 of the recording switching part 151 is in the idle rotation position (as shown in FIG. 37, the position whereat the planetary gear (A) 110 is not engaged with the recovery inputting gear 111, and the recording paper separating inputting gear 112).

Figure 39:
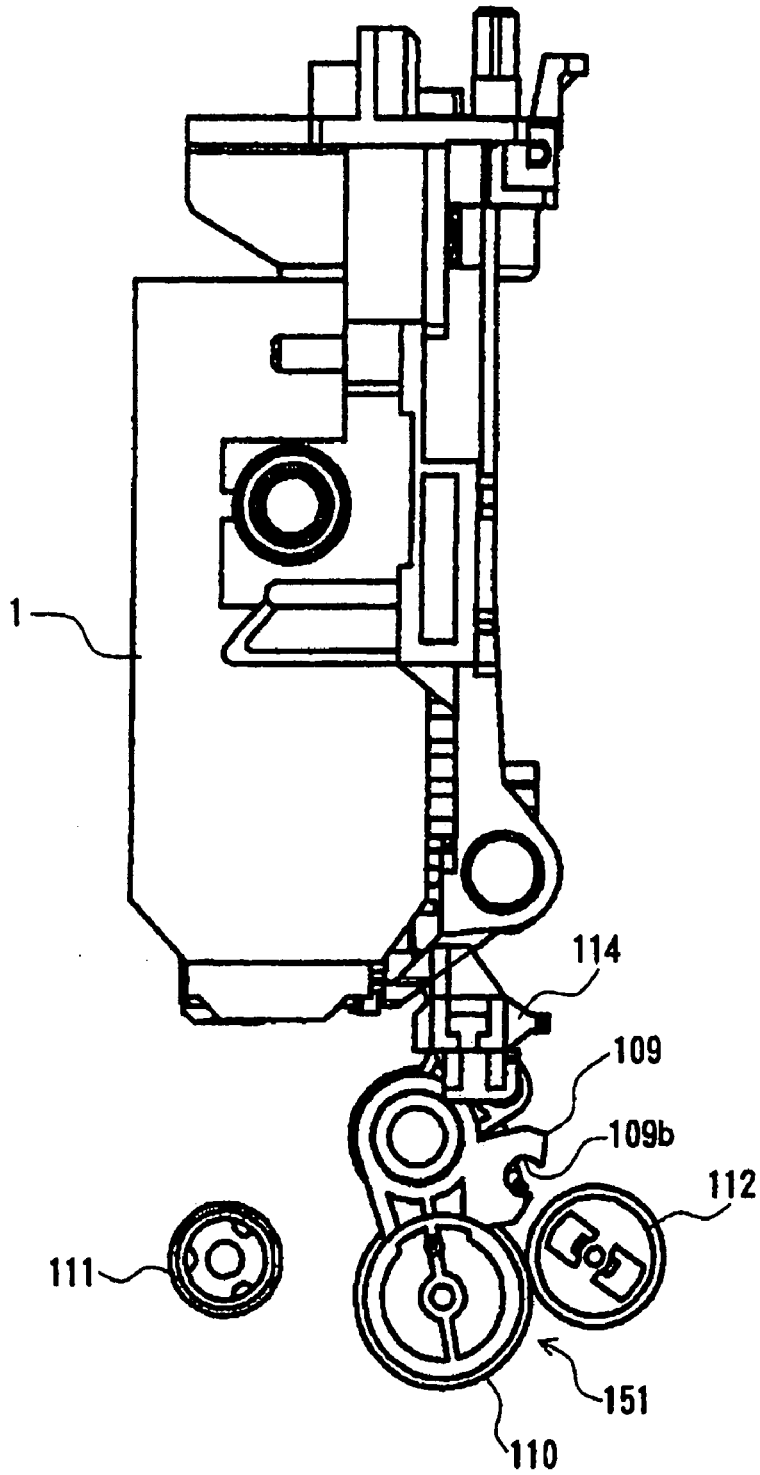
FIG. 39 is a diagram showing the state of the pendulum arm (A) at the time the pendulum arm (A) is tilted so that the recording paper separating inputting gear is engaged with the planetary gear (A)
Figure 41:
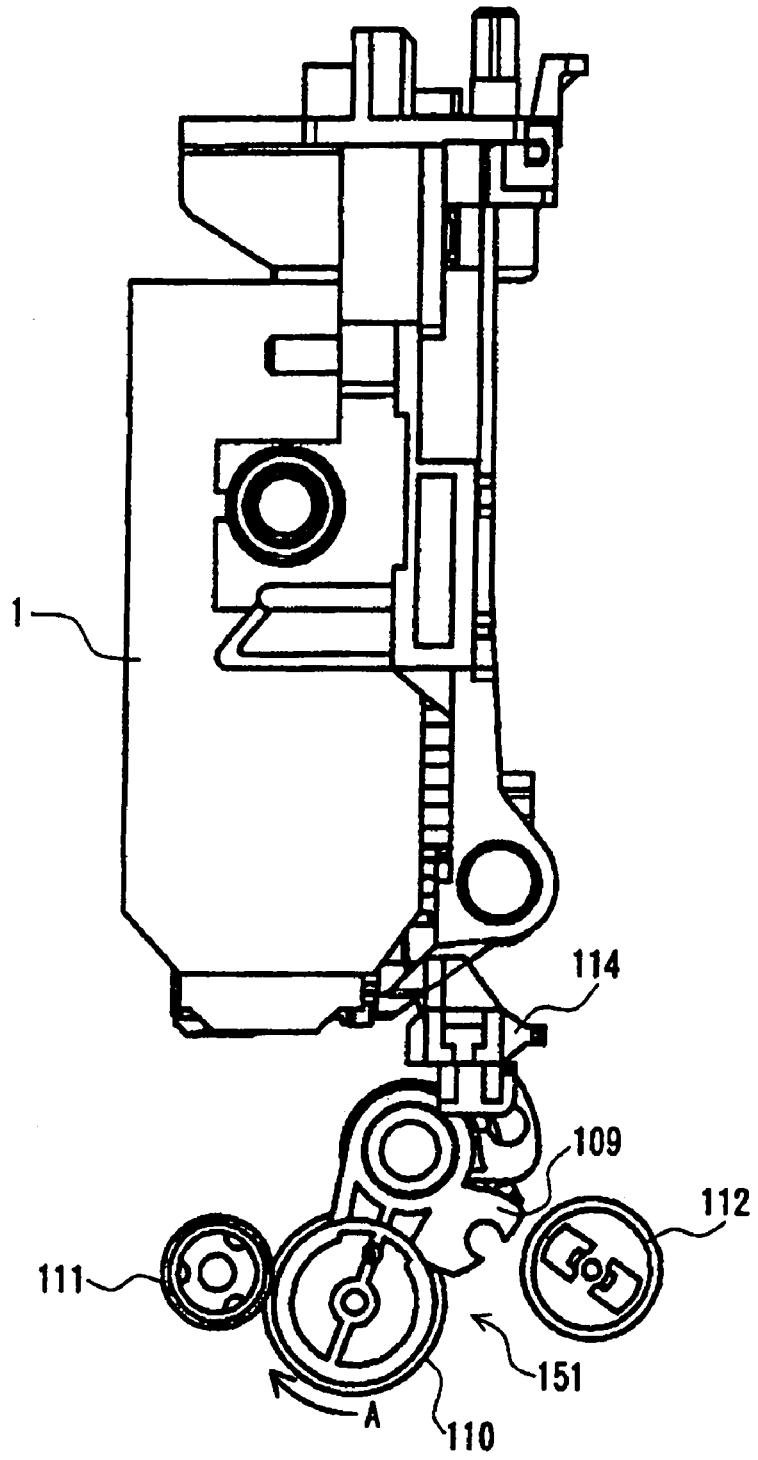
FIG. 41 is a diagram showing the state of the pendulum arm (A) at the time the pendulum arm (A) is tilted so that the recovery inputting gear is engaged with the planetary gear (A)

Moreover, at the time the controlling member (A) 113 is at the position shown in FIG. 26, (the low friction part 113*a* of the controlling member (A) 113 is at the different shape hole 3*d*), it is in the ON state (released state) as shown in FIGS. 38, 40 and 42. That is, since the controlling member (A) 113 is detached from the semi circular notch 109*b* of the pendulum arm (A) 109, in the case where the controlling member (B) 114 is in the ON state (FIGS. 40 and 42), the planetary gear (A) 110 of the recording switching part is engaged with the recording paper separating inputting gear 112 as shown in FIG. 39 by the forward rotation (in the paper feeding direction) of the feeding roller 10 so as to have the recording paper separating roller 19 (see FIG. 1) in the recording paper separating feeding state so that it is engaged with the recovery inputting gear 111 as shown in FIG. 41 by the backward rotation (in the direction opposite to the paper feeding direction) of the feeding roller 10 for having the recovery means in the operation state such as vacuuming the ink from the ink ejecting hole of the ink cartridge 1.

Here, the switching operation of the controlling member (A) 113 from the position shown in FIG. 24 (OFF, stoppage state), to the position shown in FIG. 26 (ON, released state) will be explained.

In the case where the carriage 4 is moved from the position shown in FIG. 24 further to the arrow d direction, the top end part 115*a* of the carriage cam 115 is contacted with the low friction part 113*a* of the controlling member (A) 113. Then, the controlling member (A) 113 is pushed by the top end part 115*a* of the carriage cam 115 so as to be moved in the arrow d direction together with the carriage cam 115. Then, the controlling member (A) 113 is contacted with the hypotenuse part 3*e* (see FIG. 24) of the different shape hole 3*d*. Thereby, the controlling member (A) 113 is guided by the hypotenuse part 3*e* while being pushed by the top end part 115*a* of the carriage cam 115 in FIG. 23 so as to be rotated in the arrow g direction shown in FIG. 23. in the case where the controlling member (A) 113 is tilted slightly in the arrow g direction, the oblique surface 115*e* (see FIG. 24) of the carriage cam 115 is contacted with the controlling member (A) 113. The controlling member (A) 113 is pushed by the oblique surface 115*e* of the carriage cam 115 so as to further continue the rotation in the arrow g direction for being engaged with the different shape hole 3*d* as shown in FIG. 26.

Although the controlling member (A) 113 engaged with the different shape hole 3*d* receives the pressuring force in the arrow e direction, it is maintained in the state engaged with the different shape hole 3*d* as shown in FIG. 26 without moving in the arrow e direction. In contrast, the carriage cam 115 is moved in the arrow e direction integrally with the carriage 4 according to the return of the carriage 4 in the arrow e direction so as to be separated form the controlling member (A) 113.

The position of the carriage 4 in FIG. 26 is the position whereat the carriage in FIG. 14 starts switching the controlling member (A) from the reading position to the recording position. Even in the case where the carriage 4 is rotated in the arrow e direction from the state of FIG. 26, since the controlling member (A) 113 is rotated and moved so as to be engaged with the different shape hole 3*d* as mentioned above, it is not contacted with the side end 115*b* of the carriage cam 115.

The operation of switching the controlling member (A) 113 from the position shown in FIG. 26 (ON, released state) to the position shown in FIG. 24 (off, stopped state) will be explained.

Figure 25:
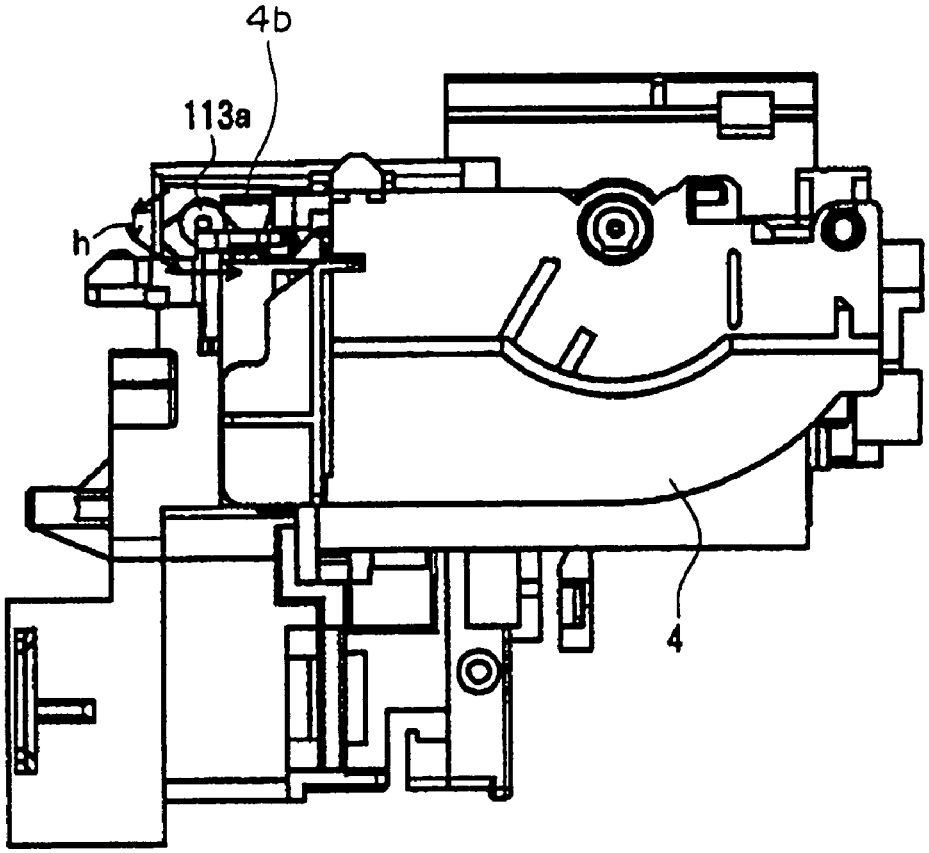
FIG. 25 is a plan view of the vicinity of the carriage for explaining the returning operation of the controlling member (A)
Figure 28:
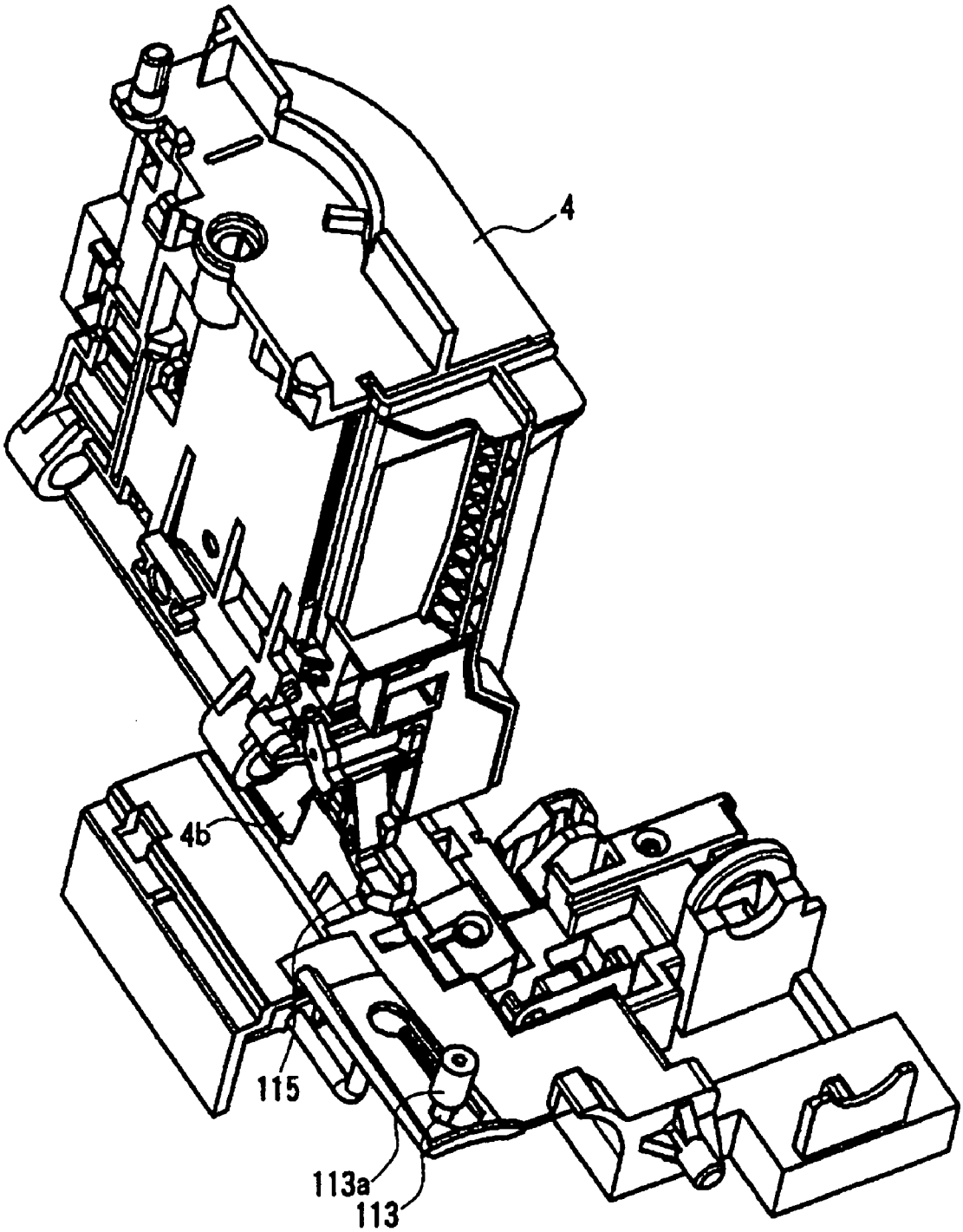
FIG. 28 is a perspective view of FIG. 27.
Figure 29:
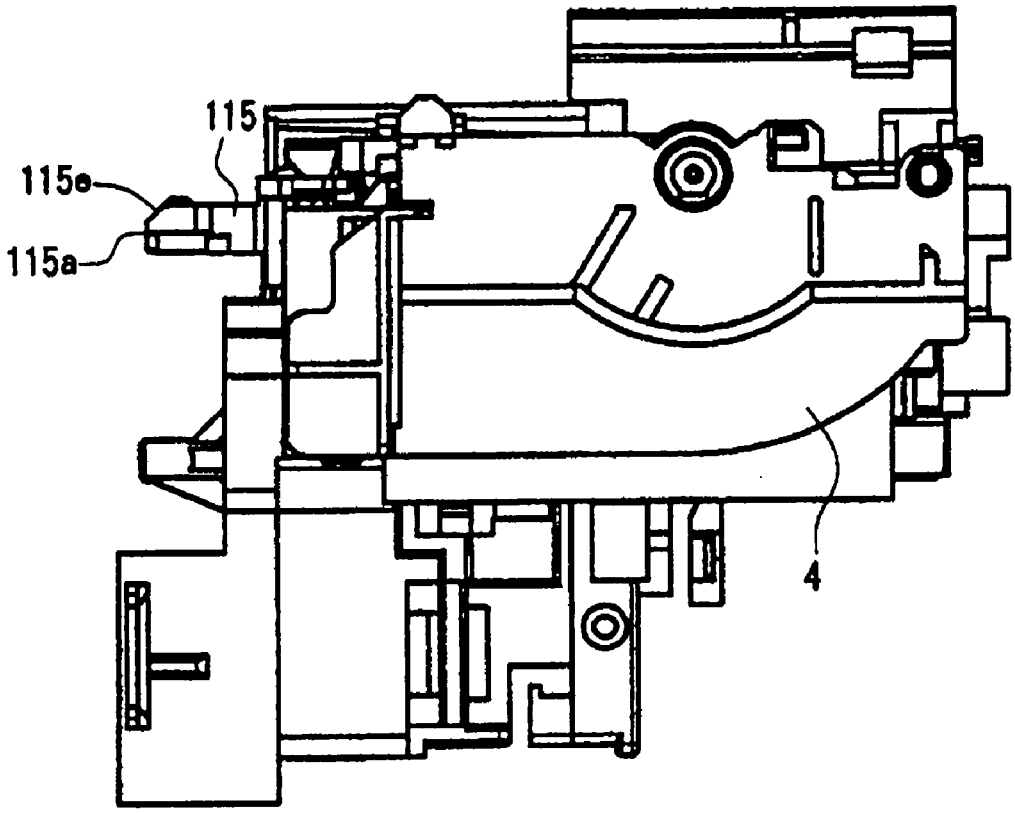
FIG. 29 is a plan view of the vicinity of the controlling member (A) at the time of detaching the controlling member (A) from the different shape hole.
Figure 30:
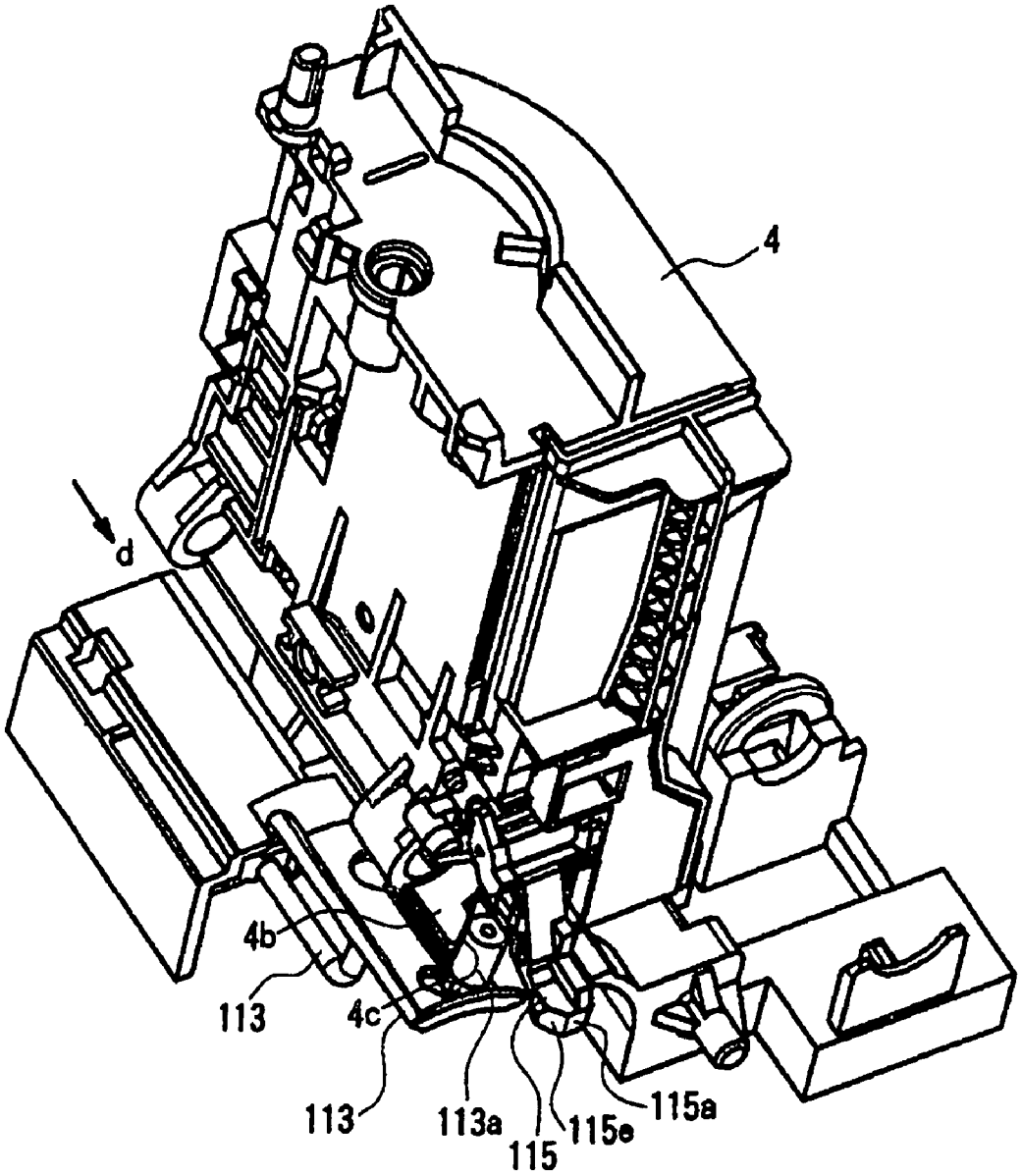
FIG. 30 is a perspective view of FIG. 29.
Figure 31:
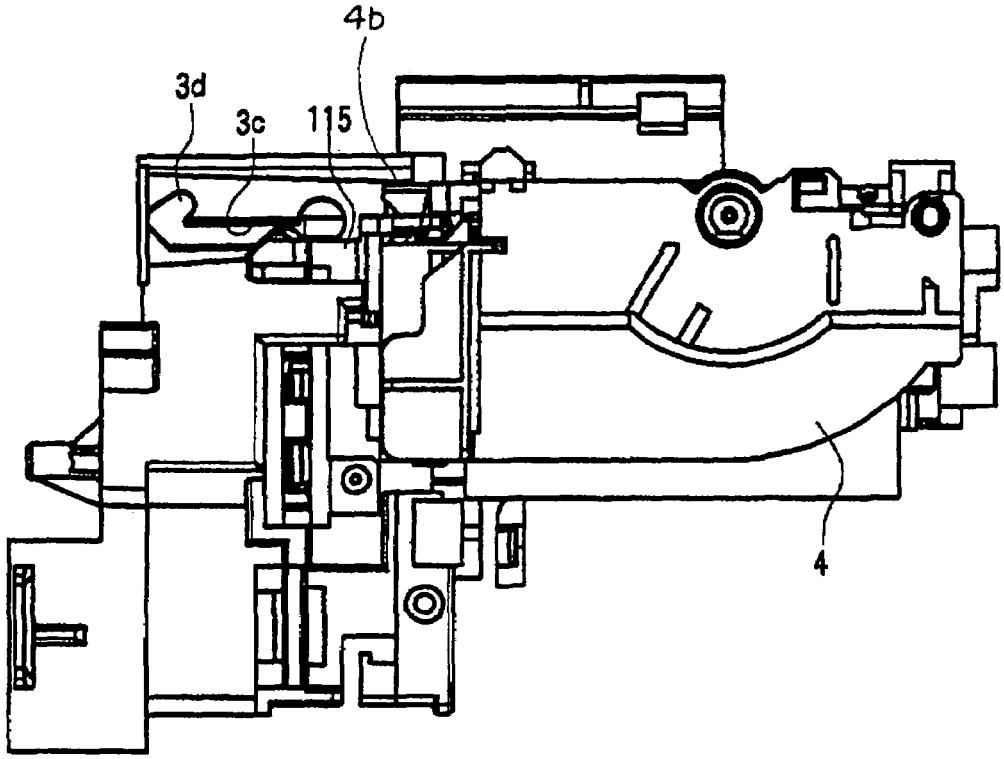
FIG. 31 is a plan view of the vicinity of the controlling member (A) for explaining the passage of the carriage cam above the controlling member (A) a at the time of moving the carriage in the arrow e direction.

In the case where the carriage 4 is moved from the position shown in FIGS. 23 and 28 to the position shown in FIG. 26, and further in the arrow d direction, the triangle shaped part 4*b* of the carriage 4 is contacted with the low friction part 113*a* of the controlling member (A) 113. Then, the controlling member (A) 113 is pushed by the triangle shaped part 4*b* of the carriage 4 so as to be rotated in the arrow h direction shown in FIG. 25 along the hypotenuse parts 3*f*, 3*e* shown in FIG. 23 while being moved in the arrow d direction. The controlling member (A) 113 changes the contact position from the top end of the triangle shaped part 4*b* of the carriage 4 to the tilted part 4*c* according to the rotation in the arrow h direction. FIG. 30 shows the state. Since the carriage 4 shown in FIG. 30 continues the movement in the arrow d direction, the controlling member (A) 113 is pushed by the tilted part 4*c*. Therefore, the controlling member (A) 113 is still rotated in the arrow h direction shown in FIG. 25 so as to come out completely from the different shape hole 3*d*. Thereafter, the carriage 4 returns to the arrow e direction in FIG. 32. Since the controlling member (A) 113 is always forced in the arrow e direction according to the returning movement of the carriage 4, it is moved in the different shape hole 3*c* so as to be returned to the position shown in FIG. 24. The arrow h direction at the time is shown in FIGS. 29 to 32. The carriage 4 position shown in FIG. 30 is the position whereat the carriage starts switching the controlling member (A) from the recording position to the reading position in FIG. 14.

The configuration of the inclined surface for applying the rotating operation to the controlling member (A) 113 being pushed by the carriage and moved, such as the hypotenuse part 3*f*, and the engaging recess part for receiving and engaging with the controlling member (A) 113 being guided by the oblique surface part 3*f*, such as the different shape hole 3*d* is an example of the supporting means.

Figure 32:
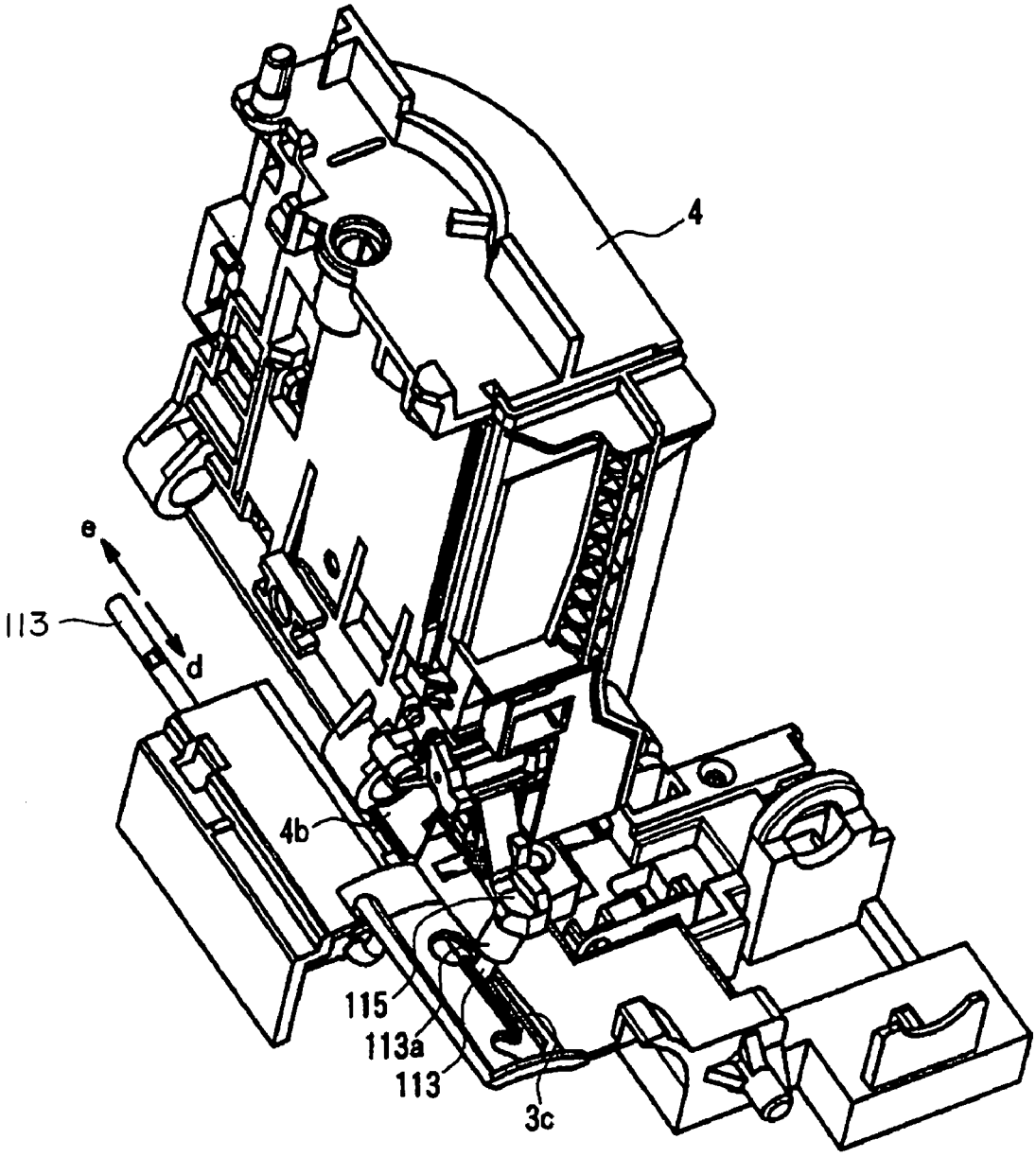
FIG. 32 is a perspective view of FIG. 31.

At the time the carriage 4 is at the position of switching the controlling member (A) form the recording position to the reading position shown in FIG. 14, the carriage cam 115 is at the arrow direction side with respect to the controlling member (A) 113. As shown in FIG. 32, in the case where the controlling member (A) 113 is moved from the position whereat the carriage starts switching the controlling member (A) 113 from the recording position to the reading position to the e direction, the bottom surface part 115*d* of the carriage cam 115 shown in FIG. 33 is contacted with the top surface part of the low friction part 113*a* of the controlling member (A) 113 so as to push up the carriage cam 115 and rotate the same in the direction opposite to the arrow A direction shown in FIG. 33. Then, after having the bottom surface part 115*d* pass by the low friction member 113*a*, the carriage cam 115 is rotated again in the arrow A direction shown in FIG. 33 according to the function of the above-mentioned flexible member so as to be returned to the state shown in FIG. 24.

According to the above-mentioned configuration, only in the case where the controlling member (A) 113 and the controlling member (B) 114 are both in the non engaged state (ON, released state), the pendulum arm (A) 109 can be rotated. Then, in FIG. 15, in the case where the feeding motor 104 is rotated forwardly (the rotation in the arrow B direction shown in FIG. 15), the planetary gear (A) 110 is engaged with the recording paper separating inputting gear 112. In the case where the feeding motor 104 is rotated backwardly, the planetary gear (A) 110 is engaged with the recovery inputting gear 111. The recording separating inputting gear 112 is interlocked with the recording paper separating roller gear 118 mounted on the shaft part of the recording paper separating roller 19, and furthermore, it is interlocked with the cam gear 119 formed integrally with the releasing cam 64 (see FIGS. 15 and 6) for driving the pressure plate 9 (see FIG. 1) on the downstream side thereof. In the case where the planetary gear (A) 110 is engaged with the recovery inputting gear 111, the recovery means, such as vacuuming the ink from the ink ejecting hole of the ink cartridge 1 can be in the operation state.

The recording paper separating inputting gear 112, the two idle gears 116, 117, the recording paper separating roller gear 118, or the like comprise the recording drive transmitting means such as the recording drive transmitting part 152 for transmitting the rotation force of the feeding motor 104 to the recording paper separating roller 19. It is also possible to use a belt, in particular, a belt with teeth may be used in place of the two idle gears 116, 117. Moreover, the recording paper separating inputting gear 112 may be engaged directly with the recording paper separating roller gear 118 by changing the gear ratio.

Document Feed and the CS Moving Driving System Row

Figure 20:
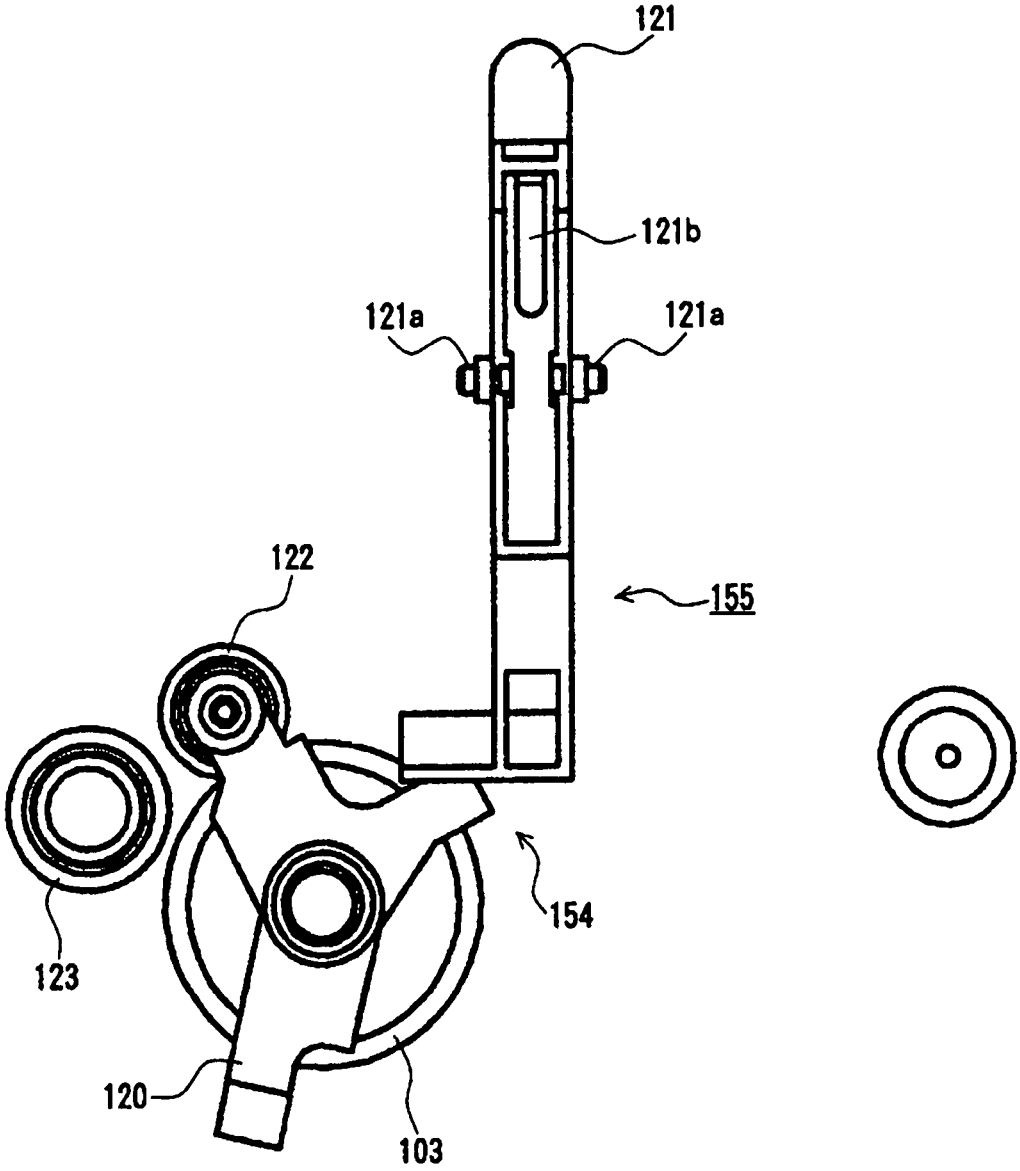

As shown in FIG. 15, a pendulum arm (B) 120 (see FIGS. 20 and 44, or the like) is mounted rotatably on the same axis as the step gear (A) 103. The pendulum arm (B) 120 has a function of switching between transmission of the driving force of the moving means (156, 157) for the contact image sensor (CS) 22 and the CS holder 26 from the stand by position to the reading position or release of the transmission. The planetary gear (B) 122 is pivoted to the pendulum arm (B) 120 with the friction load with respect to the pendulum arm (B) 120. That is, the friction load is generated between the pendulum arm (B) 120 and the planetary gear (B) 122. The planetary gear (B) 122 is engaged with the step gear (A) 103. The step gear (A) 103 serves as the sun gear. The planetary gear (B) 122 is engaged with the driven rotating member such as the step gear (B) 123. It is also possible to generate the friction load between the pendulum arm (B) 120 and the step gear (A) 103 instead of generating the friction load between the pendulum arm (B) 120 and the planetary gear (B) 122. Or it is also possible to generate the friction load between the pendulum arm (B) 120 and the planetary gear (B) 122, and between the pendulum arm (B) 120 and the step gear (A) 103.

The sun rotating member such as the step gear (A) 103, the rotating member such as the pendulum arm (B) 120, the planetary rotating member such as the planetary gear (B) 122, the releasing member to be described later such as the releasing button 140, or the like are the reading switching means, which comprise the rotation force transmitting device such as the reading switching part 154. The step gear (A) 103, the planetary gear (B) 122, the step gear (B) 123 may be a roller. The releasing button 140 needs not be always provided.

The controlling member such as the controlling arm 121 as shown in FIGS. 44 to 49 is mounted on the side plate of the chassis 7 (see FIGS. 45 and 48) having the guide rail 7*a* as shown in FIG. 11. The controlling arm 121 is formed in a strip-like shape longitudinally in the up and down direction. The center part 121*a* of the controlling arm 121 is pivoted swayably with respect to eh chassis 7. The controlling arm 121 has the tongue piece 121*b* having the flexibility formed integrally in the upper part of the controlling arm 121, butted against the chassis 7 so as to be forced to the chassis 7 side in the lower part by the generated reaction force. This state is defined to be the pendulum arm (B) 120 off (stoppage state, see FIGS. 44, 45 and 46), and the reading switching part 154 idle rotation state.

The controlling arm 121, the reading switching part 154, the step gear (B) 123, the step gear (C) 124, the step gear (D) 125, or the like comprise the reading drive switching part 155. For the reading drive switching part 155, a belt may be used without using the gear. Moreover, the reading drive switching part 155 comprises the document feeding transmitting means together with the reading drive transmitting part 158. Furthermore, the reading drive changing part 155 comprises the moving means together with the CS drive transmitting part 156 and the CS forcing moving part 157.

Figure 44:
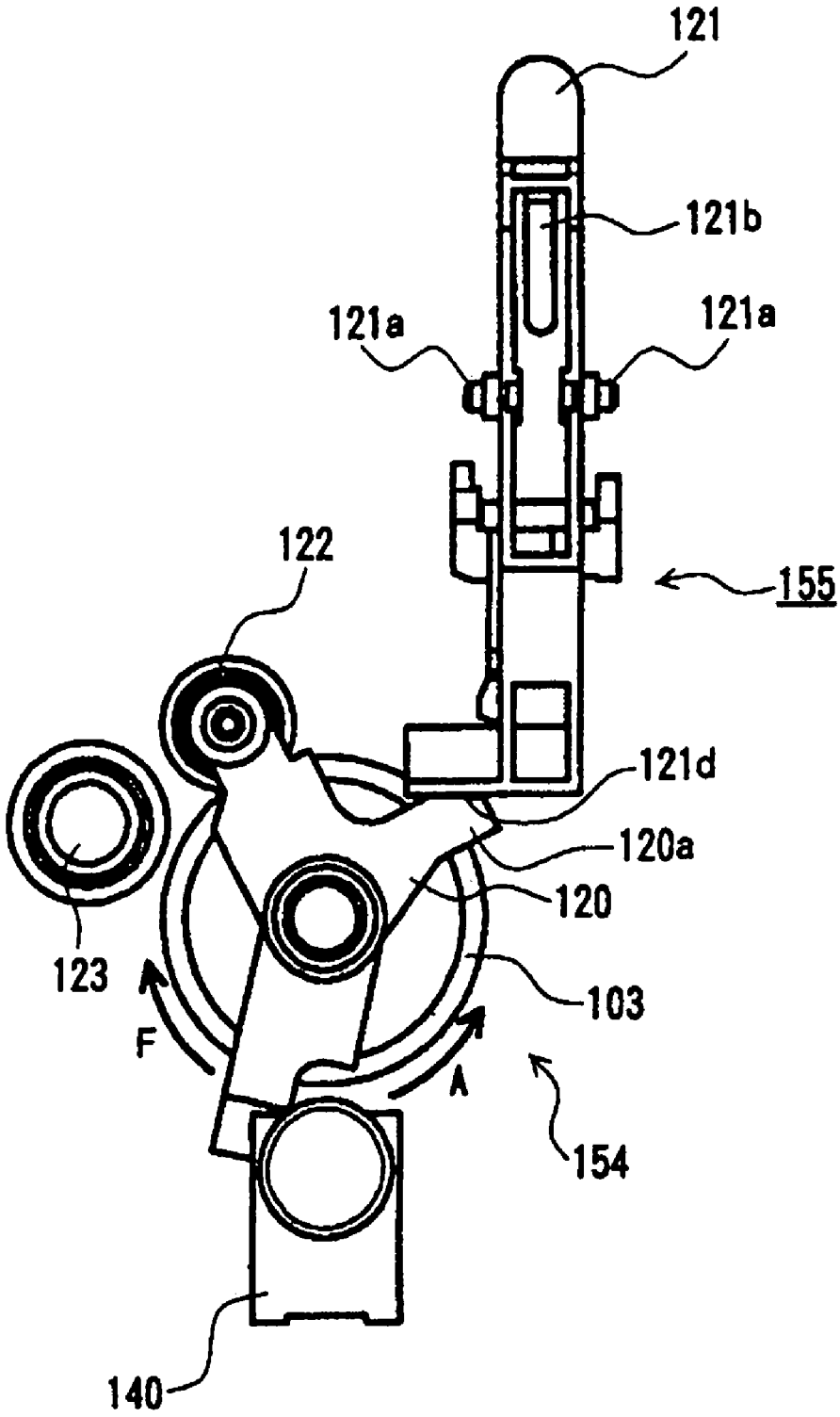
FIG. 44 is a diagram showing the switched OFF state of the pendulum arm (B) (stoppage state) and the idle rotation state of the reading switching part.
Figure 45:
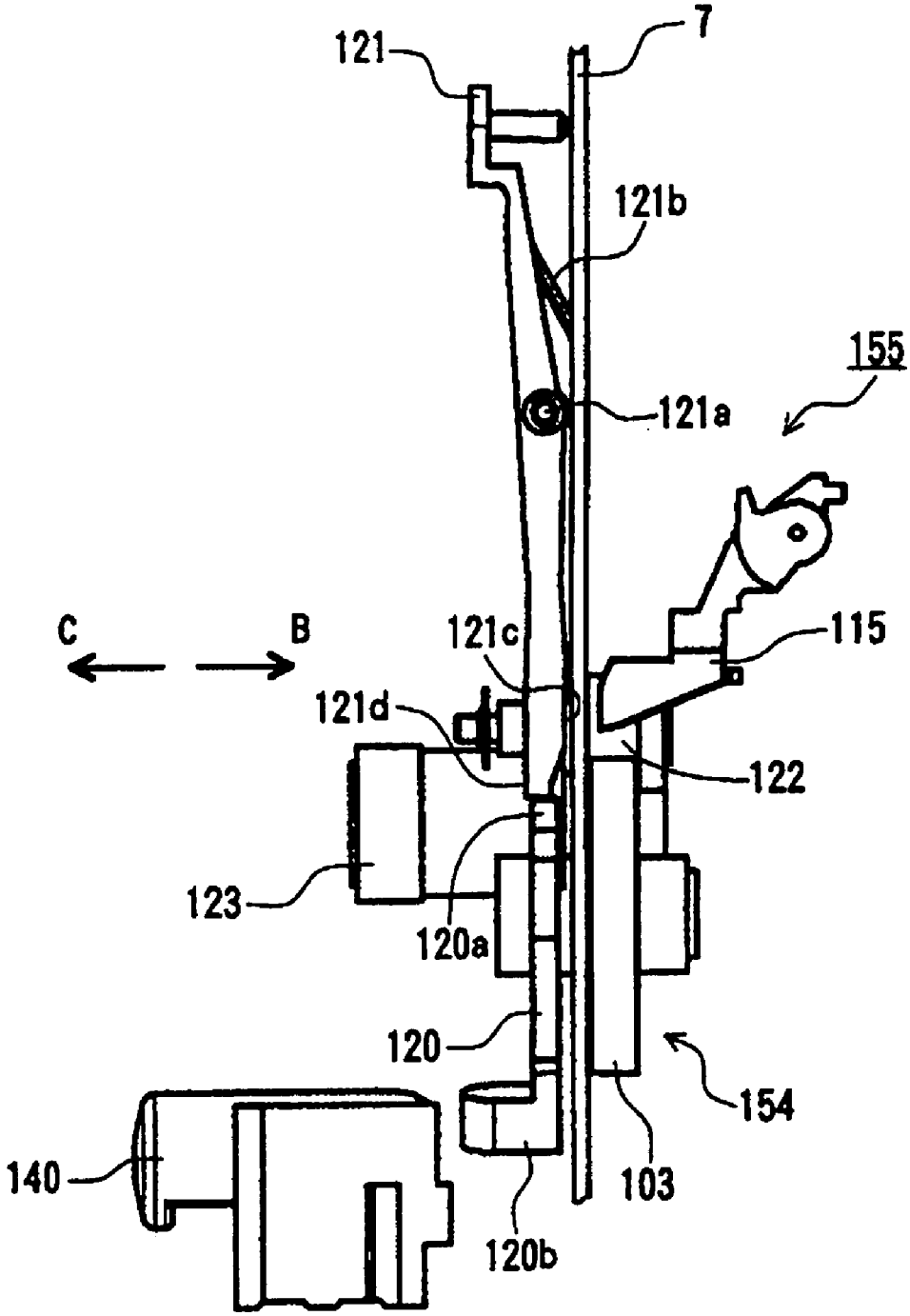
FIG. 45 is a diagram showing the switched OFF state of the pendulum arm (B) (stoppage state) and the idle rotation state of the reading switching part.
Figure 46:
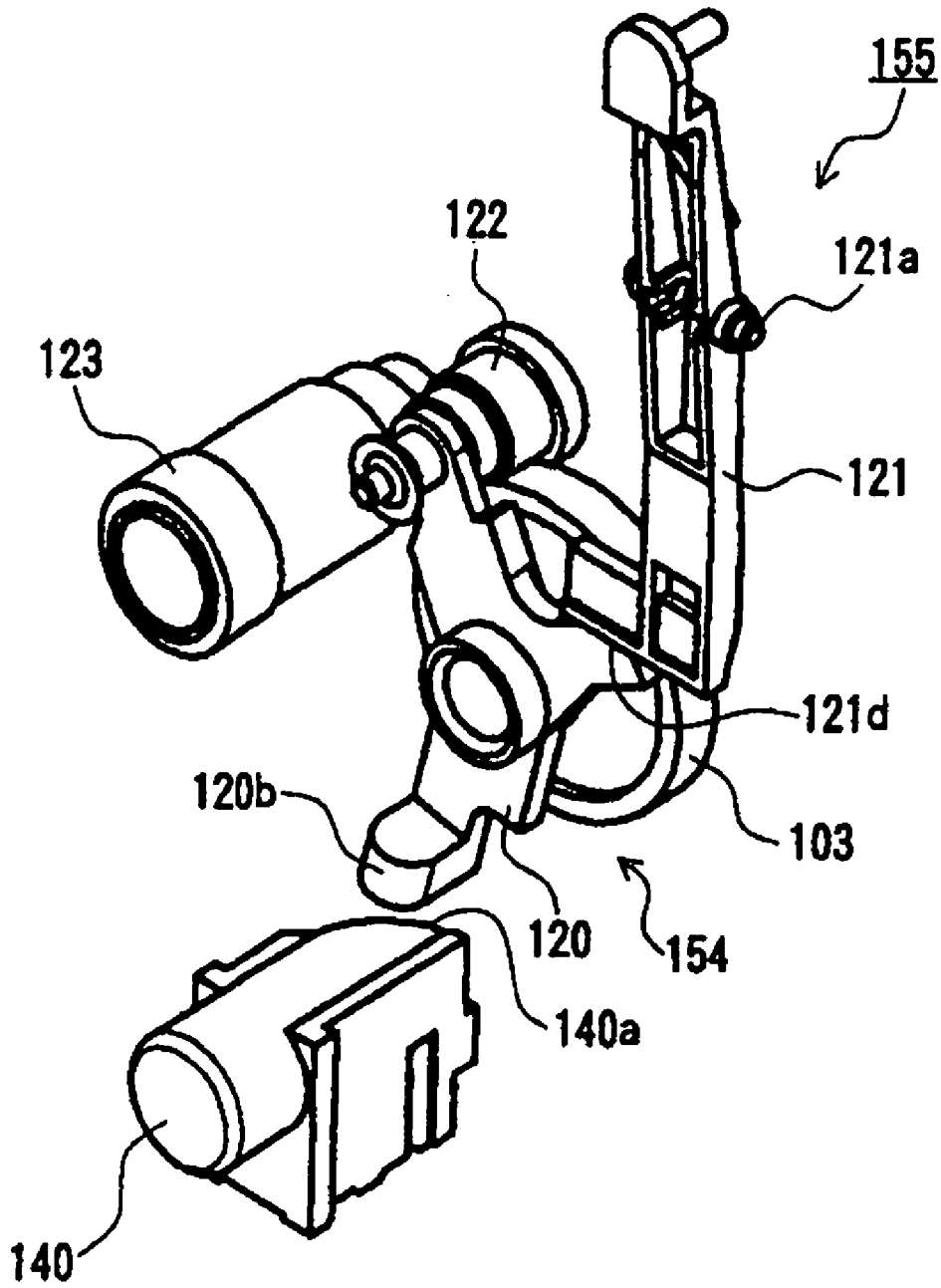
FIG. 46 is a diagram showing the switched OFF state of the pendulum arm (B) (stoppage state) and the idle rotation state of the reading switching part 1.
Figure 47:
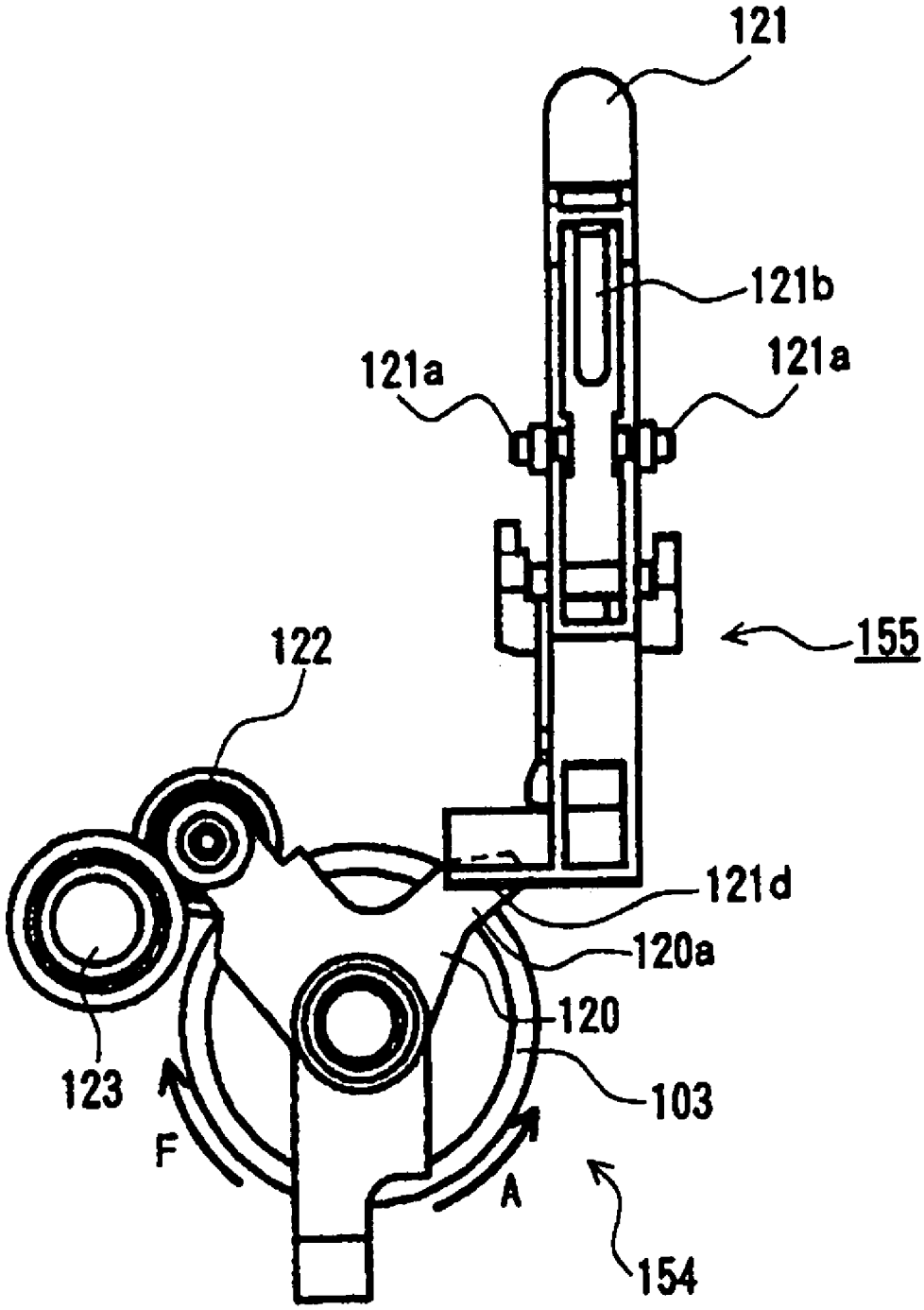
FIG. 47 is a diagram showing the result of the forward rotation of the feeding roller with the pendulum arm (B) in the switched ON state (released state)
Figure 48:
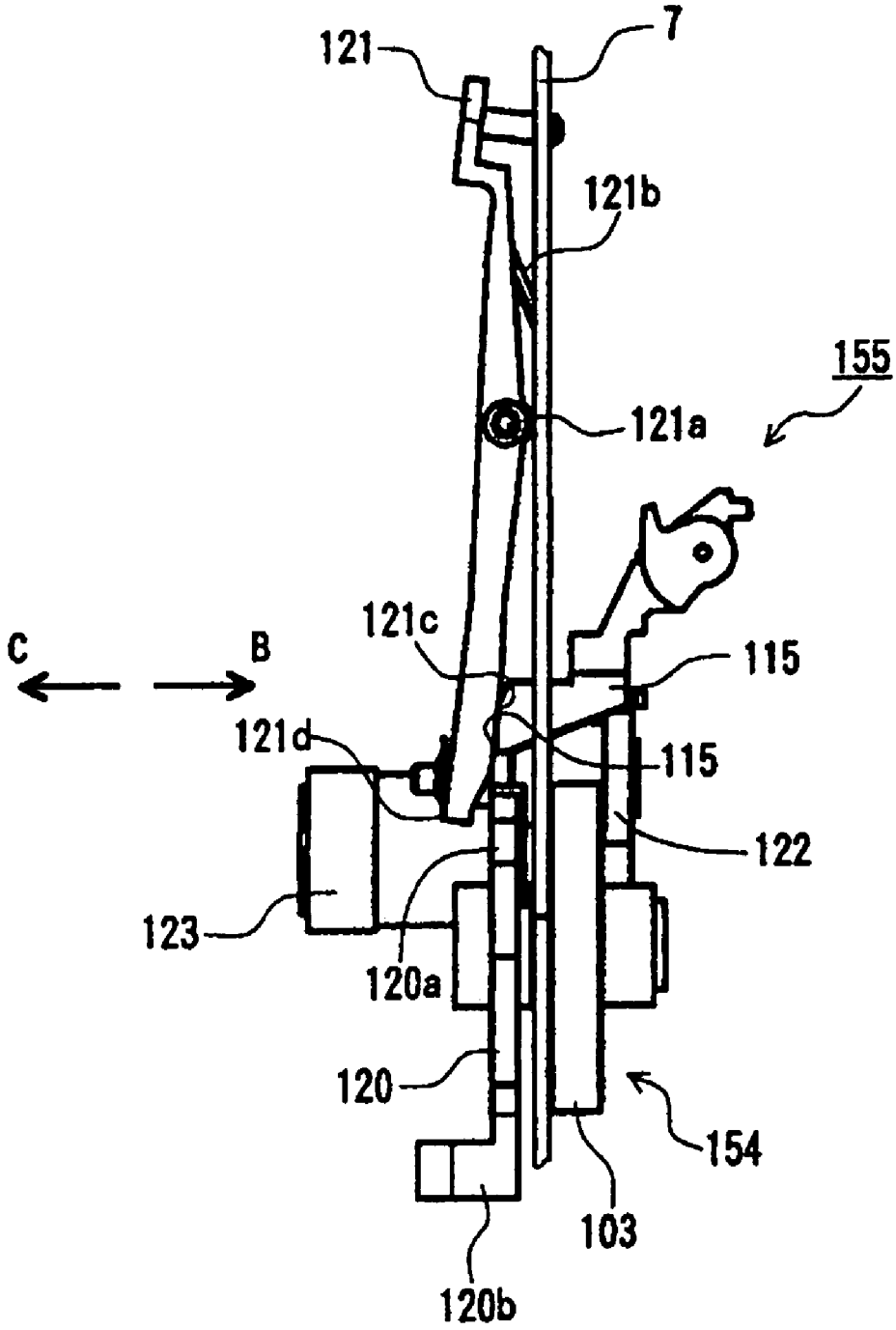
FIG. 48 is a diagram showing the result of the forward rotation of the feeding roller with the pendulum arm (B) in the switched ON state (released state)
Figure 49:
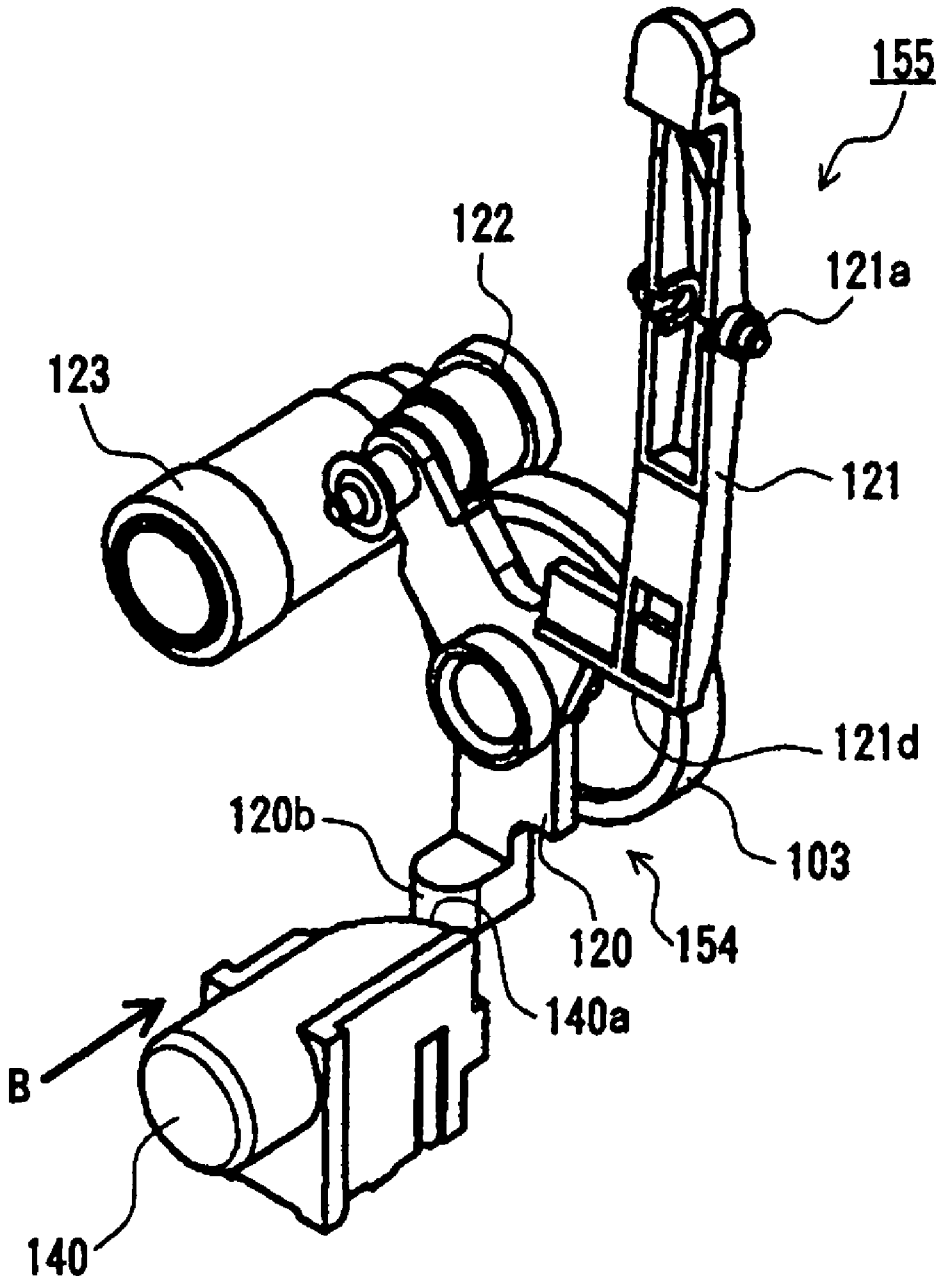
FIG. 49 is a diagram showing the result of the forward rotation of the feeding roller with the pendulum arm (B) in the switched ON state (released state)

A hole is formed in the side plate of the chassis 7 in a part facing the surface 121*c* of the controlling arm 121. At the time the carriage 4 is moved to the position whereat the carriage 4 shown in FIG. 14 starts switching the controlling member (A) from the recording position to the reading position, the carriage cam 115 pushes the surface 121*c* (FIGS. 45 and 48) of the controlling arm 121 in the arrow C direction through the hole. Then, the controlling arm 121 is rotated in the clockwise direction in FIG. 48 so that the end face 121*d* of the controlling arm 121 is moved in the axis direction (arrow C direction) so as to be detached form the rib 120*a* of the pendulum arm (B) 120 being contacted with as shown in FIG. 44 to 46 so far. As a result, the pendulum arm (B) 120 can be rotated in the arrow A direction as shown in FIGS. 47 to 49. This state is defined to be the controlling arm 121 ON state (released state).

In the case where the step gear (A) 103 is rotated in the arrow A direction shown in FIG. 44 (this is the feeding roller 10 forward rotation (rotation in the paper feeding direction) with the controlling arm 121 in the ON state (released state), the pendulum arm (B) 120 is also rotated in the arrow A direction shown in FIG. 44 so as to enter into the gap between the surface 121*c* and the chassis 7, and the planetary gear (B) 122 is engaged with the step gear (B) 123. As a result, the driving force of the feeding motor 104 (see FIGS. 15 and 17) is transmitted to the step gear (B) 123 via the pinion gear 105 (see FIG. 17), and the step gear (A) 103 (see FIGS. 17, and 47 to 49).

Thereafter, the carriage 4 is returned to the home position, and the carriage cam 115 is also returned to the arrow B direction shown in FIG. 48 integrally with the carriage 4. However, as shown in FIGS. 47 to 49, since the rib 120*a* is entered in the gap between the surface 121*c* and the chassis 7, the surface 121*c* pressures the pendulum arm (B) 120 by the elastic force of the tongue piece 121*b* in the arrow B direction shown in FIG. 48 so that the controlling arm 121 maintains the pendulum arm (B) 120 in the ON state (released state) in a state forced in the arrow B direction shown in FIG. 48 without returning to the original state. This state is defined to be the reading switching part 154 reading separation, feeding, CS rotating position.

Moreover, in contrast, in the case where the pendulum arm (B) 120 is returned to the OFF state, the reading switching part rotates the step gear (A) 103 in the arrow F direction shown in FIG. 47 from the reading separation, feeding, CS rotating position state. Then, the pendulum arm (B) 120 is rotated in the arrow F direction, resisting to the pressuring force of the tongue piece 121*b* so as to be released from the state pressured by the surface 121*c* of the controlling arm. Then, the rib 120*a* and the end face 121*d* are contacted with each other so that the pendulum arm (B) 120 is returned to the above-mentioned OFF state (stopped state).

After having he pendulum arm (B) 120 return to the above-mentioned OFF state (stoppage state), even in the case where the step gear (A) 103 is rotated forwardly (rotated in the arrow A direction), unless the controlling arm 121 is operated by the carriage cam 115 so as to be in the ON state (released state), the planetary gear (B) 122 is not engaged with the step gear (B) 123. That is, the rotation force of the feeding motor 104 (see FIG. 15) is not transmitted to the step gear (B) 123.

According to the above-mentioned configuration of the reading switching part 154, even in the case where the CS holder 2 6 is disposed at the CS holder second position (reading position) shown in FIG. 2 so that the carriage 4 cannot be moved (without driving the carriage 4), the controlling arm 121 is returned to the initial state only by rotating backward the feeding motor 104.

Moreover, the releasing member such as the releasing button 140 shown in FIG. 45 is provided on the side of the image reading and recording apparatus 91 movably in the arrow B, C directions. The releasing button 140 is always forced in the arrow C direction by an unshown elastic member. An oblique surface 140*a* is formed integrally with the releasing button 140. In contrast, the semi circular rib 120*b* is formed integrally with the pendulum arm (B) 120. At the time the pendulum arm (B) 120 is at the reading switching part 154 reading separation, feeding, CS rotating position 8the planetary gear (B) 122 is engaged with the step gear (B) 123), a predetermined gap is generated between the oblique surface 140*a* and the rib 120*b* as shown in FIG. 49.

Then, in this state, in the case where the releasing button 140 is pressed in the arrow B direction, the oblique surface 140*a* is contacted with the rib 120*b* so that the pendulum arm (B) 120 is rotated in the arrow F direction shown in FIG. 44. As a result, the planetary gear (B) 122 is separated form the step gear (B) 132. Moreover, at the same time, the engagement state of the surface 121*c* and the pendulum arm (B) 120 is released. Then, the rib 120*a* is contacted with the end face 121*d* so that the controlling arm 121 returns to the above-mentioned OFF state (stoppage state).

FIGS. 47, 48 and 49 show the state of the result of the forward rotation of the feeding roller 10 with the pendulum arm (B) 120 in the ON state (released state). The planetary gear (B) 122 is engaged with the step gear (B) 123 so that the driving force of the feeding motor 104 is transmitted to the step gear (B) 123. The released state is defined to the reading separation, feeding, CS rotating position of the reading switching part 154.

As shown in FIGS. 15 and 17, the step gear (C) 124, the step gear (D) 125 are engaged successively on the downstream side of the step gear (B) 123. The step gear (D) 125 is engaged with the idle gear (A) 126 and the idle gear (B) 132. A one way gear 127 is engaged on the downstream side of the idle gear (A) 126. The one way gear 127 comprises a gear part and a shaft part such that the gear part and the shaft part are rotated integrally in the case where the gear part is rotated in a certain direction, and the rotation of the gear part is not transmitted to the shaft part in the case where it is rotated in the opposite direction.

An idle gear (C) 128 is mounted on the elongation line of the shaft part of the one way gear 127. Only in the case where the one way gear 127 is rotated in the arrow A direction shown in FIGS. 15 and 17, the rotation force is transmitted to the idle gear (C) 128. The document feeding roller gear 129 mounted on the shaft 51*a* of the document feeding roller 51 is engaged on the downstream side of the idle gear (C) 128, and the document separating roller gear 131 mounted rotatably on the shaft 51*a* of the document separating roller 51 is engaged on the downstream side thereof.

Figure 19:
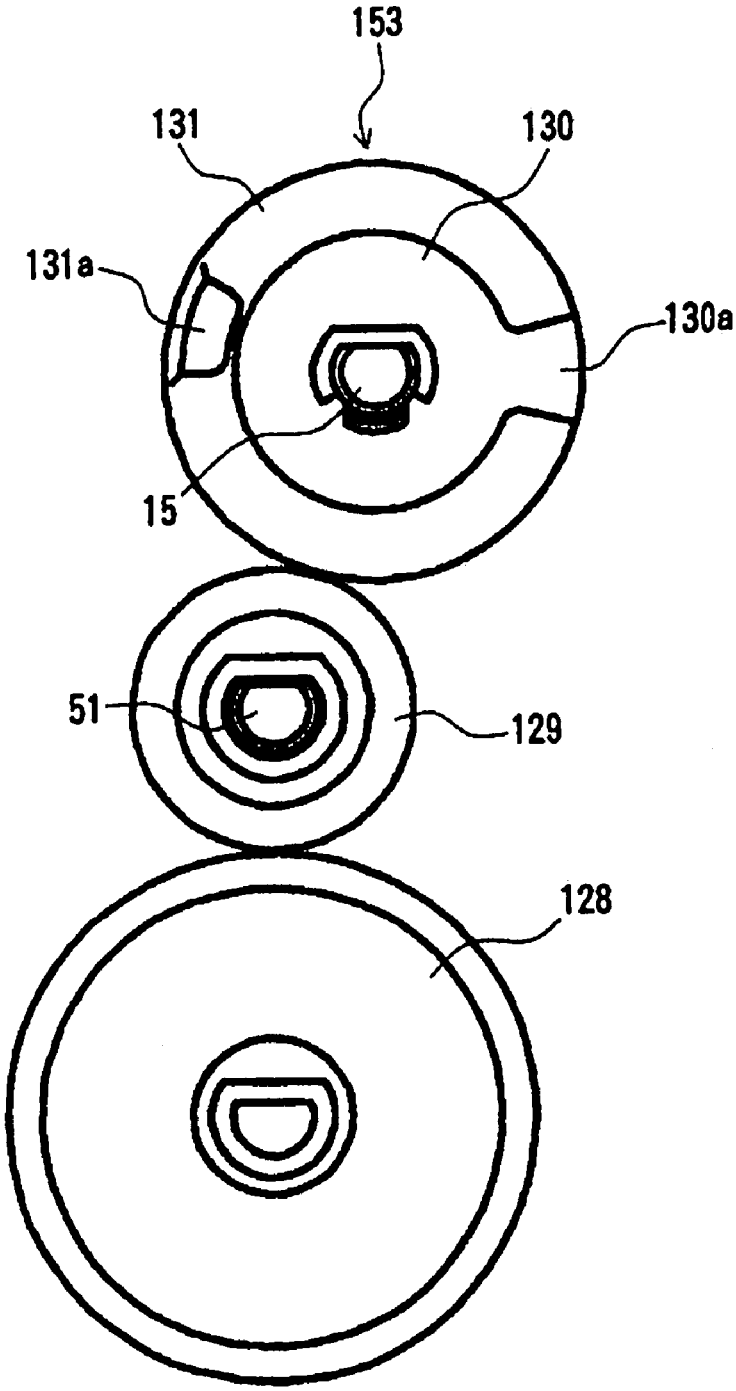
FIG. 19 is an enlarged view of the one way gear, the timer member, or the like in FIG. 17.
Figure 34:
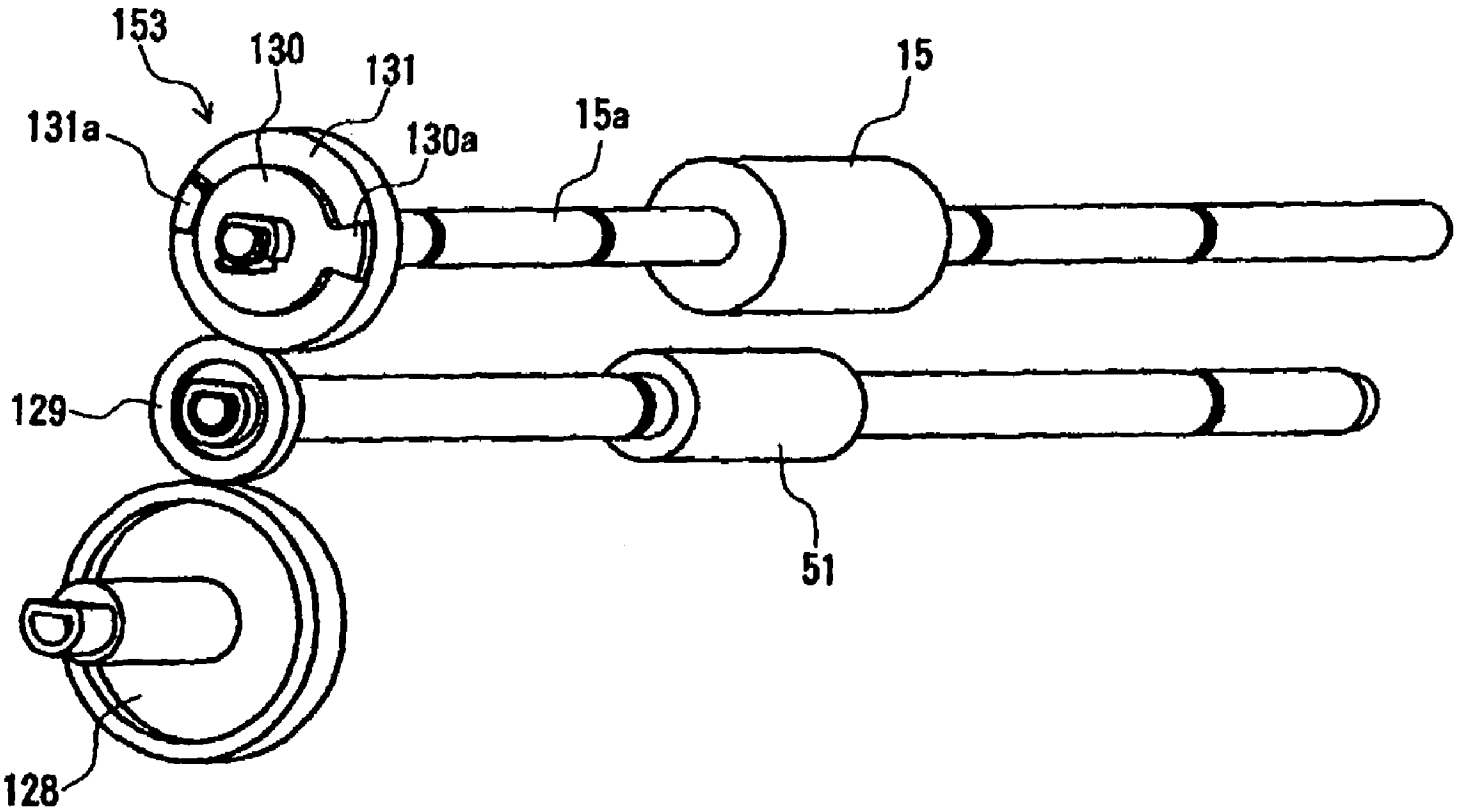
FIG. 34 is a perspective view of the vicinity of the timer member.

As shown in FIGS. 19 and 34, a disc-like timer member 130 is fixed on the shaft 15*a* of the document separating roller 15, parallel to the document separating roller 15. The document separating roller gear 131 is provided rotatably in the document separating roller 15 on the side with the timer member 130 fixed as the side surface of the document separating roller 15. A projection part 131*a* is formed in the document separating roller gear 131 by the integral molding. Similarly, an integral projection part 130*a* is formed on the outer circumference of the timer member 130. According to the engagement of the two projection parts 131*a*, 130*a* with each other, the rotation of the separating roller gear 131 is transmitted to the timer member 130 so that the separating roller gear 131 rotates the document separating roller 15. Thereby, the rotation of the document separating roller gear 129 can be transmitted to the document separating roller 15 with a predetermined time difference.

The timer member 130, the projection part 130*a*, the document separating roller gear 131, and the projection part 131*a* comprise the delaying means such as the delaying part 153. The delaying part 153 may be provided at any point from the feeding motor to the reading drive switching part 155, the reading drive transmitting part 158, the document separating roller 15.

In FIG. 15, the CS gear 133 is engaged on the downstream side of the idle gear (B) 132 being engaged with the step gear (D) 125.

The idle gear 132, and the CS gear 133 comprise the reading moving transmitting means such as the CS drive transmitting part 156 (see FIG. 15). As the CS drive transmitting part 156, a roller or a belt may be used instead of the gear. The gear and the roller is an example of the rotating member. The arrangement of a plurality of gears engaged or a plurality of rollers contacted are an example of the rotating member row. The CS drive transmitting part 156 comprises the moving means together with the reading drive switching part 155 and the CS forcing moving means 157.

The idle gear (A) 126, the one way gear 127, the idle gear (C) 128, the document feeding roller gear 129, and the document separating roller gear 131 comprise the reading drive transmitting part 158 (see FIG. 15). As the reading drive transmitting part 158, a roller or a belt may be used instead of the gear. The gear and the roller is an example of the rotating member. The arrangement of a plurality of gears engaged or a plurality of rollers contacted are an example of the rotating member row.

Figure 51:
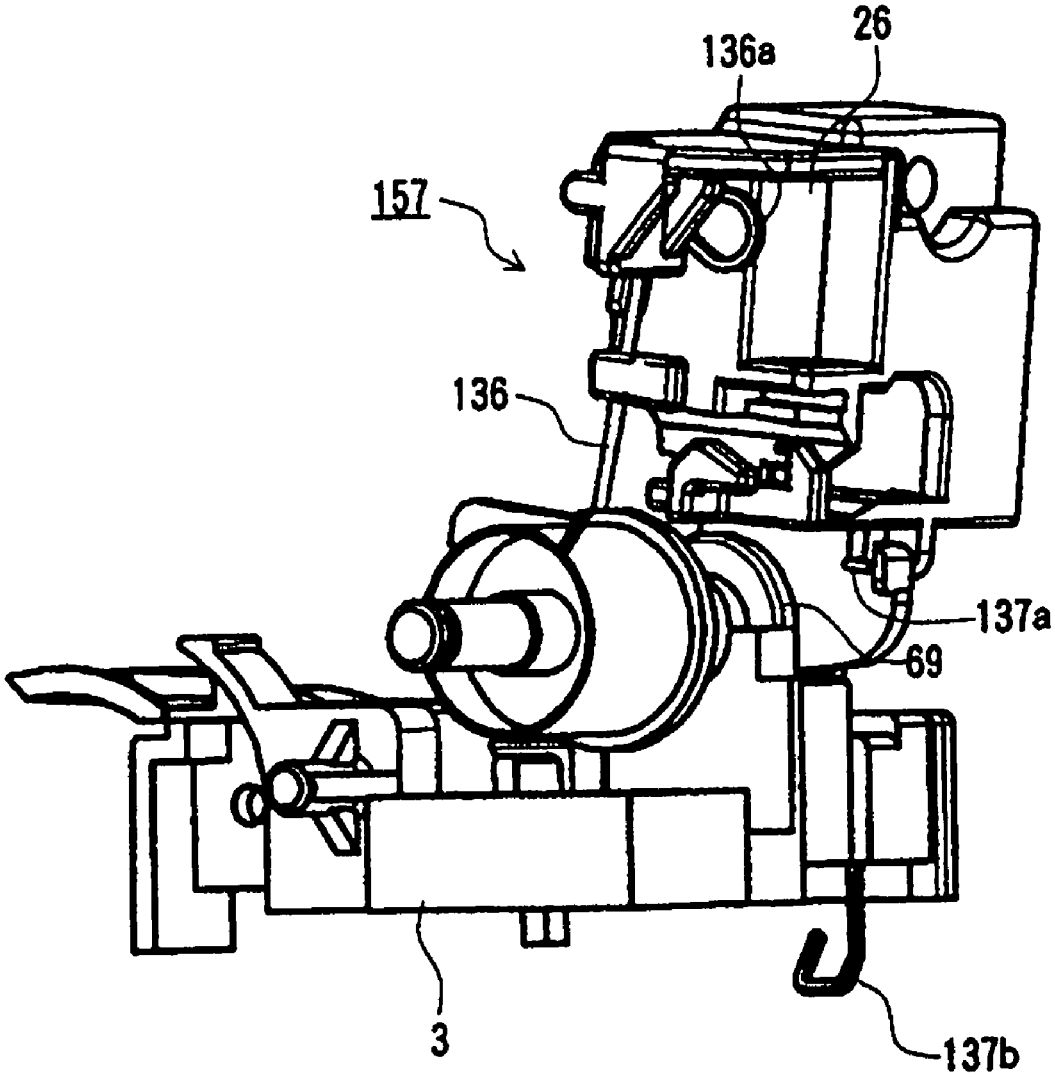
FIG. 51 is a perspective view of FIG. 50.
Figure 52:
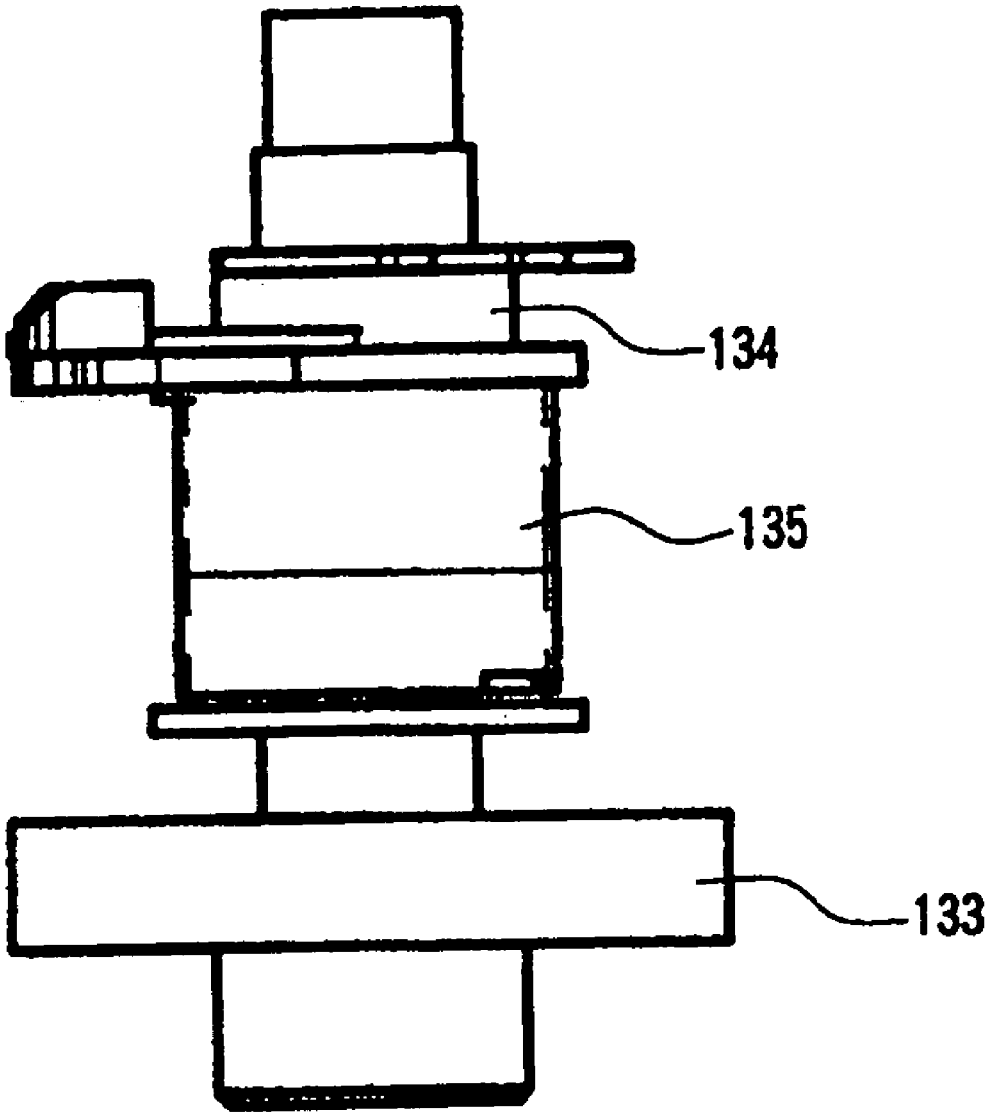
FIG. 52 is a plan view showing the contact image sensor driving arm and the contact image sensor gear.
Figure 53:
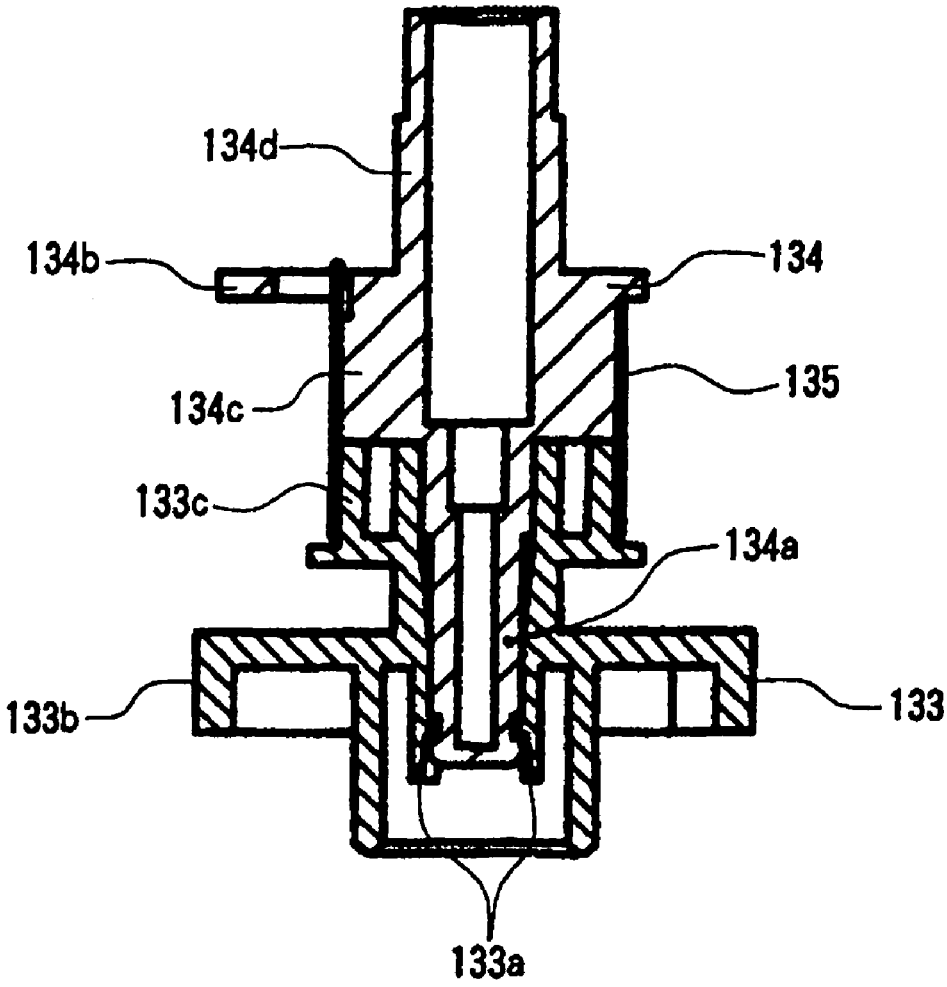
FIG. 53 is a cross-sectional view of the contact image sensor driving arm and the contact image sensor gear in FIG. 52.

As shown in FIGS. 15, 52 and 53, by engaging the boss 134*a* formed in the CS driving arm 134 with the hole formed in the CS gear 133, and stopping the same by the nail 133*a*, the CS gear 133 and the CS driving arm 134 are mounted on the same axis rotatably with each other. The CS gear 133 comprises the gear part 133*b* and the cylindrical body part 133*c*. The CS driving arm 134 comprises the arm part 134*b*, the body part 134*c* formed in the same outer diameter as the body part 133*c* of the CS gear, and the shaft part 134*d* formed on the side opposite to the body part 134*c* with respect to the arm part 134*b*. The shaft part 134*d* of the CS driving arm 134 is pivoted on the bearing part 69 (see FIGS. 13 and 51) formed in the platen 3.

The body part 133*c* of the CS gear and the body part 134*c* of the CS driving arm 134 are disposed side by side in the axis direction.

A coil spring 135 is mounted across the both body parts 133*c*, 134*c* of the CS gear 133 and the CS driving arm 134. The coil spring 135 is wound around to the inner diameter smaller than the outer diameter of the both body parts 133*c*, 134*c* by several hundred μm to several tens of μm. Therefore, the coil spring 135 is mounted on the both body parts 133*c*, 134*c* adherently. One end part 135*b* (see FIG. 50) of the coil spring 135 is engaged with the arm part 134*b* of the CS driving arm 134. The other end part is bent outward in the radial direction as the projection part 135*a* so as to be projected from the outer shape.

A first twisted coil spring 136 is mounted on the shaft part 134*d* of the CS driving arm 134. One end 136 of the first twisted coil spring 136 is fixed on the arm part 134*b* of the CS driving arm 134. The other end of the first twisted coil spring 136 is mounted on the side surface of the CS holder 26.

Figure 50:
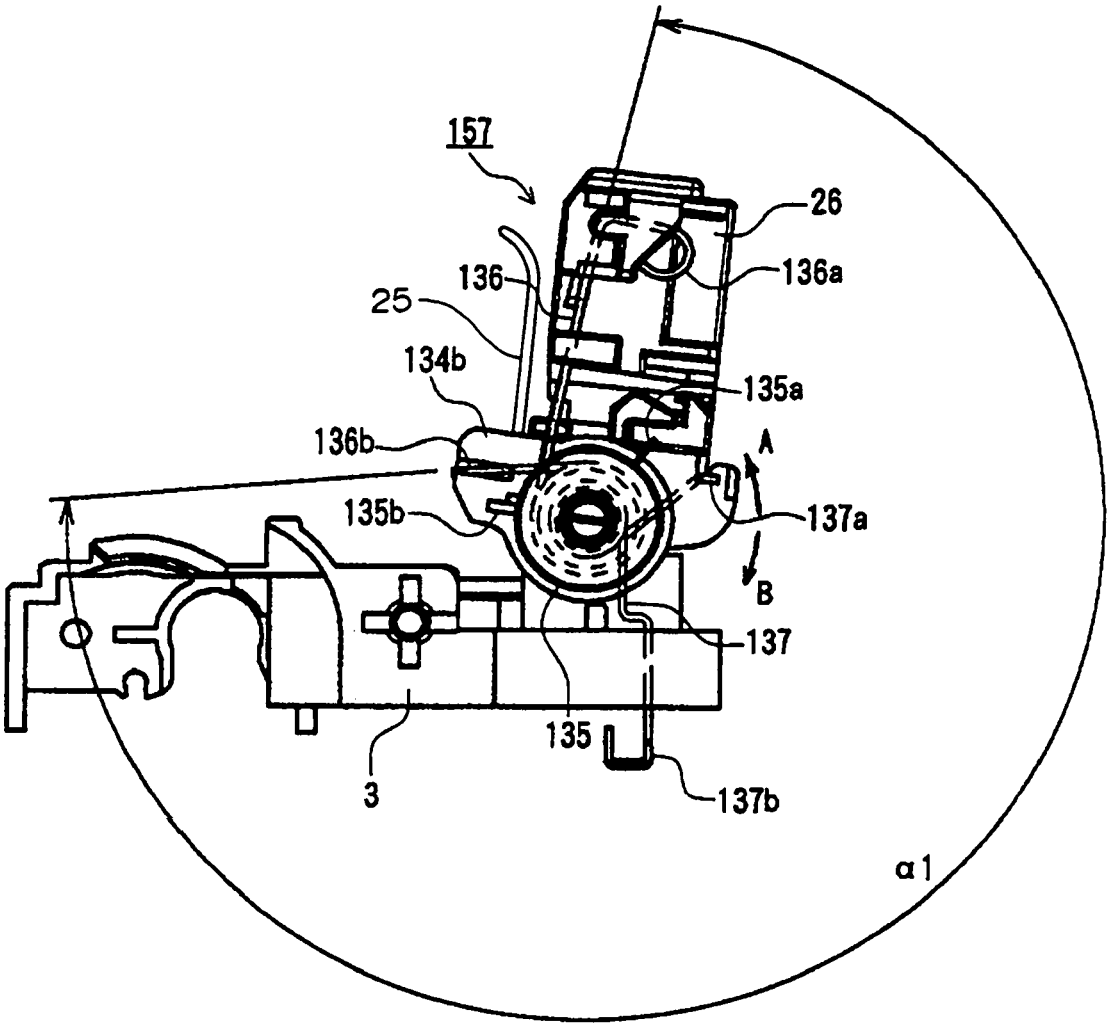
FIG. 50 is a diagram showing the stand by state of the contact image sensor holder.

A second twisted coil spring 137 is mounted on the CS holder 26 shown in FIGS. 50 and 51. One end 137*b* of the second twisted coil spring 137 is fixed on the platen 3, and the other end 137*a* is fixed on the CS holder. The second twisted coil spring 137 forces the CS holder 26 in the direction to be rotated form the second position (reading position) to the first position (stand by position) as shown in FIGS. 56 to 59 by the elastic force of the spring.

The pressuring force applied on the CS holder 26 by the elastic force of the second twisted coil spring 137 is designed so as to be about 300 g·cm by the axial torque in the rotation center at the CS holder 26 first position (stand by position) and about 600 g·cm at the second position (reading position). However, since the torque of about 300 g·cm is applied to the first twisted coil spring 136 by the self weight of the CS holder 26 at the second position, the real pressuring forces at the positions are both about 300 g·cm.

The CS driving arm 134, the coil spring 135, the first twisted coil spring 136, and the forcing member such as the second twisted coil spring 137 comprise the reading forcing moving part such as the CS forcing moving part 157 (see FIGS. 15, and 52 to 59). The first twisted coil spring 136 is not always necessary. Moreover, the CS forcing moving part 157 comprises the moving means together with the reading drive switching part 155 and the CS drive transmitting part 156.

As mentioned above, in the case where the feeding motor 104 rotates the feeding roller forwardly (rotated in the paper feeding direction) with the reading switching part 154 switched to the reading separating, feeding, CS rotating position, the rotation force of the feeding motor 104 is transmitted to the document feeding roller 51 and the document separating roller 15. At the same time, the CS driving arm 134 is rotated in the arrow A direction shown in FIG. 50 according to the rotation force of the feeding motor 104.

Figure 54:
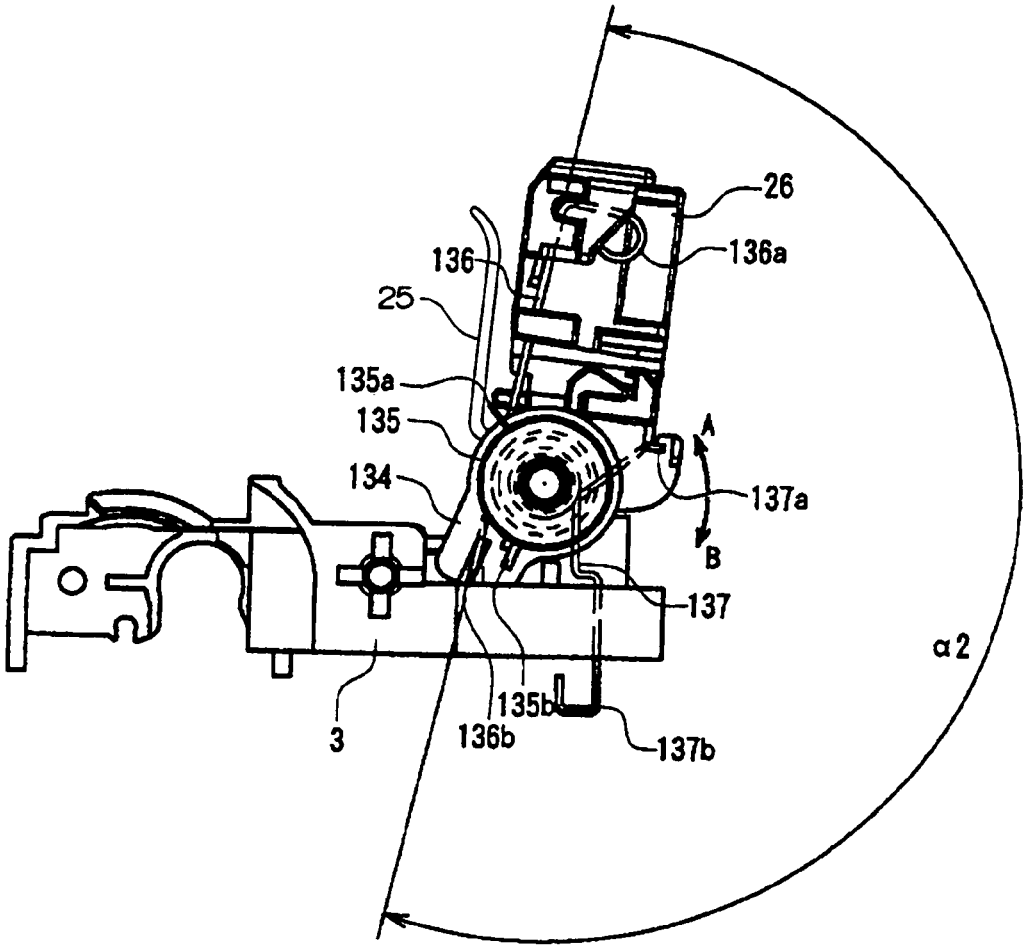
FIG. 54 is a diagram showing the state of the contact image sensor driving arm rotated forwardly from the state of FIG. 50.
Figure 55:
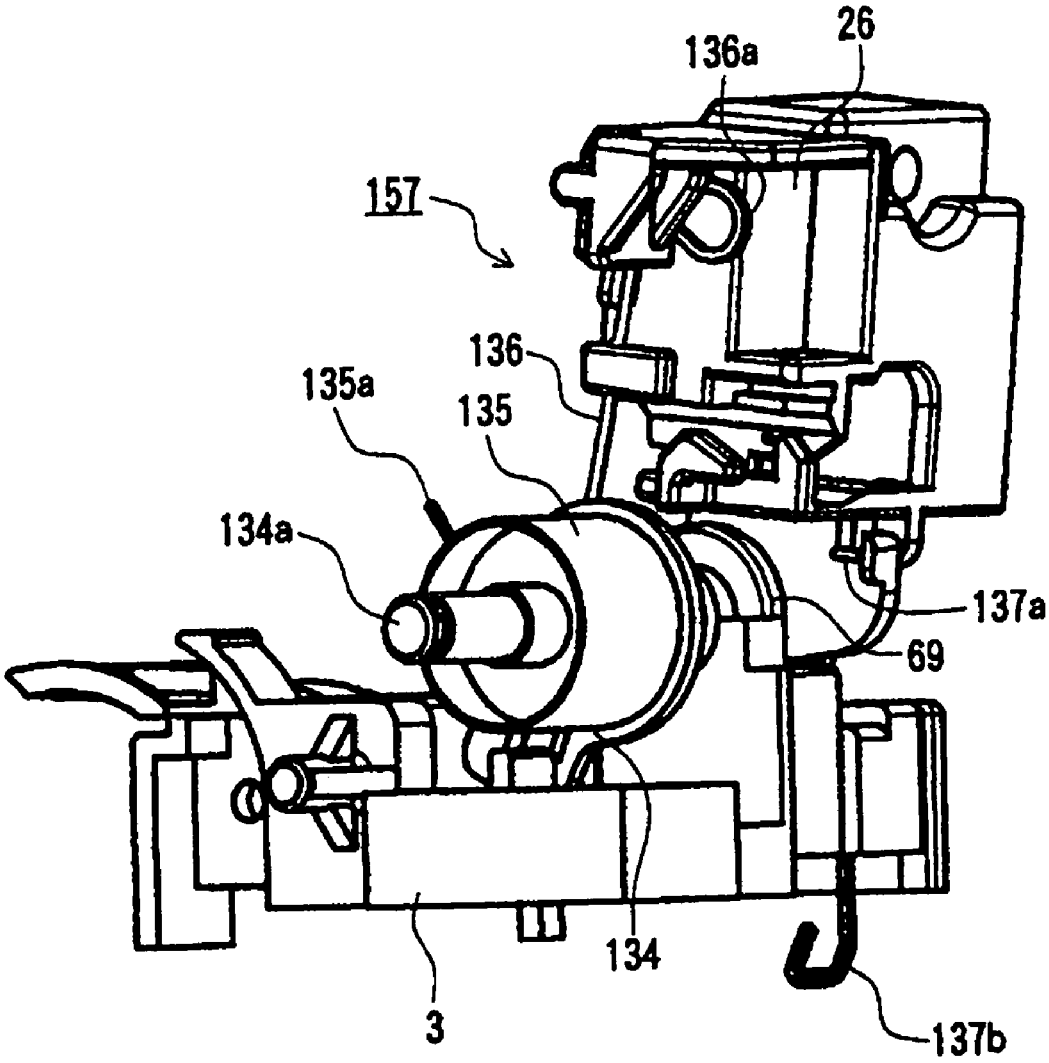
FIG. 55 is a perspective view of FIG. 54.

In the case where the CS driving arm 134 is rotated in the arrow A direction, since the end part 136*a* forces the CS holder according to the elastic force of the first twisted coil spring 136 with the end part 136*b* engaged with the arm part of the CS driving arm 134, the CS holder 26 is rotated from the first position (stand by position) shown in FIG. 54 to the A direction.

Figure 56:
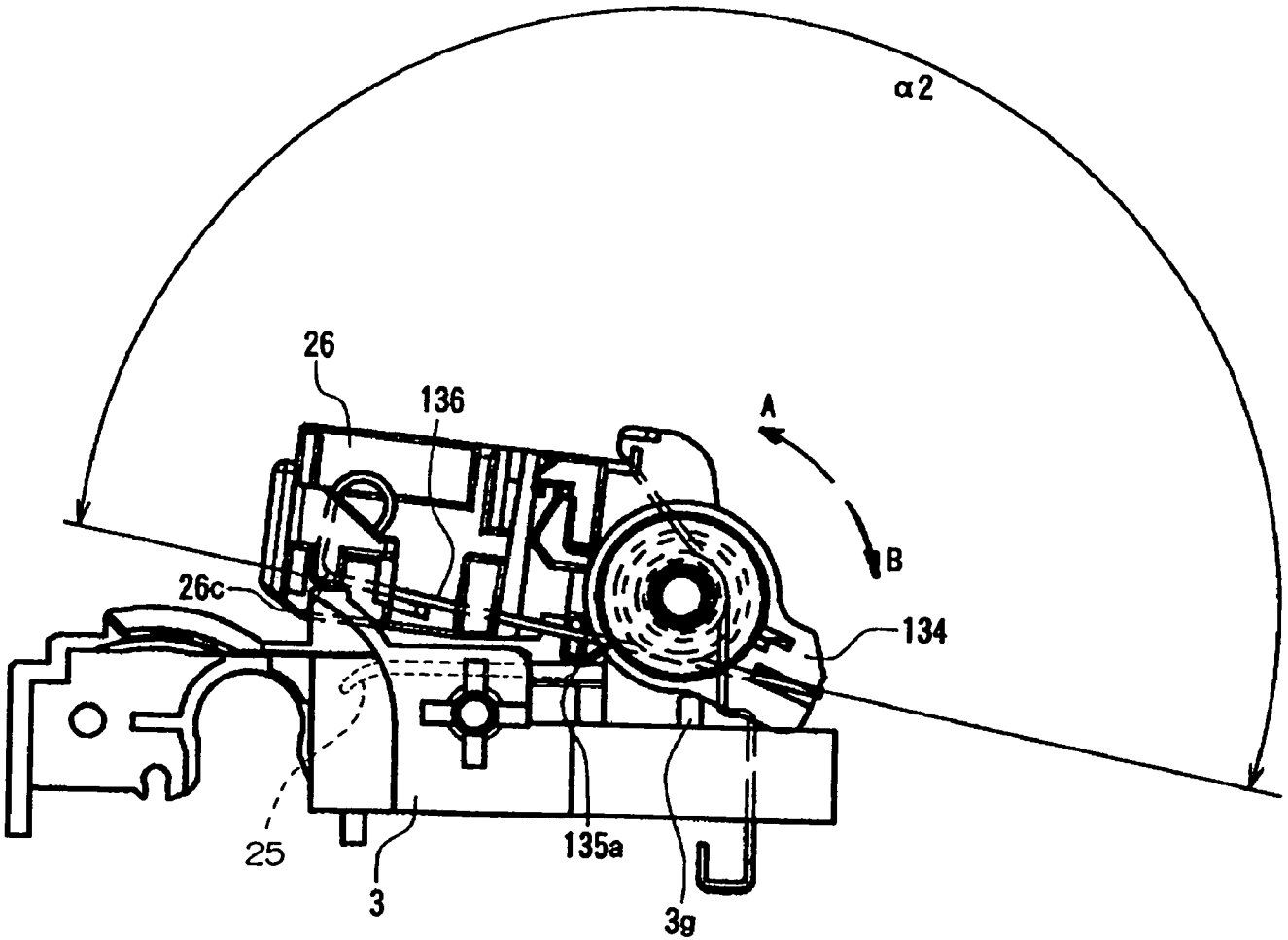
FIG. 56 is a diagram showing the state of the contact image sensor driving arm further rotated forwardly from the state of FIG. 54.
Figure 57:
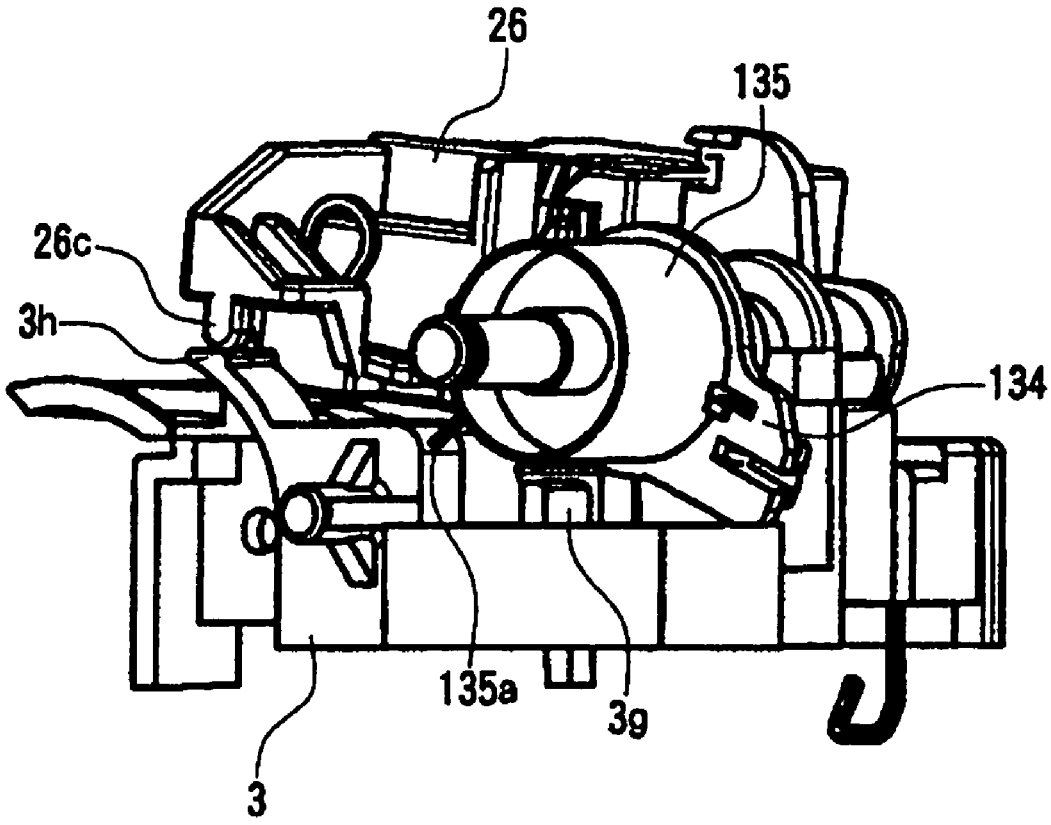
FIG. 57 is a perspective view of FIG. 56.
Figure 58:
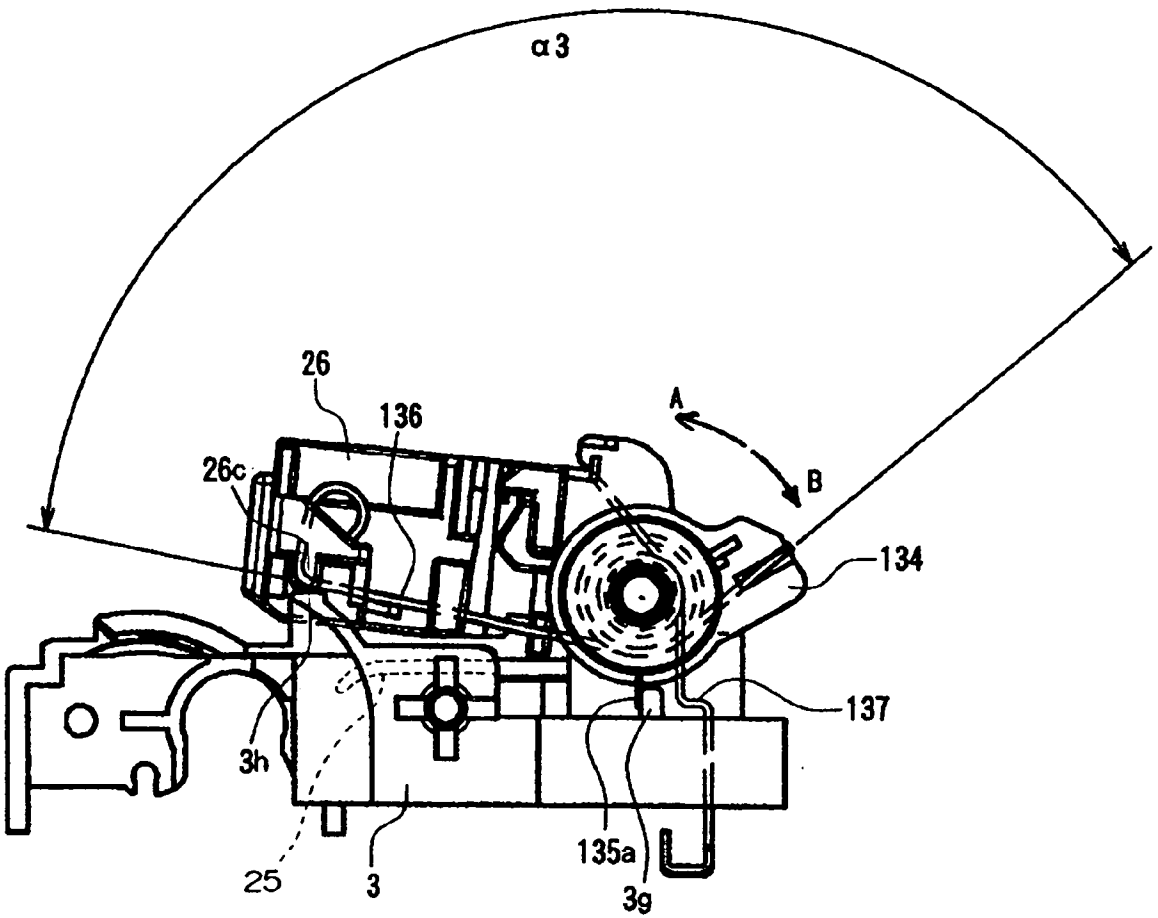
FIG. 58 is a diagram showing the state of the contact image sensor driving arm further rotated forwardly from the state of FIG. 56.
Figure 59:
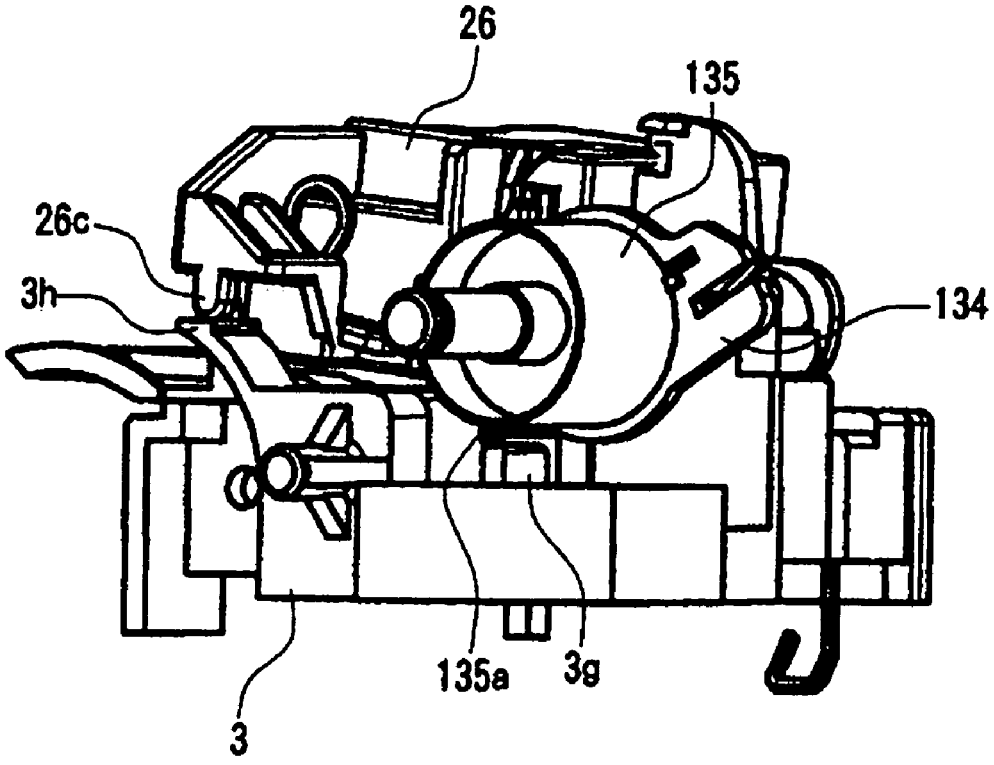
FIG. 59 is a perspective view of FIG. 58.

As shown in FIGS. 56 and 57, at the time the CS holder 26 is moved to the second position (reading position), the height positioning boss 26*c* of the CS holder 26 is contacted with the receiving part 3*h* of the platen 3 so that the A direction rotation of the CS holder 26 is stopped. Although the CS driving arm 134 continues to rotate in the A direction according to the rotation of the CS gear 133 after stopping the CS holder 226 at the second position, as shown in FIGS. 58 and 59, in the case where the projection part 135*a* of the coil spring 135 being rotated integrally with the CS driving arm 134 integrally is contacted with the stopper part 3*g* of the platen 3, the coil spring 135 is loosened so as to be slipped with respect to the CS gear 133. That is, the rotation transmission of the feeding motor 104 is blocked and the CS driving arm 134 is stopped as well. By moving the CS holder 26 to the reading position, the white reference 25 mounted on the CS holder 26 is moved similarly to the reading position so that the feeding path for the document formed between the white reference 26 and the CS 22 coincides with the feeding path of the recording sheet.

According to the above-mentioned configuration, the sequential operation of the image reading and recording apparatus will be explained with reference to the timing charts 1, 2, 3, 4 shown in FIGS. 60 to 67.

Initializing Operation

With reference to the timing chart 1 shown in FIGS. 60 and 61, the initializing operation will be explained. In FIG. 60, the "controlling member (A) recording position" is the position corresponding to the "position whereat the carriage starts switching the controlling member (A) from the reading position to the recording position" in FIG. 14. Moreover, the "controlling member (A) reading position" is the position corresponding to the "position whereat the carriage starts switching the controlling member (A) from the recording position to the reading position" in FIG. 14.

The initializing operation of the operation for having the controlling member (A) 113 and the controlling member (B) 114 in the ON state (released state) without engaging with the pendulum arm (A) 109 so that the planetary gear (A) 110 can be engaged selectively with the recovery inputting gear 111 or the recording paper separating inputting gear 112.

The state of the image reading and recording apparatus before switching on the power source of the image reading and recording apparatus yet after unpacking the package of the image reading and recording apparatus by the user is the uncertain state shown in the uppermost part of the timing chart 1 in FIG. 60.

In the case where the power source is switched ON, the image reading and recording apparatus 91 moves the carriage 4 in the arrow d direction by the distance f from the capping position to the idle vacuuming position as shown in FIG. 14. The capping position is disposed at the limit part of the carriage 4 moving range in the arrow e direction so that displacement from the capping position is ensured regardless of the carriage 4 initial position.

Here, even in the case where the CS holder 26 is at the reading position, the carriage 4 can be moved at least to the idle vacuuming position without interfering with the CS holder 26. This operation is shown in FIG. 60 as the "operation of displacing the carriage from the capping position". The position capable of disposing the carriage 4 at the time is somewhere in the range shown by hatching in the timing chart 1 of FIG. 60.

Next, in the case where the feeding roller (feeding motor 104) shown in FIG. 15 is rotated backwardly, at least the reading switching part 154 is in the idle rotation state. Then, the drive of the feeding motor 104 is blocked from the reading feed and the CS drive. As a result, the CS 22 is in the stand by state shown in FIG. 1 according to the function of the second twisted coil spring 137. At the time, since the position of the planetary gear (A) 110 of the recording switching part 151 is not certain (in the state without at least operating recording, separating feed), although the recovery means can be operated so as to execute the ink vacuuming operation, since the carriage 4 is not at the capping position, the ink cannot be vacuumed actually. This operation is shown in the timing chart 1 of FIG. 60 as the "operation of certainly having the CS in the stand by state".

After the operation, the carriage 4 is in an operable state without being interfered by the reading part 28. Therefore, according to the operation of moving to the position whereat the carriage 4 starts switching the controlling member (A) from the reading position to the recording position, the controlling member (A) 113 is disposed at the ON position (released position) as shown in FIG. 38. Then, the controlling member (B) 114 is disposed at the OFF position (stopped position). Thereby, the position of the recording switching part is determined also at the idle rotation position. This operation is shown in FIG. 60 as the "operation of switching on the controlling member (A)". Here, in the case where the position sensor of the recording separating roller 19 shown in FIG. 1 is not at the initial position, the initializing operation is completed by executing the "operation to be executed only in the case where the recording separating roller sensor is switched OFF" shown in the timing chart 1 of FIG. 60, and similarly executing the "operation of moving the recording switching part to the idle rotation position" shown in the timing chart 1. Here, this apparatus is initialized by executing the initializing operation, or the like in the case where jamming, or the like is generated.

Recording Paper Feeding Mode, Recording Paper Feeding Mode

Figure 62:
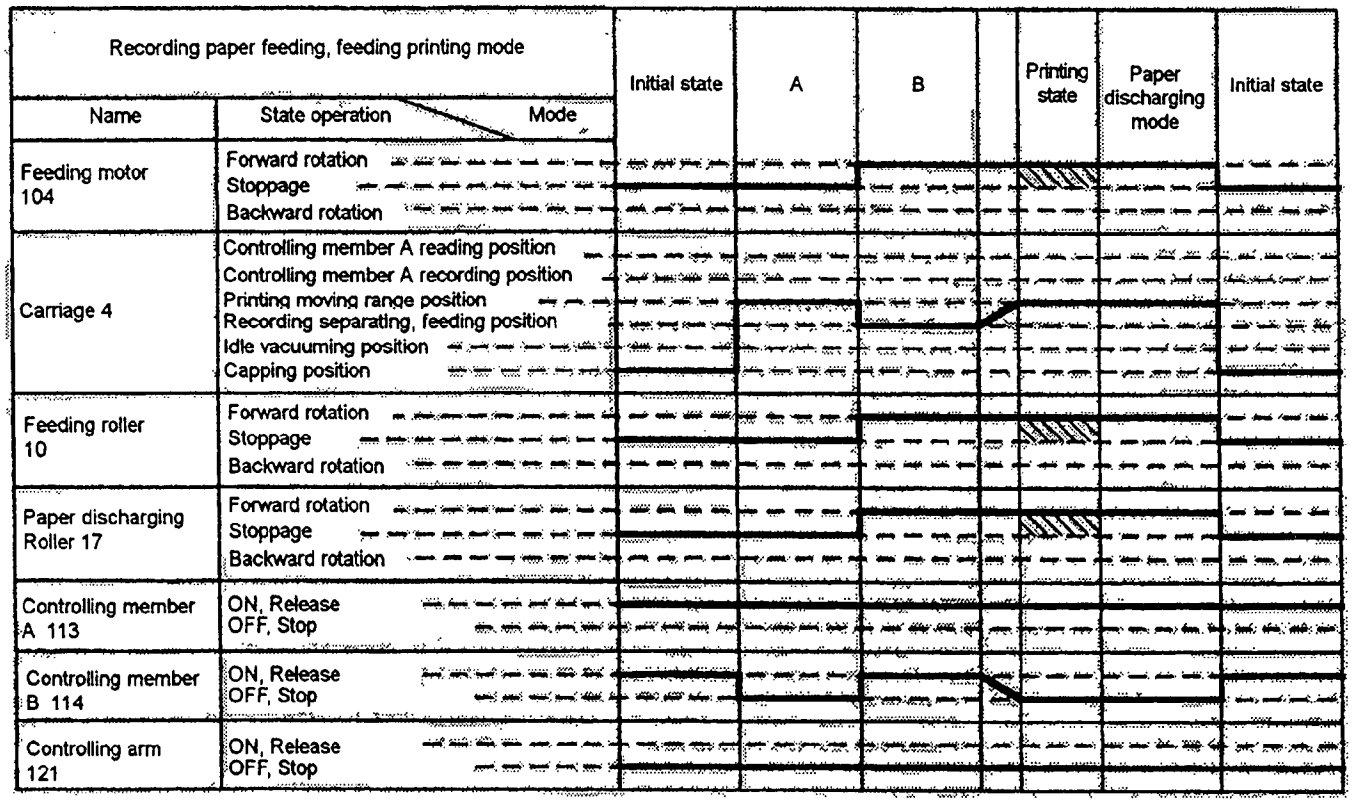
FIG. 62 is a timing chart of the recording paper feeding, feeding printing mode in the image reading and recording apparatus according to the present invention.

The recording operation of the image reading and recording apparatus 91 after finishing the initializing operation will be explained with reference to the timing chart 2 shown in FIGS. 62 and 63. In FIG. 62, the "controlling member (A) recording position" is the position corresponding to the "position whereat the carriage starts switching the controlling member (A) from the reading position to the recording position" in FIG. 14. Moreover, the "controlling member (A) reading position" is the position corresponding to the "position whereat the carriage starts switching the controlling member (A) from the recording position to the reading position" in FIG. 14.

First, the image reading and recording apparatus 91 executes the position shown in the timing chart 2 of FIG. 62 as the "operation of the controlling member (A) position confirmation mode" for confirming whether the controlling member (A) 113 is certainly in the ON state (released state).

Next, in the case where the feeding motor 104 as the driving source shown in FIG. 15 is rotated forwardly, the feeding roller 10 and the paper discharging roller 17 are rotated in the paper feeding direction. At the same time, the pendulum arm (A) 109 is rotated as shown in FIGS. 39 and 40 so that the planetary gear (A) 110 is engaged with the recording paper separating inputting gear 112. The rotation of the recording paper separating inputting gear 112 shown in FIG. 15 is transmitted to the idle gears 116, 117, the recording paper separating roller gear 118 and the cam gear 119 so as to rotate these gears. In the carriage 4 stand by state, the recording paper separating roller 19 shown in FIG. 3 stops the flat part 19*b* of the recording paper separating roller 19 in a state substantially parallel to the pressure plate 9.

The releasing cam 64 of the cam gear 119 is engaged with the right pressing down part 65 shaped on the side surface of the pressure plate 9 so as to separate the recording paper separating roller 19 and the pressure plate 9, resisting to the pressuring force by the pressure plate spring 34. However, according to the rotation of the cam gear 119, the pressure plate 9 is forced to the recording paper separating roller 19 side by the pressure plate spring 34. Simultaneously with the above-mentioned operation, the recording paper separating roller 19 is rotated in the paper feeding direction so as to separate and convey the uppermost recording paper in the set recording paper bundle. In the case where the one turn rotation of the recording paper separating roller 19 is detected by a fan-like unshown actuator and a photo interrupter shaped integrally with the shaft part of the recording paper separating roller 19, the feeding motor 104 stops the rotation. The distance capable of feeding by the one turn rotation of the recording paper separating roller 19 and the distance to the feeding roller 10 are designed and adjusted so that the top end of the recording paper separated and fed an move over the feeding roller 10 at the time.

Next, the feeding motor 104 rotates backwardly the pendulum arm (A) 109 from the position shown in FIG. 39 until the planetary gear (A) 110 is separated from the recording paper separating inputting gear 112. This operation is shown in the timing chart 2 of FIG. 62 as the "recording paper separating feeding mode". Subsequently, an unshown carriage driving motor is driven so that the carriage 4 is moved from the recording separating feeding position in FIG. 14 in the arrow d direction so as to switch the recording switching part 151 from the ON state (released state) to the OFF state (stopped state).

In the case where the feeding motor 104 is rotated forwardly again in this state, since movement of the pendulum arm (A) 109 is limited by the controlling member (B) 114, the planetary gear (A) 110 is not engaged with any gear as shown in FIG. 37 so that only the feeding roller 10 and the paper discharging roller 17 are rotated for feeding the recording paper.

Subsequent to this operation, the state of forming an image by alternately operating the feeding roller 10 and the carriage 4 is shown in the timing chart 2 of FIG. 62 as the "printing state". In the case where the rear end of the recording paper is discharged to the outside of the apparatus (it is shown as the "paper discharging mode" in the timing chart 2), the feeding motor 104 is stopped so that the carriage 4 is returned to the capping position for switching the controlling member (B) 114 in the on state so that it is returned to the initial state.

Recovery Mode

With reference to the timing chart 3 shown in FIGS. 64 and 65, the recovery mode will be explained. In FIG. 64, the "controlling member (A) recording position" is the position corresponding to the "position whereat the carriage starts switching the controlling member (A) from the reading position to the recording position" in FIG. 14. Moreover, the "controlling member (A) reading position" is the position corresponding to the "position whereat the carriage starts switching the controlling member (A) from the recording position to the reading position" in FIG. 14. In the case where the feeding motor 104 shown in FIG. 15 as the driving source is rotated backwardly from the initial state, the feeding roller 10 and the paper discharging roller 17 are rotated in the backward direction with respect to the paper feeding direction. At the same time, the pendulum arm (A) 109 is rotated in the arrow A direction in FIG. 42 so that the planetary gear (A) 110 is engaged with the recovery inputting gear 111. The piston is driven by the recording head recovery unit 101 shown in FIG. 14, interlocked with the recovery inputting gear 111 so as to vacuum the ink from the ink tank. This operation is shown in the timing chart 3 of FIG. 64 as the "vacuuming state".

Execution of the same operation after this operation with the carriage 4 moved to the idle vacuuming position shown in FIG. 14 is the "idle vacuuming state". Although it is not shown in the timing chart 3 of FIG. 62, the feeding motor 104 is rotated forwardly after vacuuming the ink so as to rotate the pendulum arm (A) 109 in the direction moving away from the rotation inputting gear 111 as shown in FIG. 37 for separating the planetary gear (A) 110 from the recovery inputting gear 111. Thereafter, the feeding motor 104 is stopped so that the cartridge 4 returns to the initial state.

Reading Mode

Figure 67:
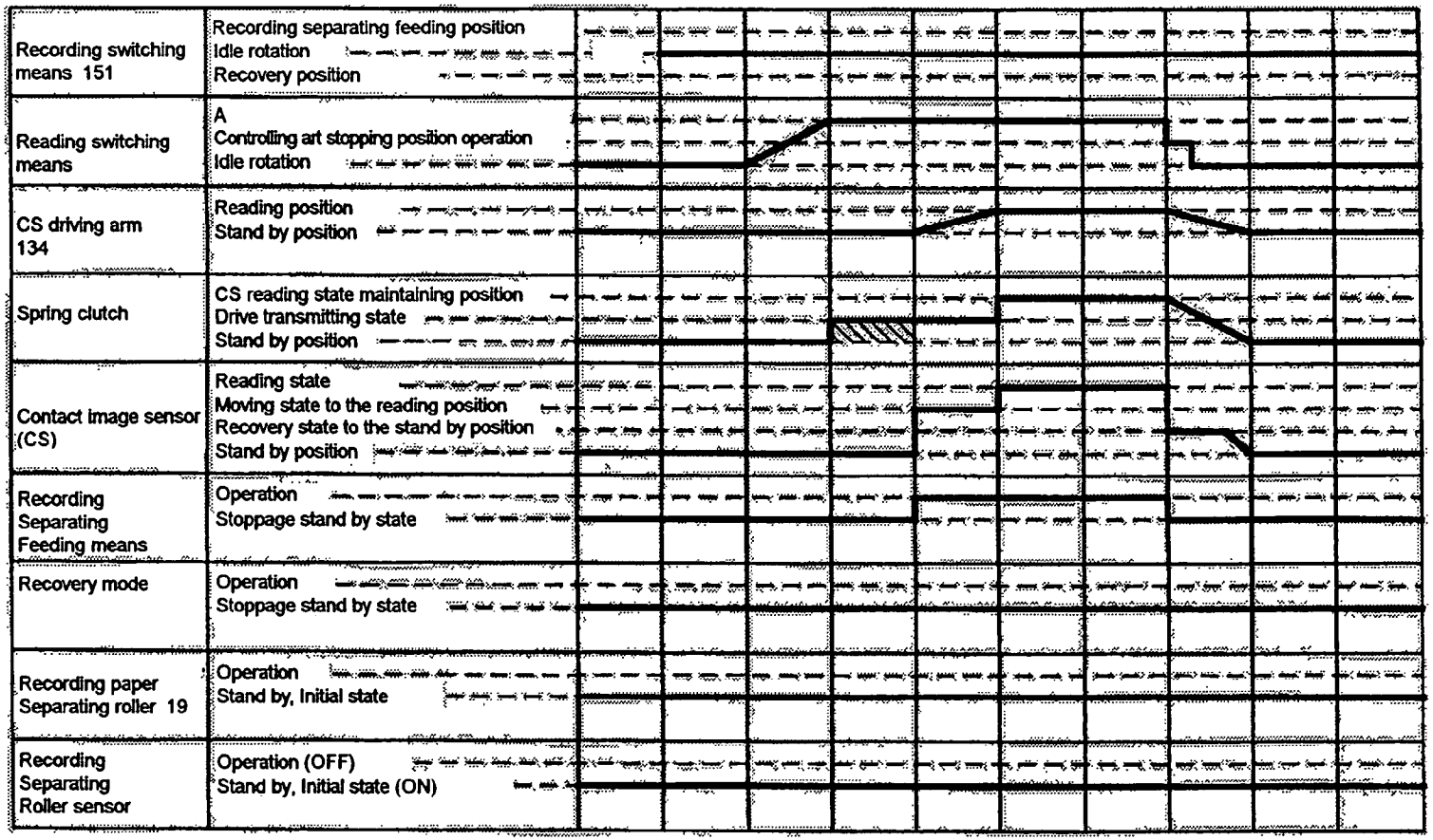
FIG. 67 is a timing chart as the continuation of FIG. 66.
Figure 68:
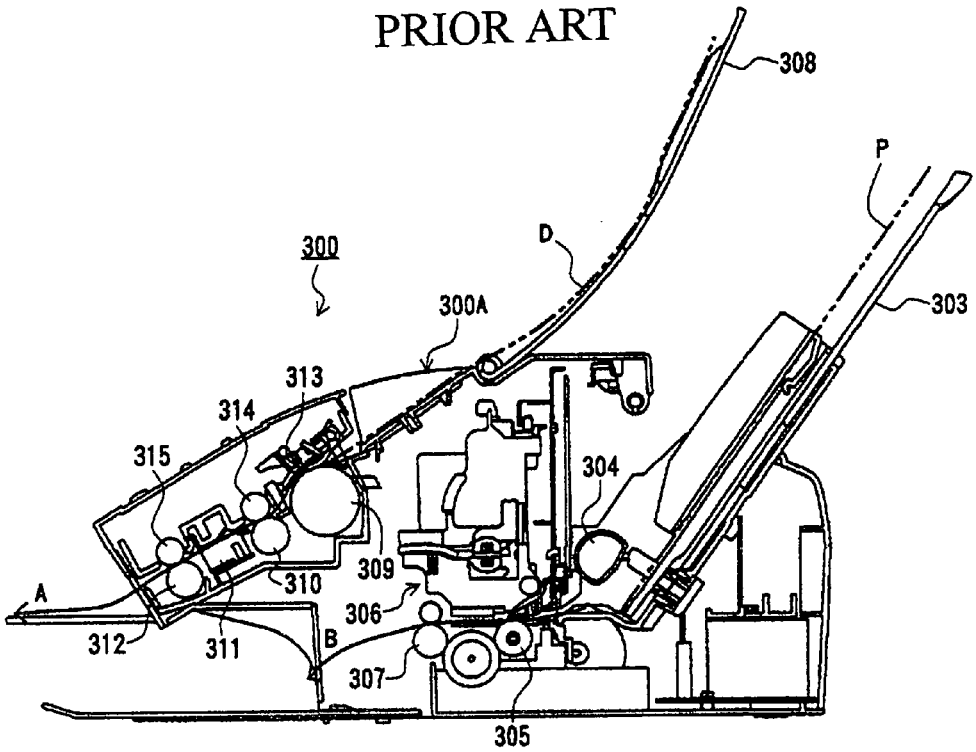
FIG.68 PRIOR ART
FIG. 68 is a cross-sectional view taken along the feeding direction of the document and the recording paper in the conventional image reading and recording apparatus.

With reference to the timing chart 4 shown in FIGS. 66 and 67, the reading mode will be explained. In FIG. 66, the "controlling member (A) recording position" is the position corresponding to the "position whereat the carriage starts switching the controlling member (A) from the reading position to the recording position" in FIG. 14. Moreover, the "controlling member (A) reading position" is the position corresponding to the "position whereat the carriage starts switching the controlling member (A) from the recording position to the reading position" in FIG. 14.

First, in the case where the carriage 4 is moved leftward from the initial state to the position whereat the carriage starts switching the controlling member (A) from the recording position to the reading position shown in FIG. 14. Thereby, as shown in FIG. 38, the controlling member (B) 114 is in the OFF state, and at the same time, the carriage cam 115 shown in FIG. 48 disposed on the carriage 4 passes through the hole formed in the side plate of the chassis 7 for pushing the surface of the controlling arm 121 so as to switch the controlling arm 121 into the ON (released state, see FIG. 48). This operation is shown in the timing chart 4 of FIG. 66 as the "controlling arm releasing operation". That is, the controlling arm 121 serves as position the detecting means for detecting the movement of the ink cartridge 1 as the recording means to the outside of the recording area.

Next, the feeding motor 104 shown in FIG. 15 is rotated forwardly for a predetermined number of steps. Then, the pendulum arm (B) 120 is rotated in the arrow A direction shown in FIG. 47 so as to stop the rotation whereat the planetary gear (B) 122 is engaged with the step gear (B) 123 (it is shown in the timing chart 4 of FIG. 66 as the "move of the CS by the reading switching means and drive switch to the document feeding means").

Then, according to the return of the carriage 4 to the capping position (it is shown in the timing chart 4 of FIG. 66 as the "move operation of the carriage to the capping position"), the controlling member (A) 113 is slid as shown in FIGS. 30, 32 and 24 so as to be in the OFF state (stopped state) so that the recording switching part 151 is maintained in the idle rotation state. However, even when the carriage 4 is returned, the pendulum arm (B) 121 is present between the controlling arm 121 and the chassis 7 so that the controlling arm 121 is stopped in the contacted state (ON, released state). Thereby, the engaged state of the planetary gear (B) 122 and the step gear (B) 123 is maintained. Subsequently, in the case where the feeding motor 104 is rotated forwardly, the CS gear 133 is rotated in the arrow A direction shown in FIGS. 15 and 17 via the planetary gear (B) 122, the step gear (B) 123, or the like.

Then, first, the coil spring 135 mounted on the body of the CS gear 133 is fastened so that the rotation of the feeding motor 104 is transmitted to the CS driving arm 134 for starting the rotation of the CS driving arm 34 in the arrow A direction in FIGS. 15, 17 and 50. At the time, since the end part of the second twisted coil spring 137 fixed on the CS driving arm 134 starts the rotation together, the torque for the rotation in the arrow A direction in FIGS. 15, 17 and 50 is generated also in the CS holder 26 via the other end part 136*a*. However, since the pressuring force of about 30 gcm is applied to the CS holder 26 by the first twisted coil spring 136 in the direction opposite to the arrow A in FIG. 17 (arrow B direction in FIG. 50) as mentioned above, the CS holder 26 does not start the rotation in the arrow A direction simultaneously.

As shown in FIG. 54, in the case where the feeding motor 104 proceeds the forward rotation so as to rotate the CS driving arm 134, the angle $\alpha 1$ formed by the end parts 136*a*, 136*b* of the first twisted coil spring 136 is gradually made smaller to $\alpha 2$ so that the torque generated by the first twisted coil spring exceeds about 300 g·cm. Then, the torque functioned by the end part 136*a* overcomes the pressuring force (about 300 g·cm) of the second twisted coil spring so that the CS holder 26 starts the rotation in the arrow A direction. Furthermore, in the case where the feeding motor 104 is rotated forwardly as shown in FIG. 56, the CS holder 26 is stopped at the position whereat the height positioning boss 26*c* of the CS holder 26 is contacted with the receiving part 3*h*, that is, at the position it is rotated to the reading position. Here, since the pressuring force in the B direction generated by the second twisted coil spring 137 is substantially 300 g·cm as mentioned above both at the first position (stand by position) and at the second position (reading position), it is rotated with the angle a formed by the two arms of the first twisted coil spring 136 provided constantly.

Furthermore, in the case where the feeding motor 104 is rotated forwardly as shown in FIG. 58, the CS driving arm 134 is rotated in a state with the CS holder 26 maintained at the reading position so as to twist the first twisted coil spring 136 for further making small the angle $\alpha 3$ formed by the two arms for applying the pressuring force in the arrow A direction in FIG. 17 to the CS holder 26. In the case where the end part 135*a* of the coil spring 135 is contacted with the stopper part 3*g* formed in the platen 3, the CS driving arm 134 is stopped at the position since the coil spring 135 is loosened so as to slip against the body of the CS gear 133. Thereby, the reading preparation of the CS holder 26 is finished.

Then, as shown in FIG. 17, simultaneously with this operation, the rotation is transmitted also to the one way gear 127 according to the forward rotation of the feeding motor 104 so as to be rotate the arrow A direction in FIG. 17. Then, since the one way gear is designed so as to transmit the rotation in the arrow A direction in FIG. 17 to the shaft, the gear part and the shaft part are rotated integrally so that the idle gear 128 mounted on the shaft, and the document feeding roller gear 129 and the document separating roller gear 131 interlocked therewith are rotated (see FIG. 19).

In the case where the document separating roller gear 131 is rotated, the document separating roller 131 is rotated via the timer member 130 shown in FIGS. 17 and 34 so as to separate and convey the document. The movement of the CS holder 26 and the feed of the document are started at the same time with the forward rotation of the feeding motor 104. The document feeding speed and the CS holder 26 moving timing are adjusted and designed such that the document reaches at the CS 22 after finishing the movement of the CS holder 26 to the second position (reading position) (it is shown in the timing chart 4 of FIG. 66 as the "move of the CS to the reading position and move of the document to the reading position"). By continuing the forward rotation of the feeding motor 104 in this state, the documents can be separated, fed, read out, and discharged successively (it is shown in the timing chart of FIG. 66 as the "move of the CS to the reading position and move of the document to the reading position", the "document feed and reading state, and the "document paper discharging state"). After discharging the final document, the feeding motor 104 is stopped.

At the time, although the force is applied to the CS holder 26 in the arrow B direction shown in FIG. 58 so as to be returned to the first position (stand by position) according to the difference of the elastic force of the first, second twisted coil springs 136, 137, since the CS gear 133 cannot be rotated backwardly due to the detent torque of the feeding motor 104, the CS holder 26 is stopped at the position (second position (reading position)). Next, in the case where the feeding motor 104 is rotated backwardly, the pendulum arm (B) 120 is rotated in the arrow F direction shown in FIG. 44 so that the engagement of the planetary gear (B) 122 and the step gear (B) 123 is released.

Then, since the gear row from the step gear (B) 123 to the downstream side is made free, the CS gear 133 is rotated backwardly according to the above-mentioned force so that the CS holder 26 is moved to the stand by position (it is shown as the "recovery operation of the CS to the stand by state" in the timing chart 4 of FIG. 66). At the time, since the one way gear 127 is rotated in the opposite direction with respect to the arrow A direction in FIG. 17, only the gear part is rotated without rotating the shaft part, and thus the document feeding roller 51, and the document separating roller 15 are not rotated. Next, the carriage 4 is moved leftward to the position whereat the carriage starts switching the controlling member (A) from the reading position to the recording position shown in FIG. 14 so as to switch the controlling member (A) 113 into the ON (released position) (the "operation of switching on the controlling member (A)" in the timing chart 4 of FIG. 67), it is returned again to the capping position so as to be in the initial state.

According to the initial state explained in the item of the (initializing operation) with reference to the timing chart 1 shown in FIGS. 60 and 61, the recording paper feeding operation can be executed without operating the recording switching part 151 by the forward rotation of the feeding motor 104 of the image reading and recording apparatus 91 in the initial state, and thereafter, the recording paper feeding operation and the recording operation can be executed. Moreover, by rotating the feeding motor 104 backwardly from the initial state, the ink vacuuming operation can be executed without operating the recording switching part 151. This is same as the stand by state in the case of using the recording part 46 as a printer itself. Then, it is moved to the reading operation by operating the controlling member (A) 113, the reading switching part 154, and the controlling arm 121.

Thereby, the image reading and recording apparatus 91 of this embodiment can operate the reading part 28 only by adding the parts and the sequence necessary for reading with the constituent member of the recording part 46 and the software controlling the operation as they are or changed slightly, and thus the apparatus having both the image forming function and the image reading function can be provided easily with the printer recording part used as the base.

Jamming Process

Next, the processing operation at the time the document is stopped in the halfway of the feed due to the document jamming, the blackout, or the like will be explained. The image reading and recording apparatus 91 comprises two detection sequences for the jamming detection. According to the first sequence, the image reading and recording apparatus 91 judges that the jamming has been generated in the case where the top end of the document is not detected by the PE sensor lever 21 shown in FIG. 2 in a predetermined time from the start of the document feed. Moreover, according to the second sequence, the image reading and recording apparatus 91 judges that the jamming has been generated in the case where the rear end of the document is not detected in a predetermined time after detection of the top end of the document by the PE sensor lever 21. Then, in the case where the image reading and recording apparatus 91 detects the jamming, it stops the feeding motor 104 and the reading operation so as to notify the jamming generation to the user by the LCD and the error sound.

Then, the user eliminates the jammed document from the inside of the image reading and recording apparatus 91. At the time, the image reading and recording apparatus 91 is in the "document feed and reading state" of the timing chart 4 shown in FIGS. 66 and 67. Moreover, the document separating roller 15 and the document feeding roller 51 shown in FIG. 15 are interlocked with the feeding motor 104 via the reading switching part 154 in the CS rotating position with the planetary gear (B) 122 engaged with the step gear (B) 123 shown in FIGS. 47 to 49 so as not to be rotated easily by the detent torque of the motor. Therefore, even though the user would pull out the document, it cannot be pulled out, and in the case where he tries to pull it out forcibly, the document may be torn.

Then, in the case where the user presses the releasing button 140 in the arrow B direction in FIG. 49, as it has been explained in the item of the (document feed and the CS moving driving system row), the oblique surface 140*a* pushes the rib 120*b* so as to rotate the pendulum arm (B) 120 in the arrow F direction in FIG. 47. Then, the planetary gear (B) 122 is separated from the step gear (B) 123. At the same time, the rib 120*a* moves out from between the chassis 7 and the surface 121*c* so that the engagement of the pendulum arm (B) 120 and the controlling arm 121 is detached. Then, as shown in FIGS. 44 to 46, the rib 120*a* is contacted with the end face 121*d* so that the controlling arm 121 is returned to the above-mentioned OFF state (stopped state).

As a result, the gears of the gear row on the downstream side of the step gear (B) 132 are in the rotatable state so that the document separating roller 15 and the document feeding roller 51 become rotatable as well, and thus the document can be eliminated easily from the image reading and recording apparatus 91. Moreover, simultaneously with the elimination of the document, the CS holder 26 is moved to the CS holder first position (stand by potion) by the second twisted coil spring 137. Then, the image reading and recording apparatus 91 executes the initializing operation explained in the item of the (initializing operation) based on the timing chart 1 shown in FIGS. 60 and 61 according to the user operation so as to return to the stand by state.

What is claimed is:

1. An image reading and recording apparatus comprising:

a first driving source;

a recording sheet feeding means for feeding a recording sheet;

a recording means for recording an image on the recording sheet, fed by the recording sheet feeding means, in a predetermined recording area, and movable to the outside of the recording area;

a document feeding means for feeding a document;

a reading means movable between the reading position for reading an image on the document, fed by the document feeding means, and the stand by position withdrawn from the reading position;

a recording sheet feeding force transmitting means for transmitting the driving force of the first driving source to the recording sheet feeding means;

a document feeding force transmitting means for transmitting the driving force of the first driving source to the document feeding means;

a switching controlling means for switching the transmission of the driving force of the first driving source either to the recording sheet feeding force transmitting means or the document feeding force transmitting means;

a moving means for moving the reading means to the reading position by the driving force of the document feeding force transmitting means; and a second driving source for moving the recording means, wherein the switching controlling means is switched by the movement of the recording means.

2. The image reading and recording apparatus according to claim 1, wherein the movement of the reading means to the reading position is interlocked with the movement of the recording means to outside of the recording area.

3. The image reading and recording apparatus according to claim 2, wherein the movement of the reading means to the reading position is executed, following the position detecting means for detecting the movement of the recording means to the outside of the recording area.

4. The image reading and recording apparatus according to claim 1, wherein the switching controlling means comprises a first switching controlling means for controlling the transmission of the driving force from the first driving source to the recording sheet feeding force transmitting means and the release of the transmission, and a second switching controlling means for controlling the transmission of the driving force from the first driving source to the document feeding force transmitting means and release of the transmission.

5. The image reading and recording apparatus according to claim 4, wherein the second switching controlling means comprises a releasing member for manually releasing the transmission of the driving force of the first driving source to the document feeding force transmitting means.

6. The image reading and recording apparatus according to claim 1, wherein there is a time zone with the operation of the document feeding means for feeding the document to the reading position, and the operation of the moving means for moving the reading means to the reading position executed at the same time.

7. The image reading and recording apparatus according to claim 1, wherein the conveying path for the recording sheet to be fed by the recording sheet feeding means, and the conveying path for the document to be fed by the document feeding means have at least partially a common conveying path.

8. The image reading and recording apparatus according to claim 7, wherein a reading density reference member is mounted on the reading means, and the reading density reference member is withdrawn from the common conveying path together with the reading means in the case the reading means is at the stand by position.

9. The image reading and recording apparatus according to claim 8, wherein a document conveying path is formed between the image reading means and the reading density reference member, and the document conveying path coincides with the recording sheet conveying path at the time the image reading means is moved to the reading position.

10. The image reading and recording apparatus according to claim 8, wherein the reading density reference member comprises a white sheet member.

11. The image reading and recording apparatus according to claim 1, wherein the recording means is reciprocally movable serial recording means.

12. The image reading and recording apparatus according to claim 1, wherein the recording means is an ink jet recording type recording means.

13. The image reading and recording apparatus according to claim 1, wherein the driving source is a pulse motor.

14. The image reading and recording apparatus according to claim 1, wherein the recording sheet feeding force transmitting means is disposed on one side of the recording area for recording an image onto the recording sheet by the recording means, and the document feeding force transmitting means is disposed on the other side.

15. The image reading and recording apparatus according to claim 1, wherein the document feeding force transmitting means comprises a delaying means for transmitting the driving force from the first driving source to the document feeding means with a predetermined time lag such that the document reaches at the position to be read by the reading means after moving the reading means to the reading position.

16. An image reading and recording apparatus comprising:

a first driving source;

a recording sheet feeding means for feeding a recording sheet;

a recording means for recording an image on the recording sheet, fed by the recording sheet feeding means, in a predetermined recording area, and movable to the outside of the recording area;

a document feeding means for feeding a document;

a reading means movable between the reading position for reading an image on the document, fed by the document feeding means, and the stand by position withdrawn from the reading position;

a recording sheet feeding force transmitting means for transmitting the driving force of the first driving source to the recording sheet feeding means;

a document feeding force transmitting means for transmitting the driving force of the first driving source to the document feeding means;

a switching controlling means for switching the transmission of the driving force of the first driving source either to the recording sheet feeding force transmitting means or the document feeding force transmitting means; and a moving means for moving the reading means to the reading position by the driving force of the document feeding force transmitting means, wherein there is a time zone with the operation of the document feeding means for feeding the document to the reading position, and the operation of the moving means for moving the reading means to the reading position executed at the same time.

17. An image reading and recording apparatus comprising:

a first driving source;

a recording sheet feeding means for feeding a recording sheet;

a recording means for recording an image on the recording sheet, fed by the recording sheet feeding means, in a predetermined recording area, and movable to the outside of the recording area;

a document feeding means for feeding a document;

a reading means movable between the reading position for reading an image on the document, fed by the document feeding means, and the stand by position withdrawn from the reading position;

a recording sheet feeding force transmitting means for transmitting the driving force of the first driving source to the recording sheet feeding means;

a document feeding force transmitting means for transmitting the driving force of the first driving source to the document feeding means;

a switching controlling means for switching the transmission of the driving force of the first driving source either to the recording sheet feeding force transmitting means or the document feeding force transmitting means; and a moving means for moving the reading means to the reading position by the driving force of the document feeding force transmitting means, wherein the recording sheet feeding force transmitting means is disposed on one side of the recording area for recording an image onto the recording sheet by the recording means, and the document feeding force transmitting means is disposed on the other side.

18. An image reading and recording apparatus comprising:

a first driving source;

a recording sheet feeding means for feeding a recording sheet;

a recording means for recording an image on the recording sheet, fed by the recording sheet feeding means, in a predetermined recording area, and movable to the outside of the recording area;

a document feeding means for feeding a document;

a reading means movable between the reading position for reading an image on the document, fed by the document feeding means, and the stand by position withdrawn from the reading position;

a recording sheet feeding force transmitting means for transmitting the driving force of the first driving source to the recording sheet feeding means;

a document feeding force transmitting means for transmitting the driving force of the first driving source to the document feeding means;

a switching controlling means for switching the transmission of the driving force of the first driving source either to the recording sheet feeding force transmitting means or the document feeding force transmitting means; and a moving means for moving the reading means to the reading position by the driving force of the document feeding force transmitting means, wherein the document feeding force transmitting means comprises a delaying means for transmitting the driving force from the first driving source to the document feeding means with a predetermined time lag such that the document reaches at the position to be read by the reading means after moving the reading means to the reading position.

* * * * *

UNITED STATES PATENT AND TRADEMARK OFFICE

CERTIFICATE OF CORRECTION

PATENT NO. : 7,077,517 B2
APPLICATION NO. : 10/739347
DATED : July 18, 2006
INVENTOR(S) : Takashi Awai et al.

It is certified that error appears in the above-identified patent and that said Letters Patent is hereby corrected as shown below:

ON THE TITLE PAGE, AT ITEM (57), Abstract:
Line 10, “stand by” should read --standby--.

COLUMN 3:
Line 50, “a” should be deleted.

COLUMN 6:
Line 1, “form” should read --from--.
Line 29, “form” should read --from--.

COLUMN 8:
Line 38, “8in” should read --8 in--.

COLUMN 9:
Line 5, “stand by” should read --standby--.
Line 25, “form” should read --from--.
Line 46, “form” should read --from--.

COLUMN 12:
Line 20, “pat” should read --part--.

COLUMN 13:
Line 9, “then,” should read --Then,--.

COLUMN 14:
Line 40, “stand by” should read --standby--.

COLUMN 16:
Line 30, “like” should read --line--.

COLUMN 19:
Lines 55 and 56, “carriageZ2” should read --carriage Z2--.

COLUMN 20:
Line 9, “he” should read --the--.

COLUMN 21:
Line 53, “form” should read --from--.

COLUMN 22:
Line 6, “non engaged” should read --non-engaged--.

UNITED STATES PATENT AND TRADEMARK OFFICE

CERTIFICATE OF CORRECTION

PATENT NO. : 7,077,517 B2
APPLICATION NO. : 10/739347
DATED : July 18, 2006
INVENTOR(S) : Takashi Awai et al.

It is certified that error appears in the above-identified patent and that said Letters Patent is hereby corrected as shown below:

COLUMN 23:
Line 10, “eh” should read --the--.
Line 28, “form” should read --from--.

COLUMN 24:
Line 48, “form” should read --from--.

COLUMN 27:
Line 3, “stand by” should read --standby--.

COLUMN 29:
Line 5, “stand by” should read --standby--.
Line 29, “an” should be deleted.

COLUMN 31:
Line 42, “(stand by” should read --(standby--.
Line 44; “a” should read --α--.
Line 63, “be rotate” should read --rotate in--.

COLUMN 32:
Line 26, “(stand by” should read --(standby--.
Line 39, “stand by” should read --standby--.
Line 66, “stand by” should read --standby--.

COLUMN 34:
Line 1, “(stand by” should read --(standby--.
Line 6, “stand by” should read --standby--.
Line 19, “stand by” should read --standby--.

COLUMN 35:
Line 12, “stand by” should read --standby--.
Line 57, “stand by” should read --standby--.

UNITED STATES PATENT AND TRADEMARK OFFICE

CERTIFICATE OF CORRECTION

PATENT NO. : 7,077,517 B2
APPLICATION NO. : 10/739347
DATED : July 18, 2006
INVENTOR(S) : Takashi Awai et al.

It is certified that error appears in the above-identified patent and that said Letters Patent is hereby corrected as shown below:

COLUMN 36:
Line 24, "stand by" should read --standby--.
Line 57, "stand by" should read --standby--.

Signed and Sealed this

Twelfth Day of June, 2007

JON W. DUDAS
*Director of the United States Patent and Trademark Office*